US008132369B2

(12) United States Patent
Pettit et al.

(10) Patent No.: US 8,132,369 B2
(45) **Date of Patent: *Mar. 13, 2012**

(54) INTEGRATED TILT/SASH LOCK ASSEMBLY

(75) Inventors: Dean Pettit, St. John, IN (US); Mark B. Eenigenburg, Lansing, IL (US)

(73) Assignee: Newell Operating Company, Huntersville, NC (US)

( * ) Notice: Subject to any disclaimer, the term of this patent is extended or adjusted under 35 U.S.C. 154(b) by 68 days.

This patent is subject to a terminal disclaimer.

(21) Appl. No.: 12/567,655

(22) Filed: Sep. 25, 2009

(65) Prior Publication Data

US 2010/0050528 A1 Mar. 4, 2010

Related U.S. Application Data

(60) Division of application No. 10/863,089, filed on Jun. 8, 2004, now Pat. No. 7,607,262, which is a continuation-in-part of application No. 10/289,803, filed on Nov. 7, 2002, now Pat. No. 7,013,603.

(51) Int. Cl.
*E05F 1/00* (2006.01)

(52) U.S. Cl. ..... 49/449; 49/181; 292/DIG. 20; 292/DIG. 47

(58) Field of Classification Search ..... 49/176, 49/181, 449; 292/240, 194, 197, 200, DIG. 20, 292/DIG. 47

See application file for complete search history.

(56) References Cited

U.S. PATENT DOCUMENTS 166,842 A 8/1875 Berryman
176,360 A 6/1876 Cooper
178,360 A 6/1876 Cooper
201,146 A 3/1878 Adler
336,302 A 2/1886 Dudgeon
346,788 A 8/1886 Teufel
376,252 A 1/1888 McIntyre
410,728 A 9/1889 Brown
480,148 A 8/1892 Theby
509,941 A 12/1893 Perry
512,593 A 1/1894 Webster et al.
526,118 A 9/1894 Sharp
551,242 A 12/1895 Wallace (Continued)

FOREIGN PATENT DOCUMENTS

GB 0341207 1/1931

(Continued)

*Primary Examiner* — Jerry Redman
(74) *Attorney, Agent, or Firm* — Taft Stettinius & Hollister LLP

(57) ABSTRACT

An integrated tilt/sash lock assembly for a sash window is disclosed. The sash window assembly has an upper sash window and a lower sash window slideable within a master frame, the integrated assembly has a keeper adapted to be connected to the upper sash window. A rotor assembly is adapted to be supported by the lower sash window, the rotor assembly having a rotor connected to a spool. A latch bolt is adapted to be supported by the lower sash window and is adapted to engage the master frame. A connector has a first end connected to the spool and a second end connected to the latch bolt. An actuator is connected to the rotor assembly. The actuator has a locked position wherein the rotor engages the keeper. The actuator is moveable to an unlocked position wherein the rotor assembly is disengaged from the keeper, and is further moveable to a tiltable position wherein the connector retracts the latch bolt from the master frame.

11 Claims, 37 Drawing Sheets

U.S. PATENT DOCUMENTS 590,225 A 9/1897 Hill
722,162 A 3/1903 St. Louis
759,642 A 5/1904 Sparks
878,206 A 2/1908 Johnson
948,628 A 2/1910 Jefferis
966,063 A 8/1910 Toothaker
980,131 A 12/1910 Shean
998,642 A 7/1911 Shean
1,006,211 A 10/1911 Hermon
1,041,803 A 10/1912 Kilburn
1,051,918 A 2/1913 Rowley
1,059,999 A 4/1913 James et al.
1,141,437 A 6/1915 Unterlender
1,243,115 A 10/1917 Shur
1,253,810 A 1/1918 Gianninoto
1,270,740 A 6/1918 Keyes
1,393,628 A 10/1921 Leichter
1,550,532 A 8/1925 French
1,552,690 A 9/1925 Frantz
1,704,946 A 3/1929 Lindgren
1,712,792 A 5/1929 Hansen .
1,715,957 A 6/1929 Stein
1,794,171 A 2/1931 Grutel
1,864,253 A 6/1932 McIntyre
1,869,274 A 7/1932 Phillips
1,901,974 A 3/1933 Macy
1,922,062 A 8/1933 Sullivan
1,964,114 A 6/1934 Gerlach et al.
2,095,057 A 10/1937 Corrado
2,122,661 A 7/1938 Rightmyer
2,126,995 A 8/1938 Kingdon
2,272,145 A 2/1942 Anderson et al.
2,369,584 A 2/1945 Lundholm
2,452,521 A 10/1948 Johnson et al.
2,500,849 A 3/1950 Menns
2,537,736 A 1/1951 Carlson
2,766,492 A 10/1956 Day et al.
2,818,919 A 1/1958 Sylvan
3,027,188 A 3/1962 Eichstadt
3,187,526 A 6/1965 Moler
3,362,740 A 1/1968 Burns
3,438,153 A 4/1969 Lemme
3,599,452 A 8/1971 Maruyama et al.
3,683,652 A 8/1972 Halopoff et al.
3,811,718 A 5/1974 Bates
3,919,808 A 11/1975 Simmons
4,068,871 A 1/1978 Mercer
4,151,682 A 5/1979 Schmidt
4,165,894 A 8/1979 Wojciechowski
4,227,345 A 10/1980 Durham, Jr.
4,253,688 A 3/1981 Hosooka
4,303,264 A 12/1981 Uehara
4,305,612 A 12/1981 Hunt et al.
4,392,329 A 7/1983 Suzuki
4,470,277 A 9/1984 Uyeda
4,475,311 A 10/1984 Gibson
4,525,952 A 7/1985 Cunningham et al.
4,580,366 A 4/1986 Hardy
4,587,759 A 5/1986 Gray
4,624,073 A 11/1986 Randall
4,639,021 A 1/1987 Hope
4,643,005 A 2/1987 Logas
4,801,164 A * 1/1989 Mosch ..... 292/204
4,827,685 A 5/1989 Schmidt
4,893,849 A 1/1990 Schlack
4,922,658 A 5/1990 Coddens
4,949,506 A 8/1990 Durham, Jr.
4,961,286 A 10/1990 Bezubic
5,072,464 A 12/1991 Draheim et al.
5,076,015 A 12/1991 Manzalini
5,087,087 A 2/1992 Vetter et al.
5,087,088 A 2/1992 Milam
5,090,750 A 2/1992 Lindqvist
5,127,685 A 7/1992 Dallaire et al.
5,139,291 A 8/1992 Schultz
5,143,412 A 9/1992 Lindqvist
5,165,737 A 11/1992 Riegelman
5,183,310 A 2/1993 Shaughnessy
5,244,238 A 9/1993 Lindqvist
5,274,955 A 1/1994 Dallaire et al.
5,341,752 A 8/1994 Hambleton
5,398,447 A 3/1995 Morse
5,437,484 A 8/1995 Yamada
5,454,609 A 10/1995 Slocomb et al.
5,560,149 A 10/1996 Lafevre
5,636,475 A 6/1997 Nidelkoff
5,688,000 A 11/1997 Dolman
5,715,631 A 2/1998 Kailian et al.
5,791,700 A 8/1998 Biro
5,829,196 A 11/1998 Maier
5,873,199 A 2/1999 Meunier et al.
5,901,499 A 5/1999 Delaske et al.
5,911,763 A 6/1999 Quesada
5,970,656 A 10/1999 Maier
5,992,907 A 11/1999 Sheldon et al.
6,086,121 A 7/2000 Buckland
6,135,510 A 10/2000 Diginosa
6,139,071 A 10/2000 Hopper
6,142,541 A 11/2000 Rotondi
6,155,615 A 12/2000 Schultz
6,161,335 A 12/2000 Beard et al.
6,176,041 B1 1/2001 Roberts
6,178,696 B1 1/2001 Liang
6,183,024 B1 2/2001 Schultz et al.
6,209,931 B1 4/2001 Stoutenborough et al.
6,217,087 B1 4/2001 Fuller
6,230,443 B1 5/2001 Schultz
6,257,303 B1 7/2001 Coubray et al.
6,279,266 B1 8/2001 Searcy
6,422,287 B1 7/2002 Wilke
6,546,671 B2 4/2003 Mitchell et al.
6,565,133 B1 5/2003 Timothy
6,588,150 B1 7/2003 Wong et al.
6,592,155 B1 7/2003 Lemley et al.
6,607,221 B1 8/2003 Elliott
6,631,931 B2 10/2003 Magnusson ..... 292/175
6,817,142 B2 11/2004 Marshik
6,871,885 B2 3/2005 Goldenberg et al.
6,877,784 B2 4/2005 Kelley et al. ..... 292/241
7,013,603 B2 3/2006 Eenigenburg et al. ..... 49/185
7,070,211 B2 7/2006 Polowinczak et al.
7,481,470 B2 1/2009 Eenigenburg et al.
7,607,262 B2 10/2009 Eenigenburg et al.

FOREIGN PATENT DOCUMENTS

GB 2026594 2/1980

* cited by examiner

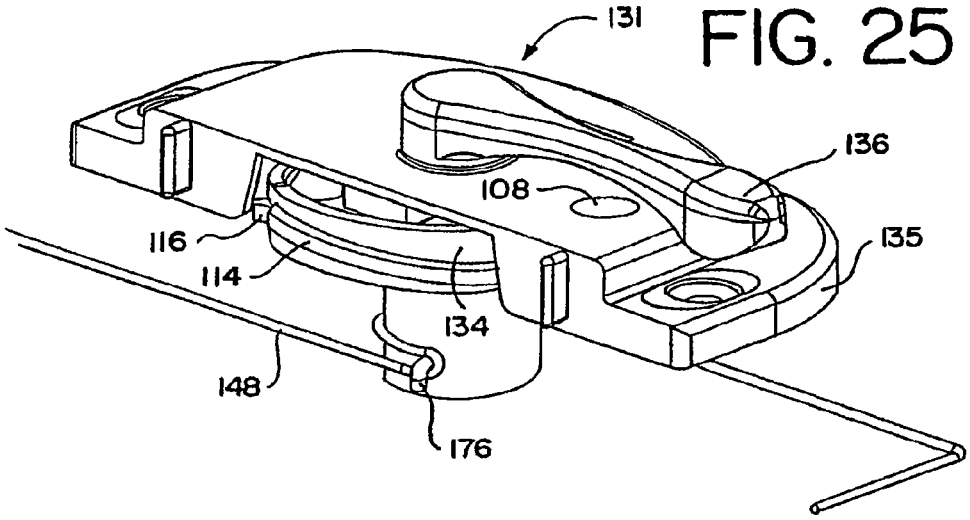
FIG. 25
FIG. 26
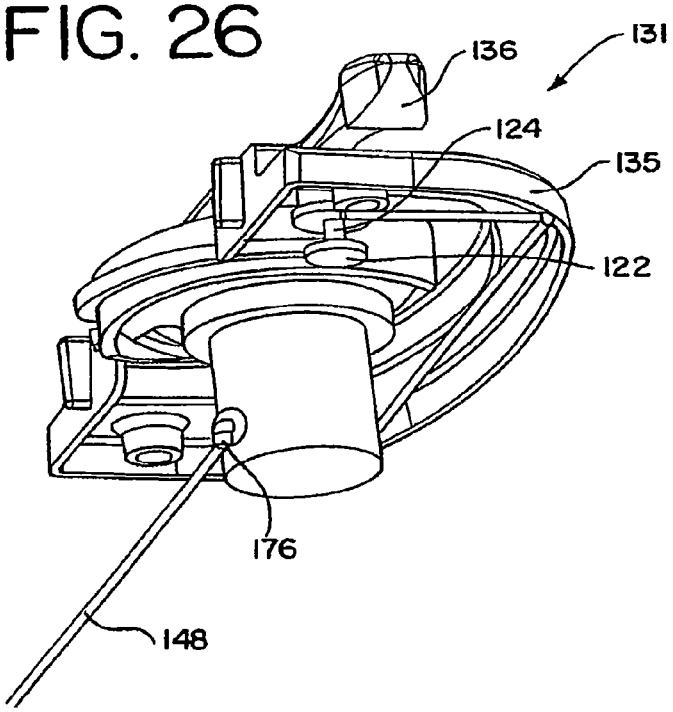

FIG. 32
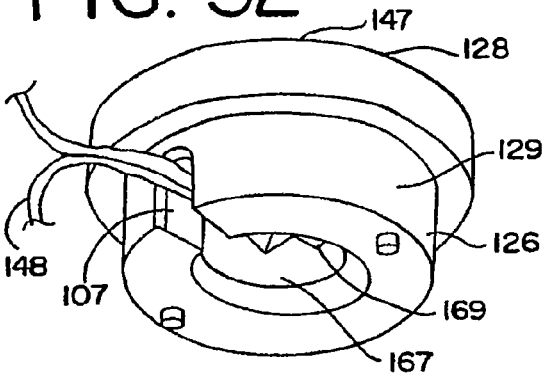
FIG. 33
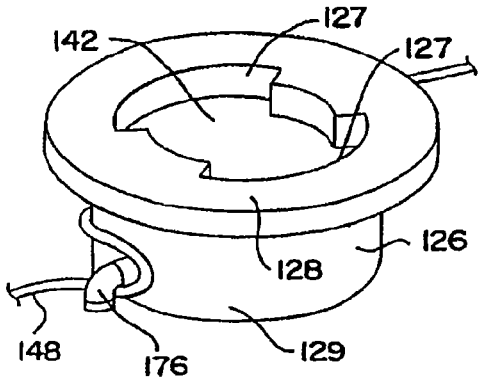
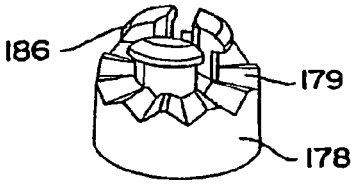
FIG. 34
FIG. 35
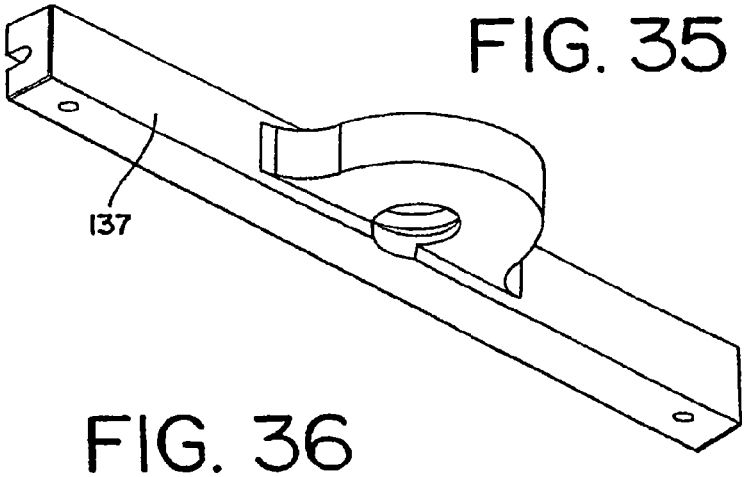
FIG. 36
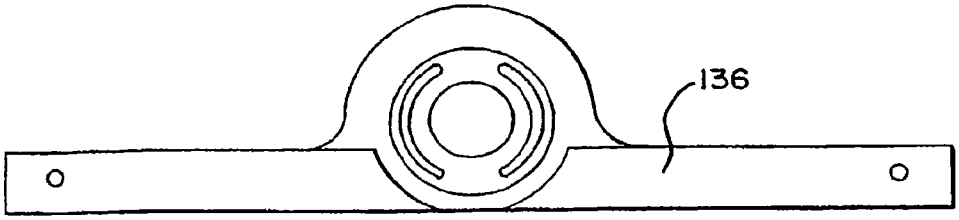

INTEGRATED TILT/SASH LOCK ASSEMBLY

Related Applications

This application is a divisional and claims the benefit of U.S. application Ser. No. 10/863,089, filed on Jun. 8, 2004 which application is a continuation-in-part of and claims the benefit of U.S. patent application Ser. No. 10/289,803, filed Nov. 7, 2002 which issued on Mar. 21, 2006 as U.S. Pat. No. 7,013,603. Both applications are incorporated entirely herein by reference and made a part hereof.

TECHNICAL FIELD

The present invention relates generally to sash window hardware and, more particularly, to an integrated tilt/sash lock assembly that performs a sash lock operation and a tilt-latch operation in a sash window assembly.

BACKGROUND OF THE INVENTION

Sash window assemblies are well-known. In one typical configuration, a sash window is slidably supported within a master frame. The master frame of the sash window assembly typically has opposed, vertically extending guide rails to enable vertical reciprocal sliding movement of the sash window while cooperatively engaged with the guide rails. The sash window has a top sash rail, a base and a pair of stiles cooperatively connected together at adjacent extremities thereof to form a sash frame, usually a rectangular frame. In another conventional configuration, a double-hung sash window assembly has a lower sash window and an upper sash window that are mounted for slidable movement along adjacent parallel guide rails in the master frame. To restrain upward sliding of the lower sash window, the sash window assembly typically employs a sash lock assembly generally consisting of a locking cam and a keeper. When it is desirable to lock the window to prevent upward sliding, an operator rotates the locking cam to engage the keeper.

The sash windows in these sash window assemblies are often constructed to allow for the sash windows to be tilted inward. This allows, for example, a homeowner to easily clean an outer surface of a glass pane of the sash window from inside of a dwelling. To allow for tilting, the sash window is pivotally mounted in the master frame at the base of the sash window, and the sash window is equipped with a tilt-latch. Typically, a tilt-latch is installed in opposite ends of the top rail of the sash window. The tilt-latches have a latch bolt that is biased outwardly for engagement with guide rails of the master frame. An operator manually engages the latch bolts and simultaneously retracts each latch bolt into the top rail. Once retracted, the latch bolts are then disengaged from the guide rails wherein the sash window can then be titled inward. In this configuration, an operator must use two hands to inwardly pivot the sash window since the latch bolts are required to be simultaneously retracted. This simultaneous retraction can be difficult for some operators. In addition, certain sash lock and tilt-latch designs have had an assortment of complex structures that are expensive and difficult to assemble and operate.

Some attempts have been made to provide an assembly that has a single actuator that operates both the sash lock and tilt-latch. U.S. Pat. Nos. 5,992,907; 5,398,447 and 5,090,750 are some examples of such structures. While this combined assembly assists in the overall operation of the sash window assembly, an assembly design that is simple in construction, is easy to assembly, and provides smooth, reliable operation is still difficult to achieve. Nevertheless, it remains desirable to provide an assembly that integrates the sash lock operation and the tilt latch operation.

Furthermore, it is desirable to provide a sash window assembly that has minimal exposed hardware such as the sash lock and tilt-latches. For example, it is desirable to provide a sash window having a substantially smooth line of sight. Many tilt-latches are mounted on a top surface of the top rail of the sash window. While a flush-mount tilt-latch is positioned substantially within the top rail, a top portion of the latch is still visible on the top rail. Similarly, sash lock assemblies are typically mounted on the top surface of the top rail of the sash window. Thus, it is desirable to provide a sash window assembly, that utilizes a sash lock and tilt-latches, that has a substantially smooth line of sight across the assembly.

The present invention is provided to solve these and other problems.

SUMMARY OF THE INVENTION

An integrated tilt/sash lock assembly for a sash window assembly is disclosed. The integrated assembly provides a sash lock operation and a tilt-latch operation.

According to one aspect of the present invention, the integrated assembly comprises a handle movable among a first, a second and a third position to adjust the assembly among a respective locked, unlocked and tiltable position. The integrated assembly further comprises a rotor coupled to the handle. The rotor has a locking cam and a pair of slots disposed therein. The integrated assembly also includes a keeper adapted to be supported by the sash window. The integrated assembly further includes a latch bolt housing having a latch bolt slidably disposed therein and a spring for biasing the latch bolt towards one of the guide rails. The integrated assembly further has a connector coupling the latch bolt to the rotor. The connector has a guide pin which slidably engages the slot in the rotor.

According to another aspect of the present invention, the integrated assembly comprises a handle movable among a first, a second and a third position to adjust the assembly among a respective locked, unlocked and tiltable position. The integrated assembly further comprises a rotor coupled to the handle. The rotor has a locking cam. The integrated assembly also includes a keeper adapted to be supported by the sash window. The integrated assembly further includes a latch bolt housing having a latch bolt slidably disposed therein and a spring for biasing the latch bolt towards one of the guide rails. The integrated assembly further has a connector coupling the latch bolt to the rotor. The connector is coupled proximate a first end to the latch bolt and proximate a second end to a first end of a linkage member. The second end of each of the linkage member is pivotably coupled to the rotor.

According to another aspect of the invention, the integrated assembly has rotor assembly having a rotor connected to a spool. A connector has one end connected to the spool and another end connected to the latch bolt. An actuator is connected to the rotor assembly. The actuator has a locked position wherein the rotor engages the keeper. The actuator is moveable to an unlocked position wherein the rotor assembly is disengaged from the keeper. The actuator is further moveable to a tiltable position wherein the connector retracts the latch bolt from the master frame.

According to another aspect of the invention, the integrated assembly has means for preventing the actuator from being moved from the unlocked position to the tiltable position.

According to a further aspect of the invention, an integrated assembly has a handle moveable among a first position, a second position, and a third position to adjust the assembly among a respective locked, unlocked and tiltable position. A rotor is coupled to the handle and has a locking cam. The rotor is positioned in the top rail of a lower sash window. A pawl is operably associated with the handle and has a base and an appending member. A keeper is provided and is adapted to be connected to an upper sash window. A latch bolt is adapted to be slideable within the top rail of the lower sash window. A connector has a first end coupled to the latch bolt and a second end operably engaged with the appending member of the pawl. Rotation of the handle rotates the pawl wherein the appending member engages the connector to retract the latch bolt.

According to another aspect of the invention, a sash lock handle is provided that is capable of being retracted into the top rail of the lower sash window. In the retracted position, the sash lock handle is substantially flush with a top surface of the top rail.

According to another aspect of the invention, a spool used in the integrated assembly has a channel offset from a center of the spool. A protrusion extends into the channel. A connector is received by the channel and in one preferred embodiment, the connector has a knot that is received within the channel.

According to another aspect of the invention, a fastener is used with the connector and latch bolt of the integrated assembly. The fastener comprises a clip having a base and a pair of legs extending from the base. The legs are configured to be releasably received by a slot in the latch bolt.

According to yet another aspect of the invention, the integrated assembly utilizes a sash lock housing having a central opening wherein an annular groove surrounds the central opening. An actuator extends through the central opening and has a protuberance received by the annular groove.

According to yet another aspect of the invention, the integrated assembly utilizes a connector having a first end attached to a latch bolt and a second end connected to a rotor of the integrated assembly. A portion of the connector is slidingly connected to a second latch bolt.

According to another aspect of the invention, the integrated assembly has a spool that forms a pinion. The assembly further has a latch bolt that forms a rack operably engaged with the pinion. Rotation of the spool operates to retract the latch bolt.

These and other objects and advantages will be made apparent from the following description of the drawings and detailed description of the invention.

Figure 7:
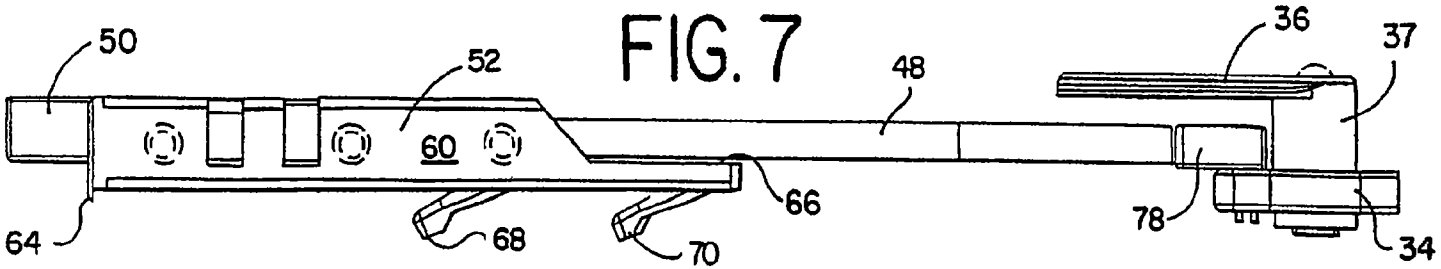
Figures 8, 9:
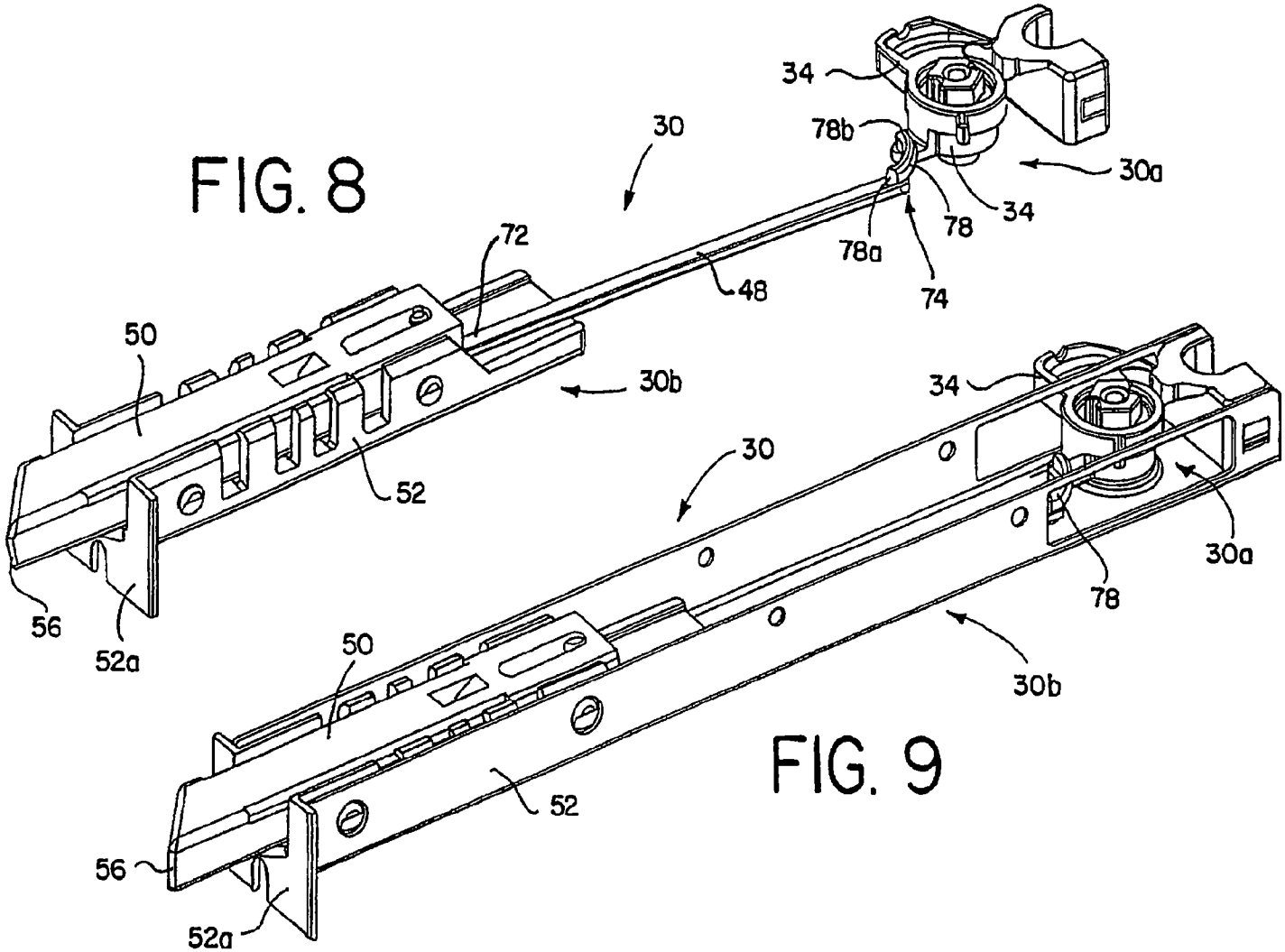
Figure 10:
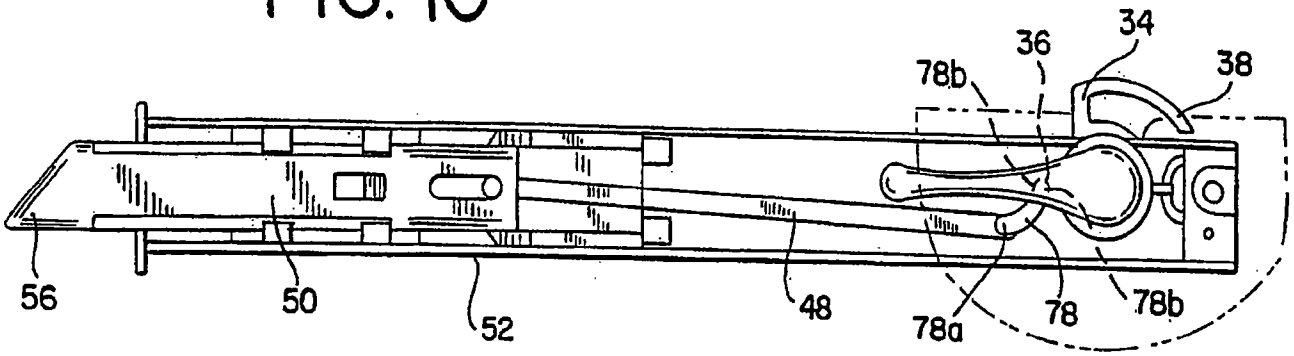
Figure 11:
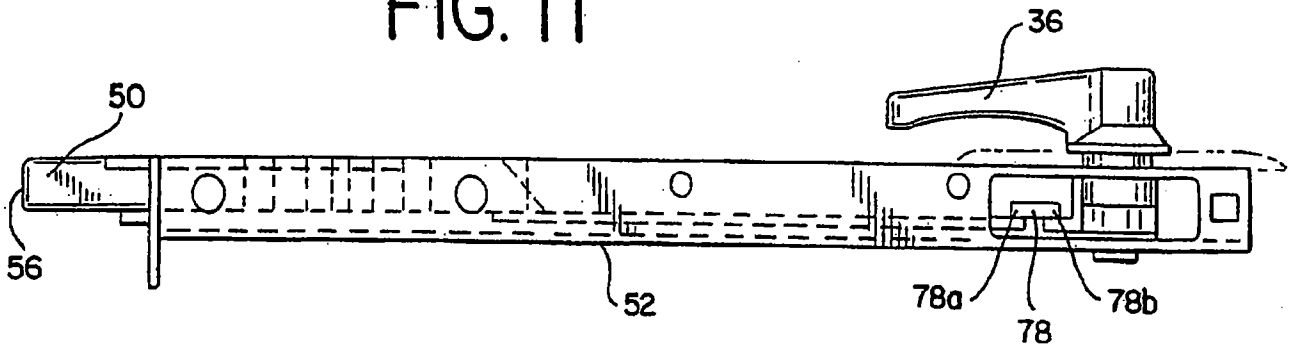
Figure 12:
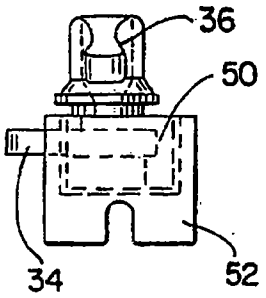
Figure 13:
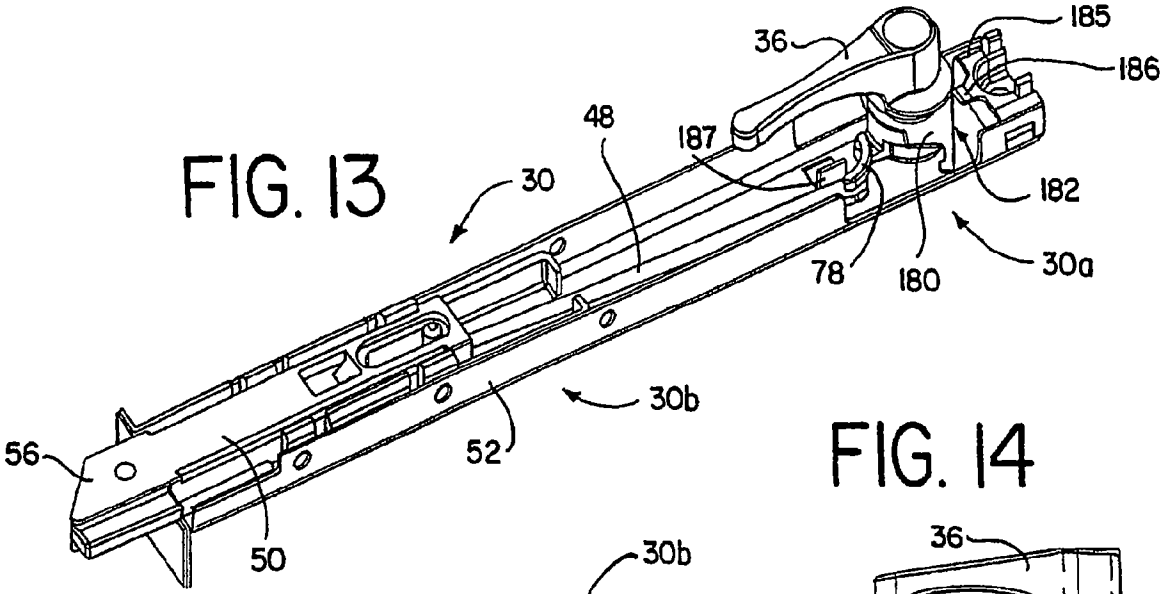
Figure 14:
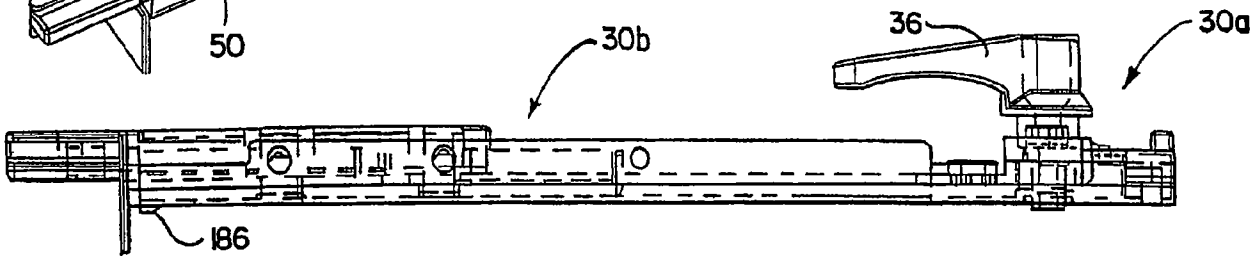
Figure 15:
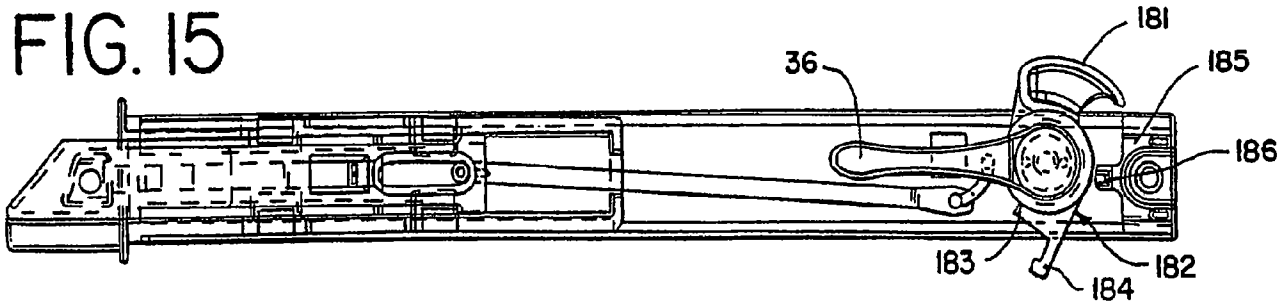
Figure 16:
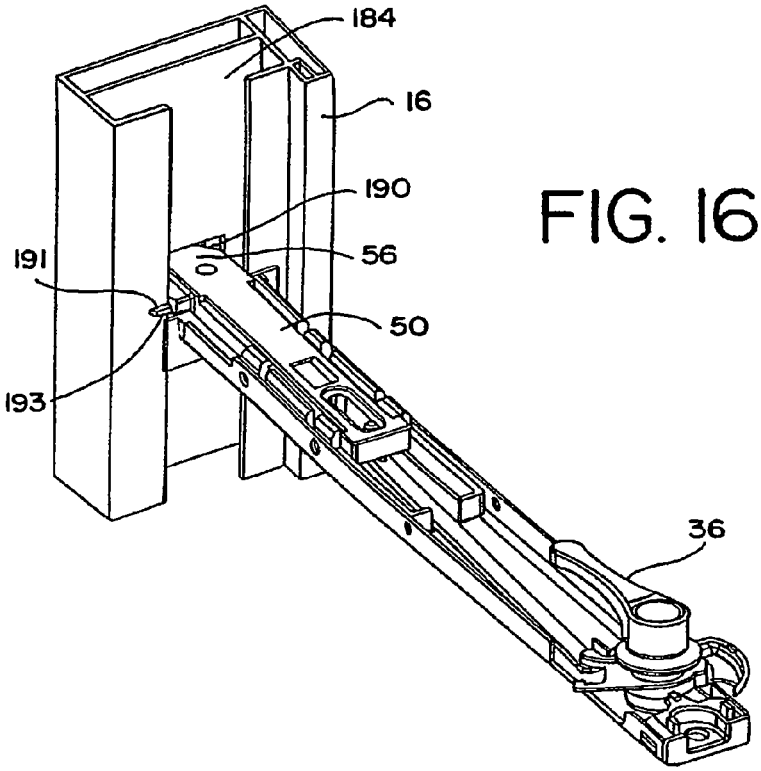
Figure 17:
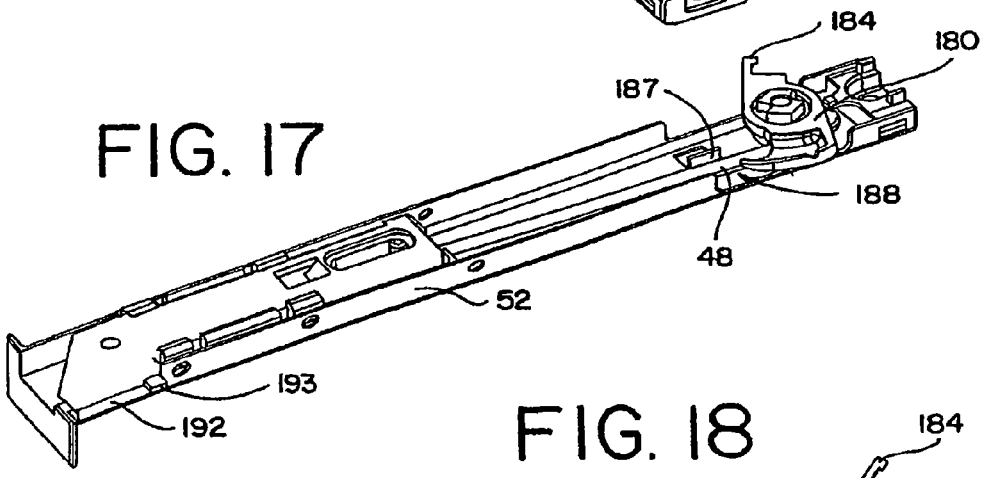
Figure 18:
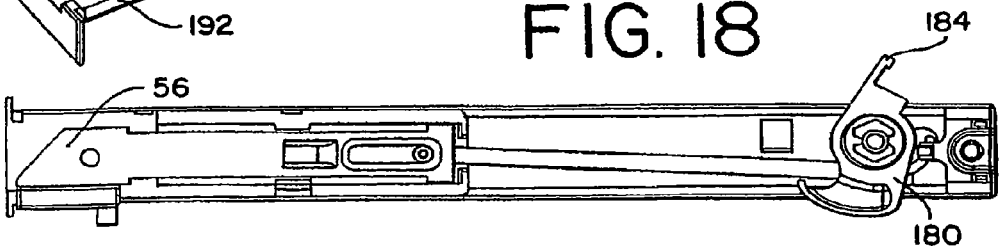
Figure 19:
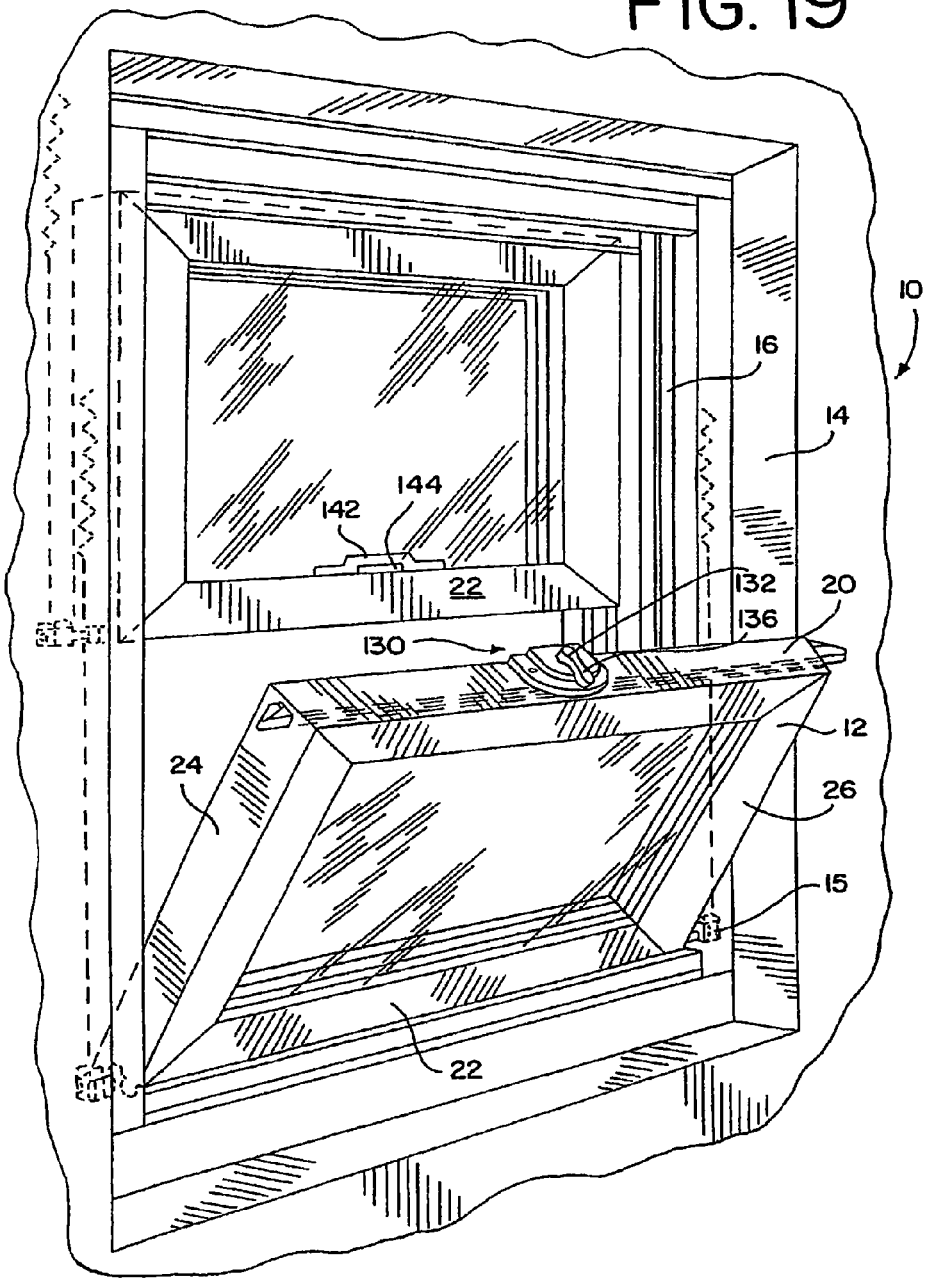
Figure 20:
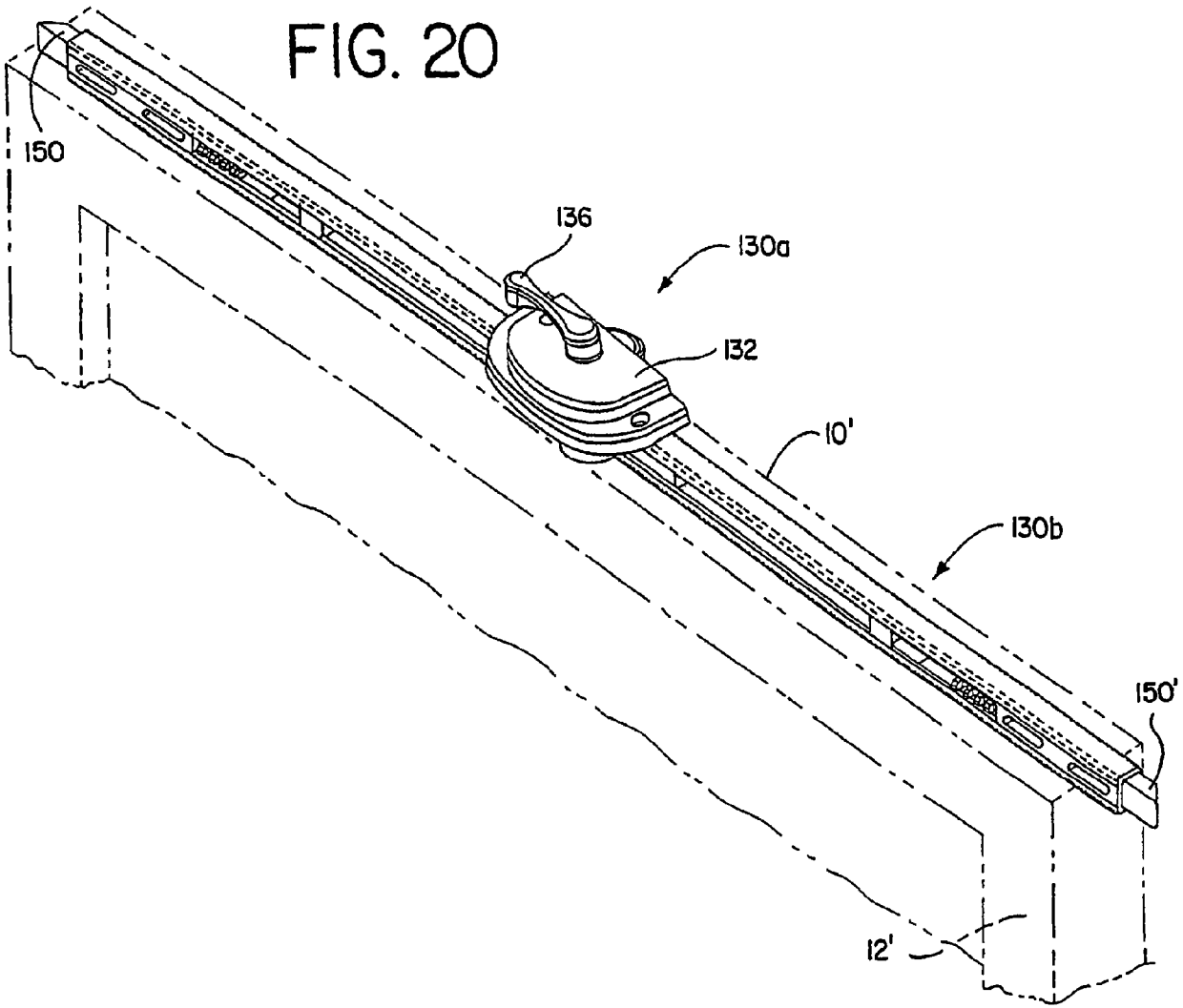
Figures 21, 22:
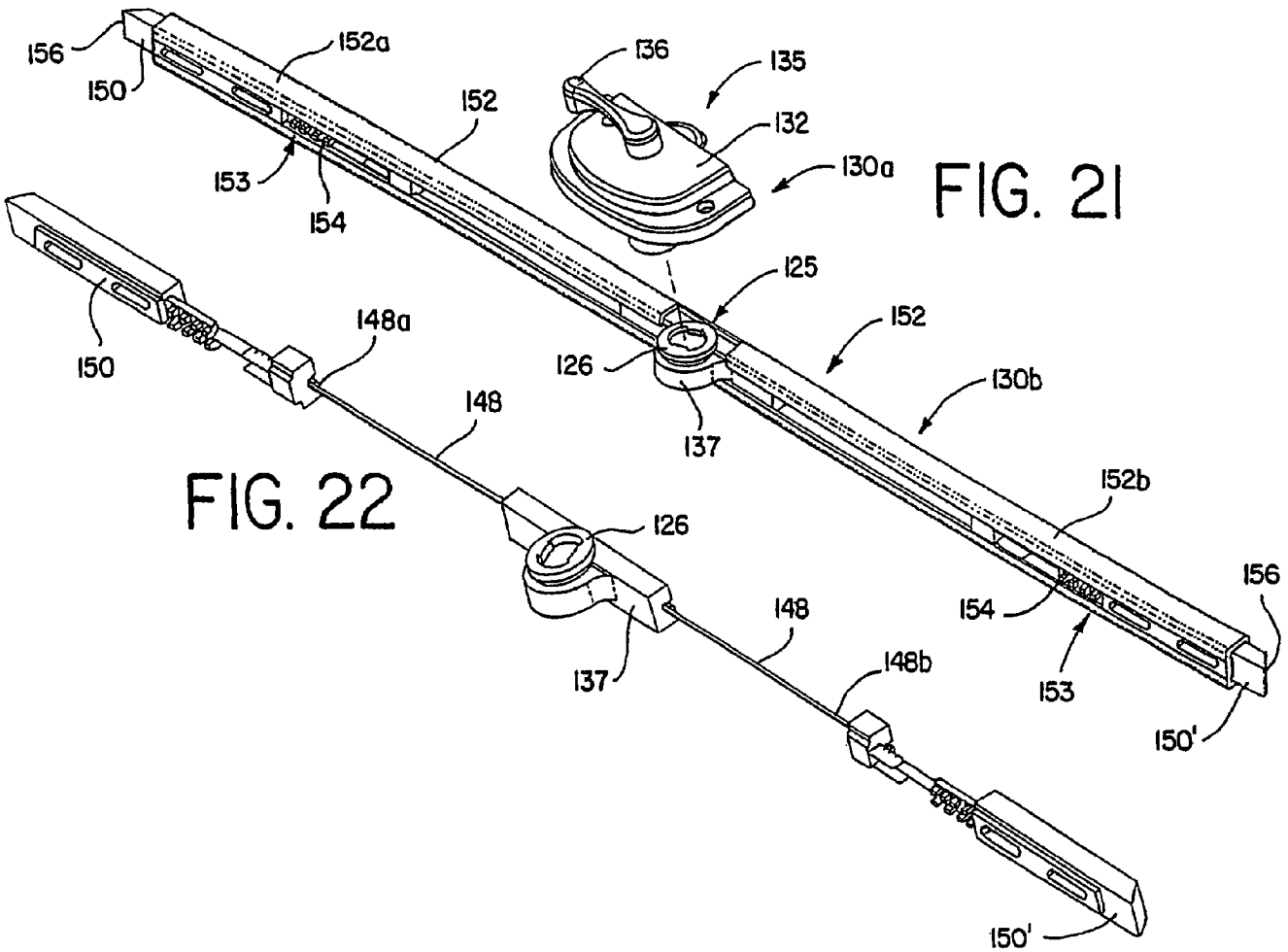
Figure 23:
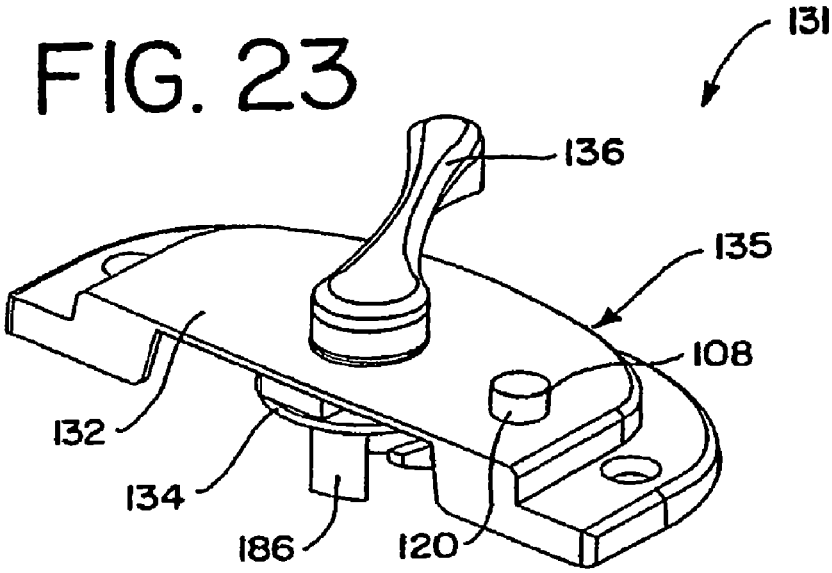
Figure 24:
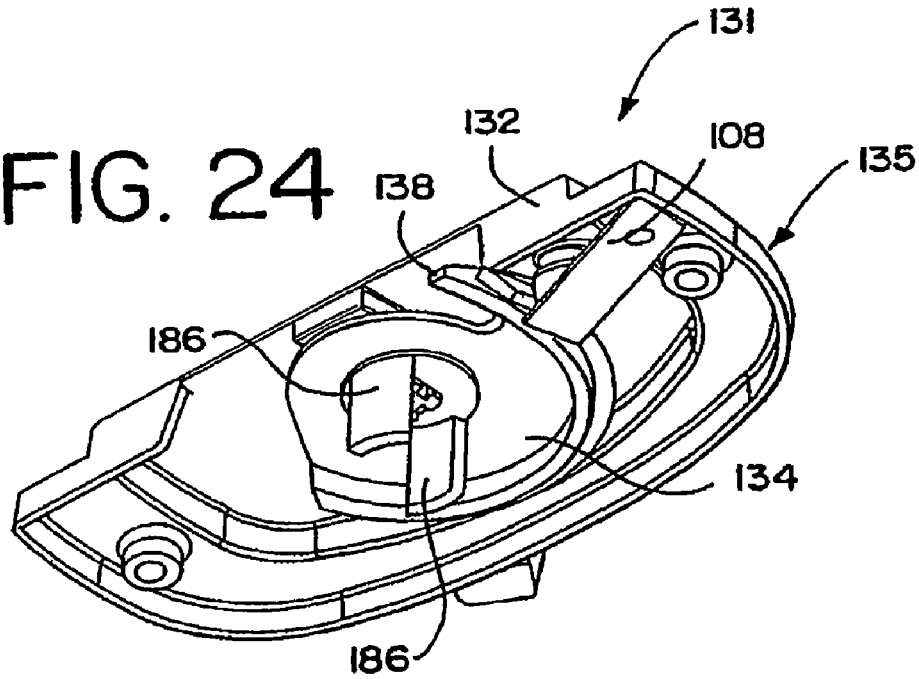
Figure 27:
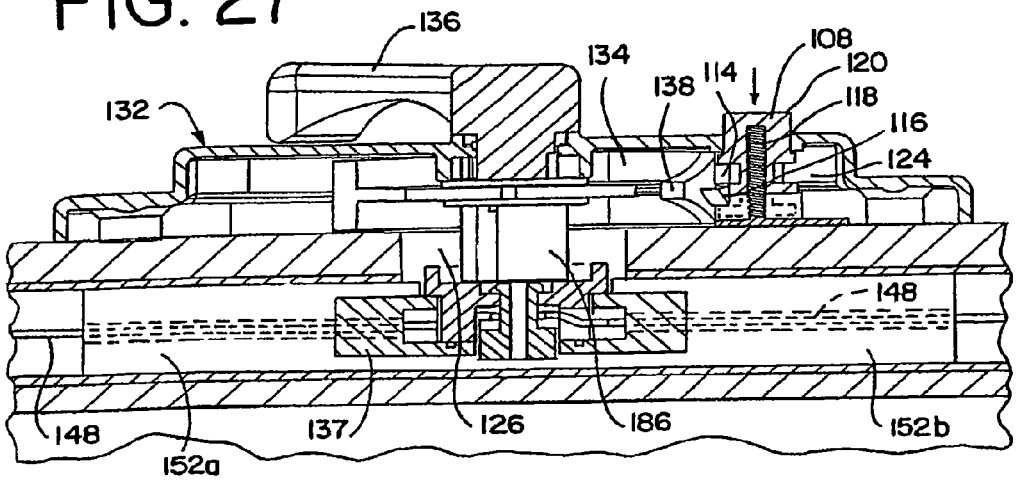
Figure 29:
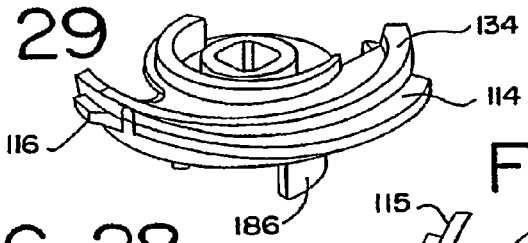
Figure 30:
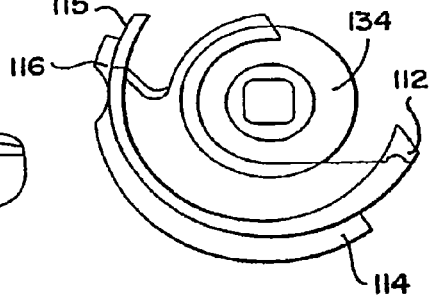
Figure 28:
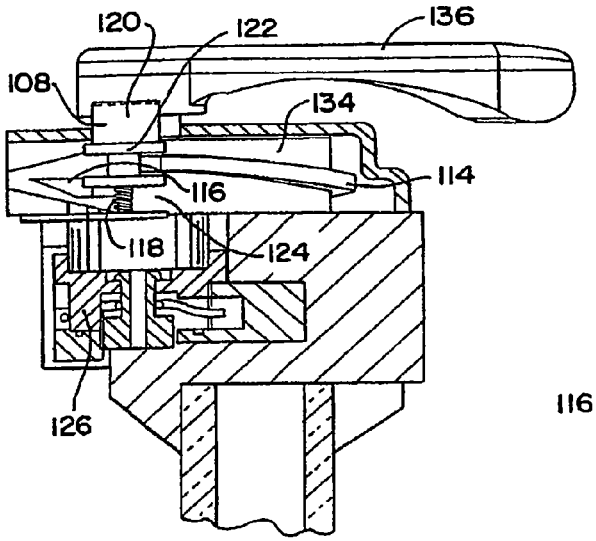
Figure 31:
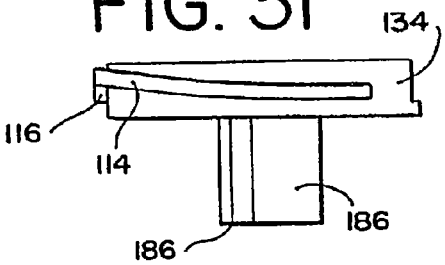
Figure 37:
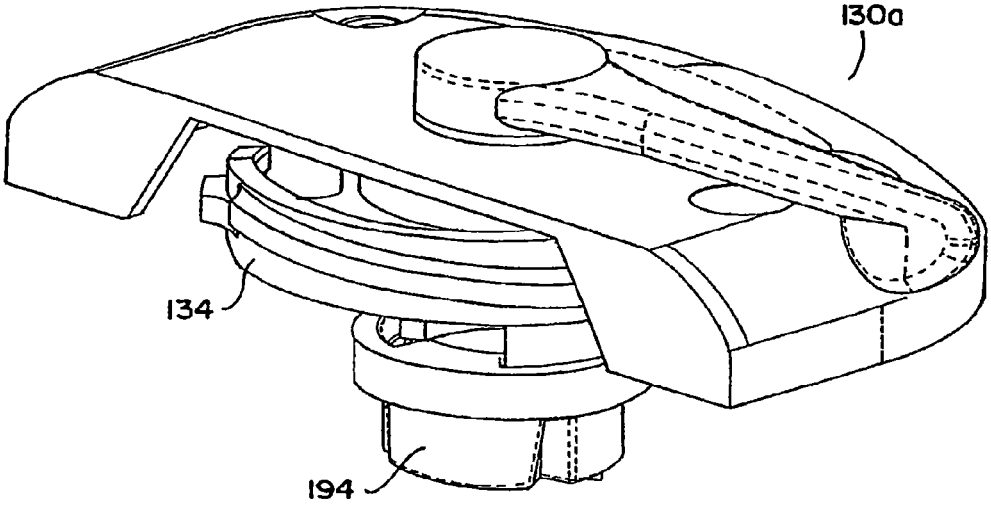
Figure 38:
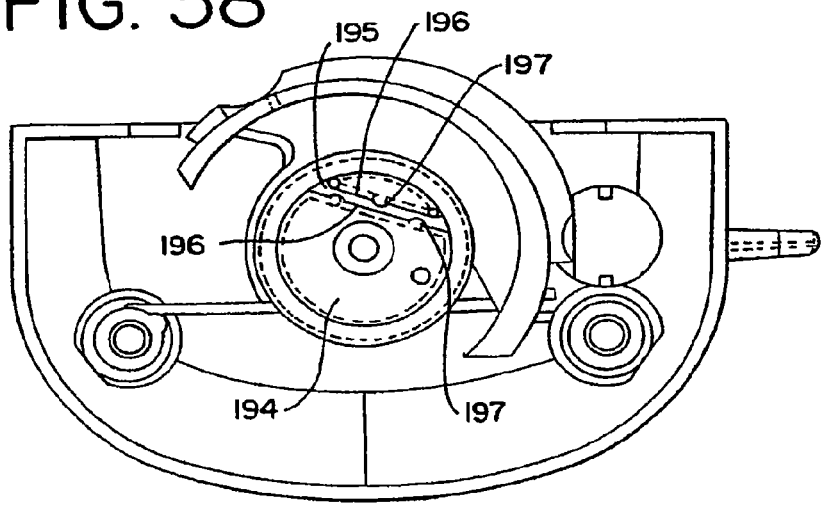
Figure 39:
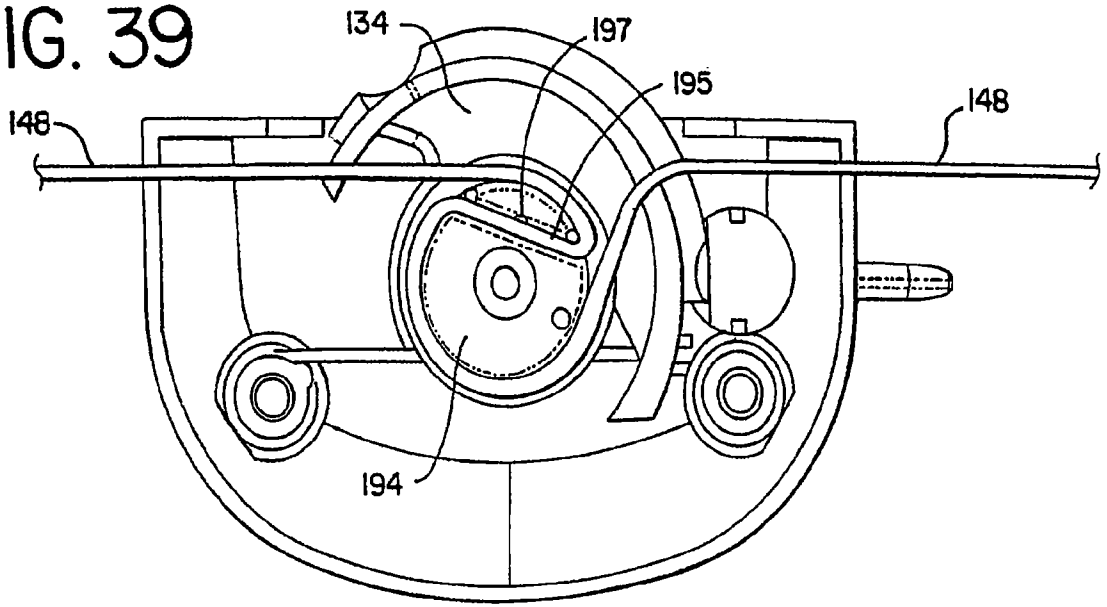
Figure 40:
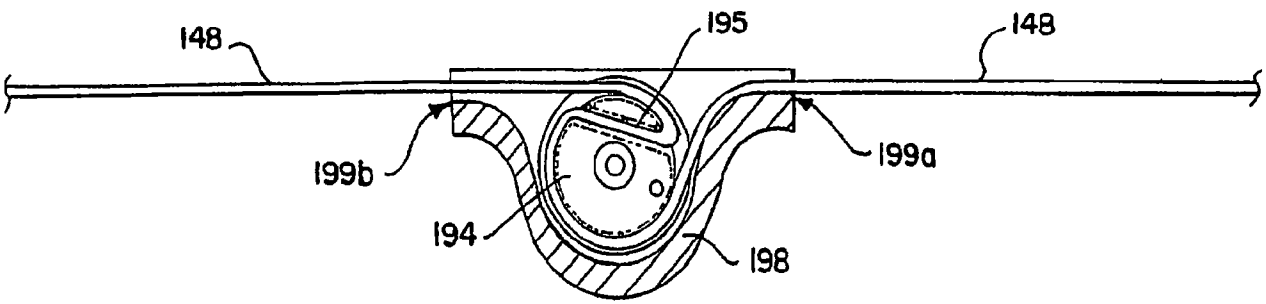
Figure 41:
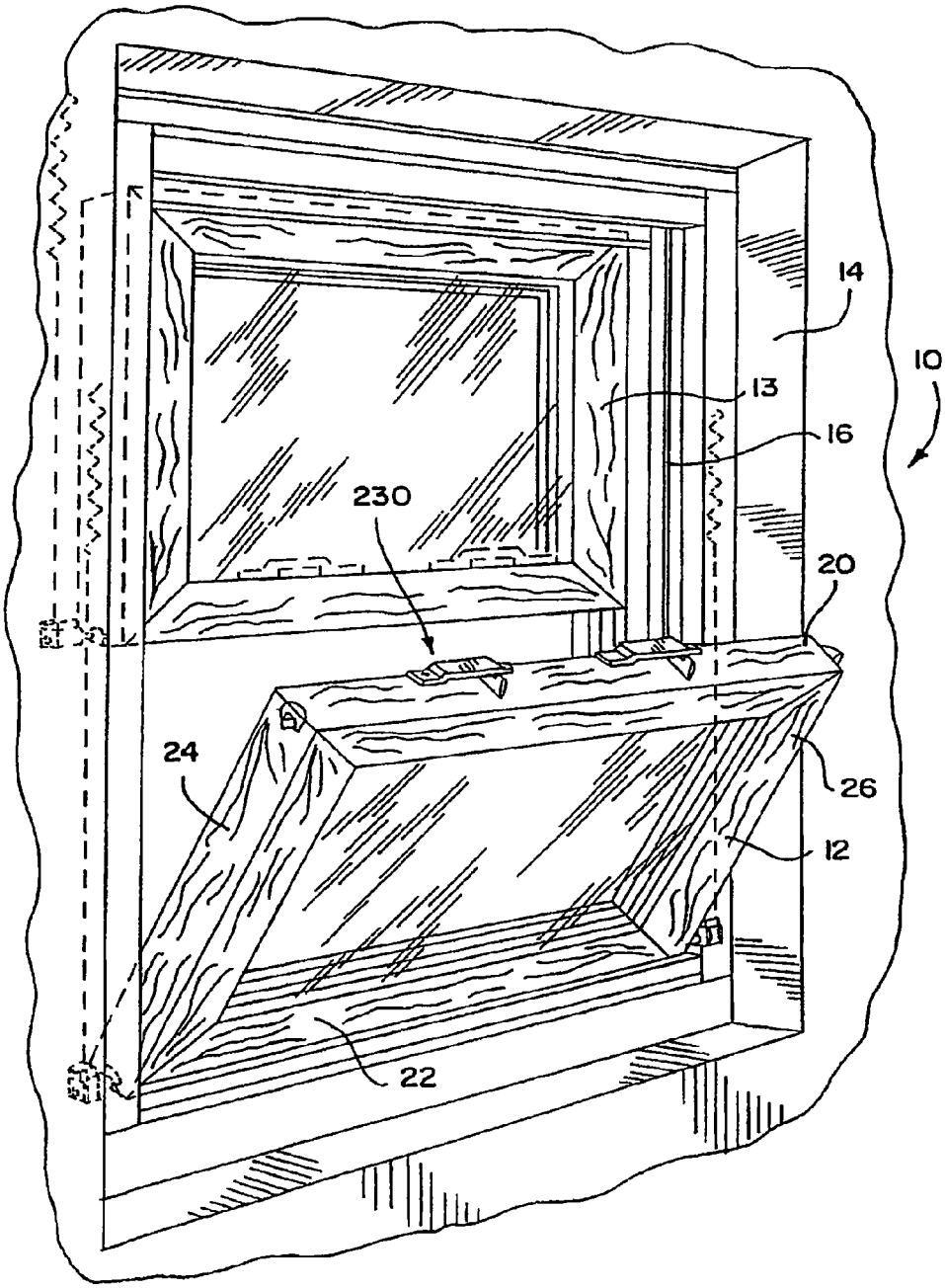
Figure 42:
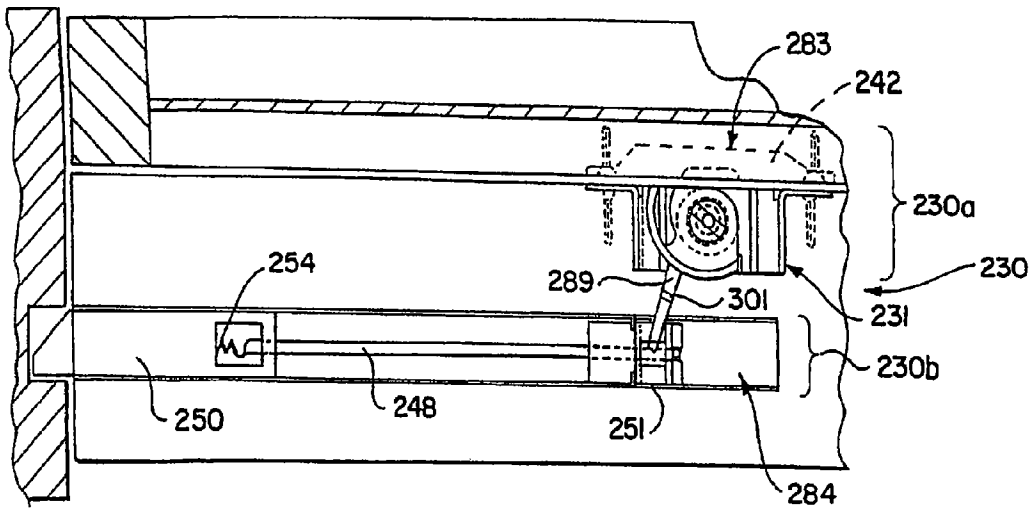
Figure 43:
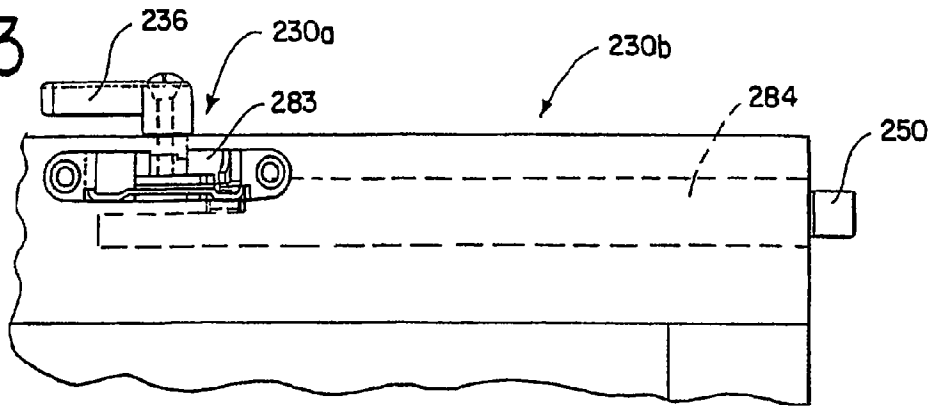
Figure 44:
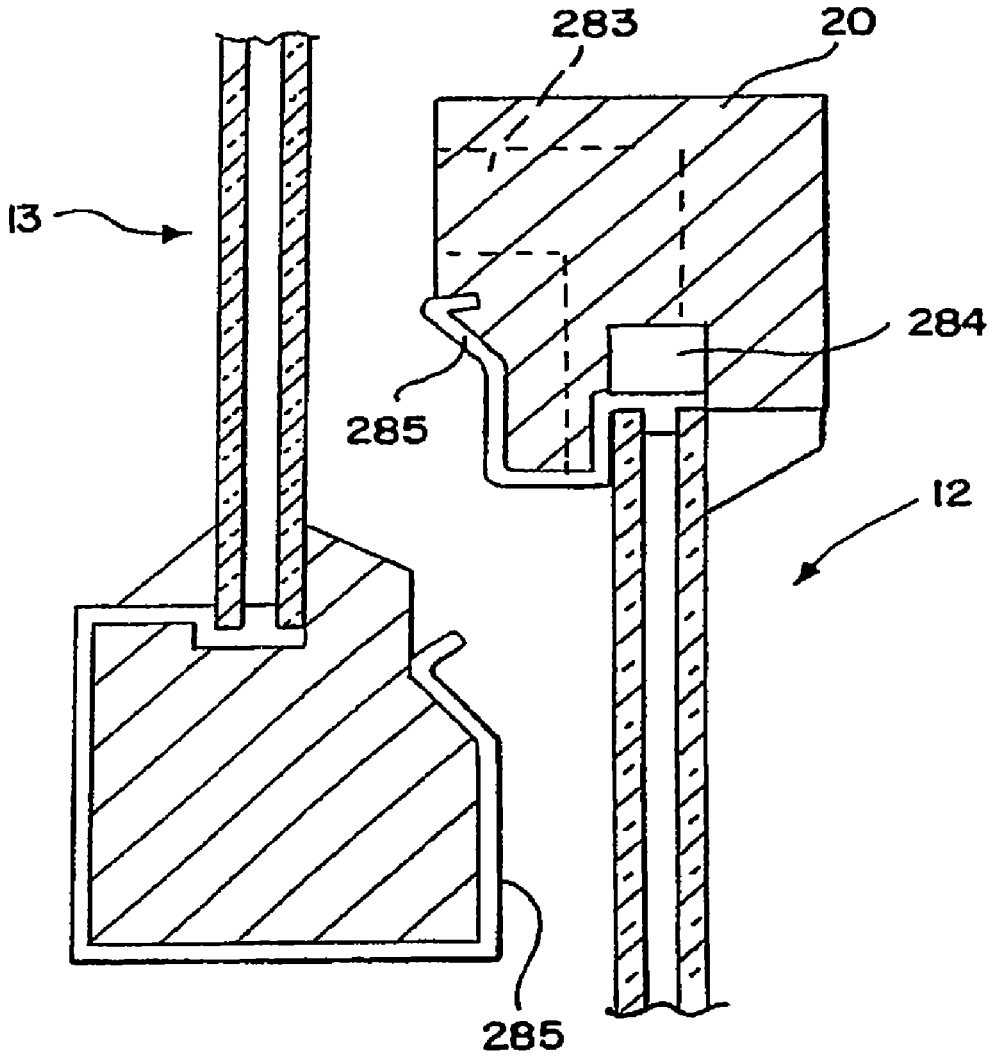
Figure 45:
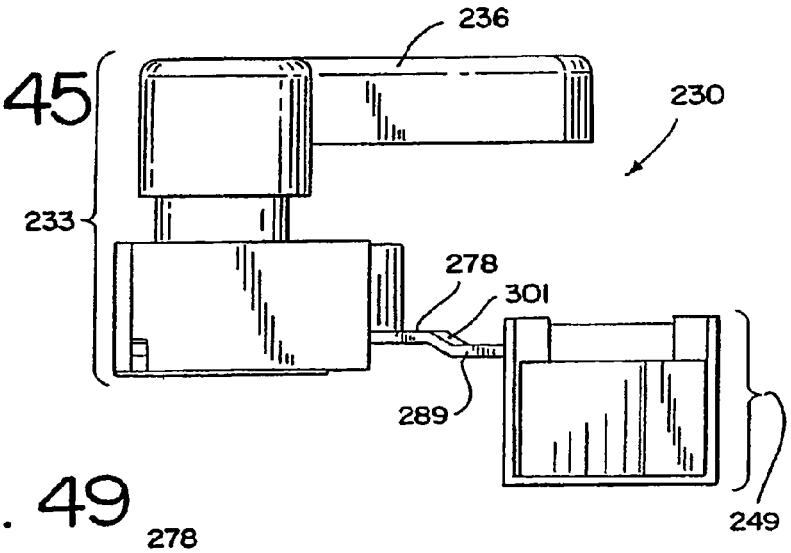
Figure 49:
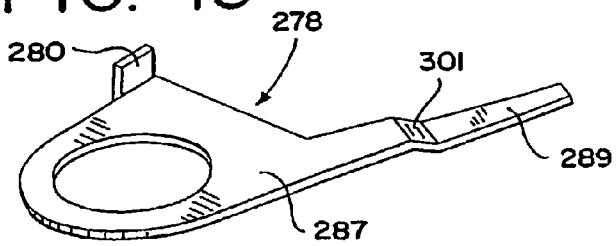
Figure 50:
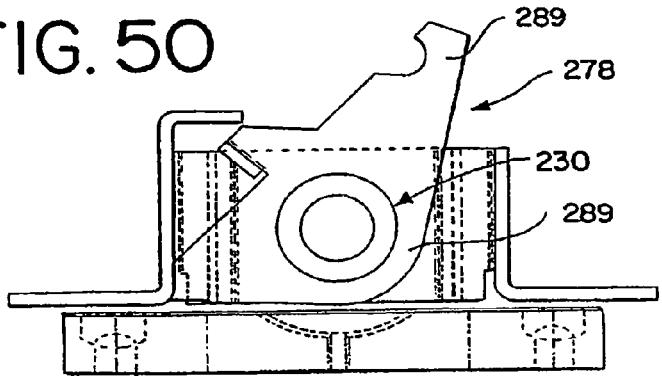
Figure 46:
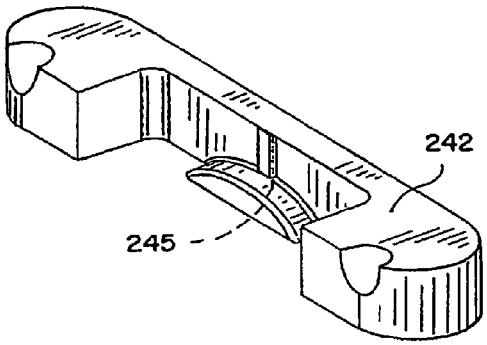
Figure 47:
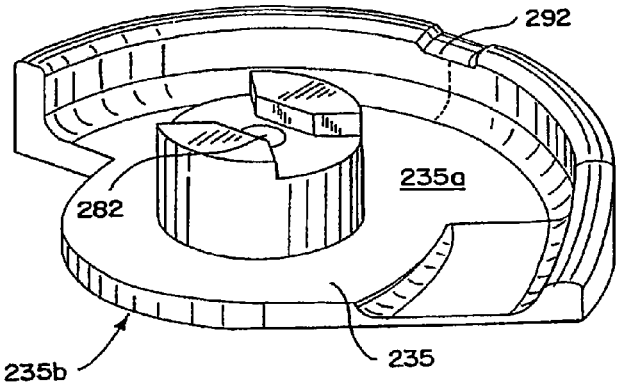
Figure 48:
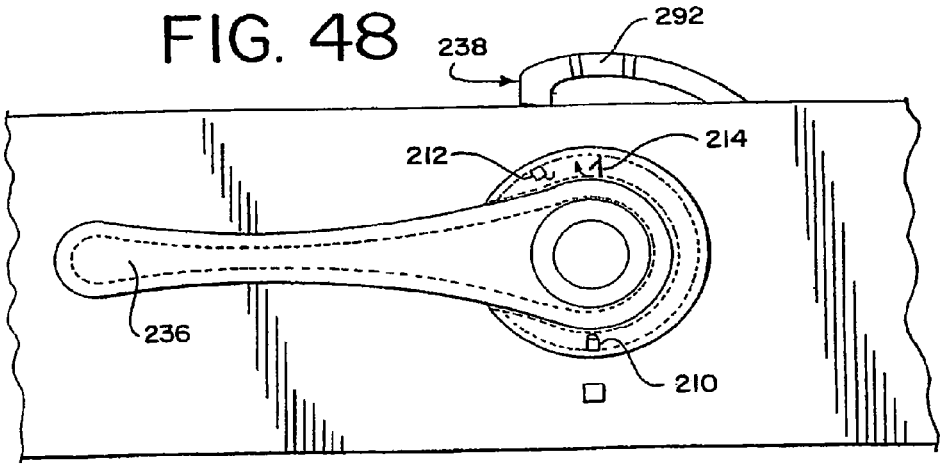
Figures 51, 52:
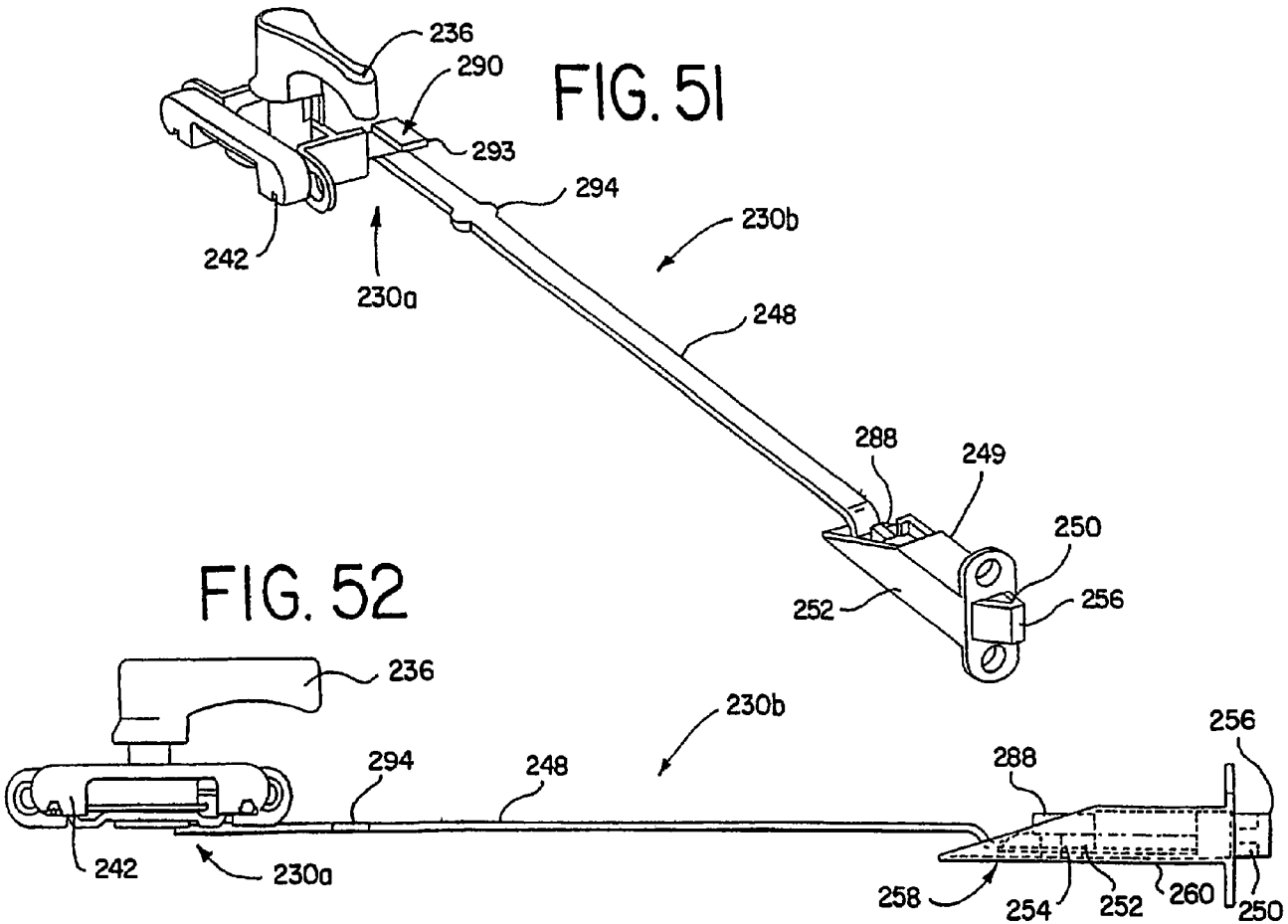
Figures 53, 54, 55:
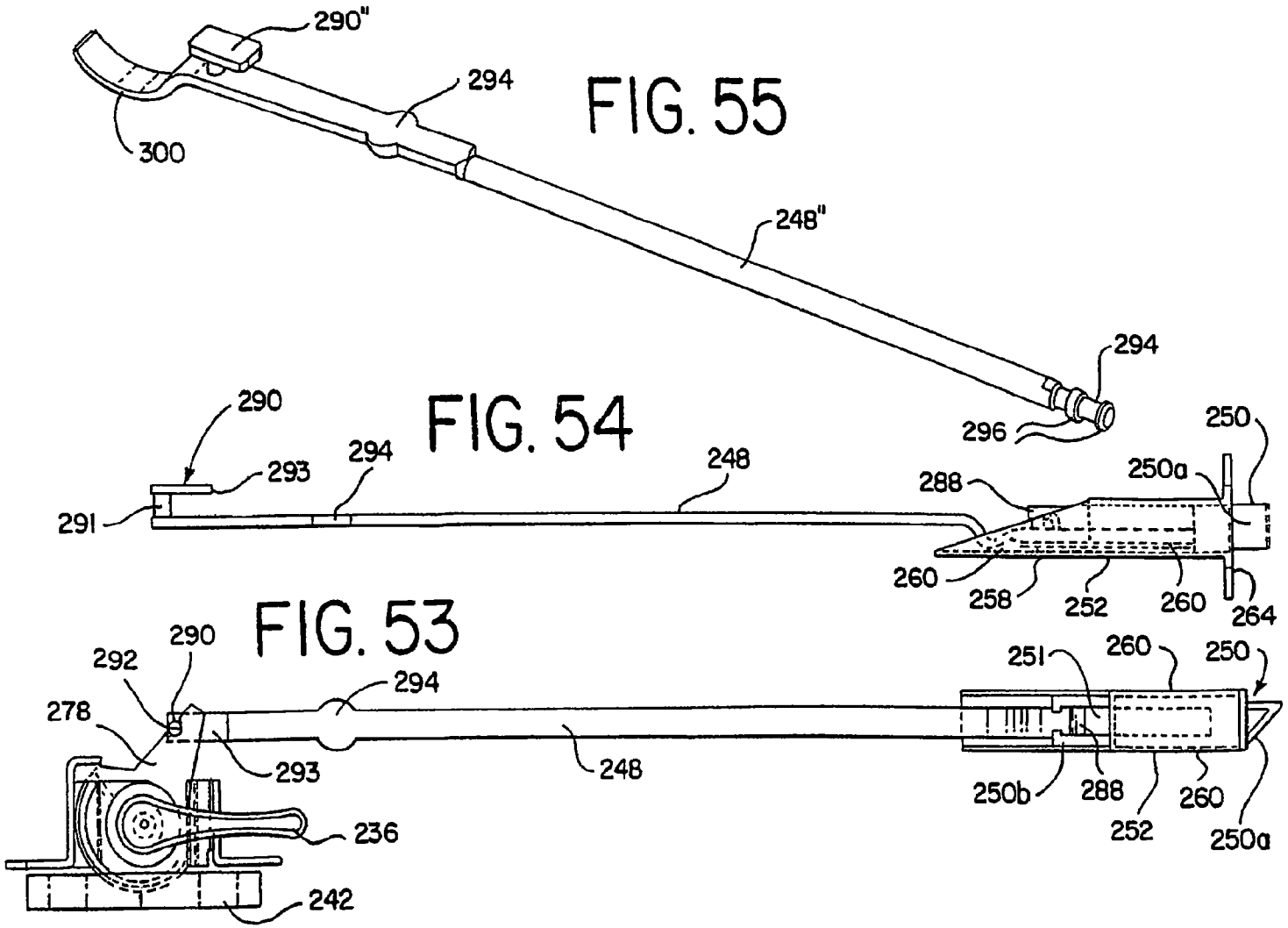
Figure 56:
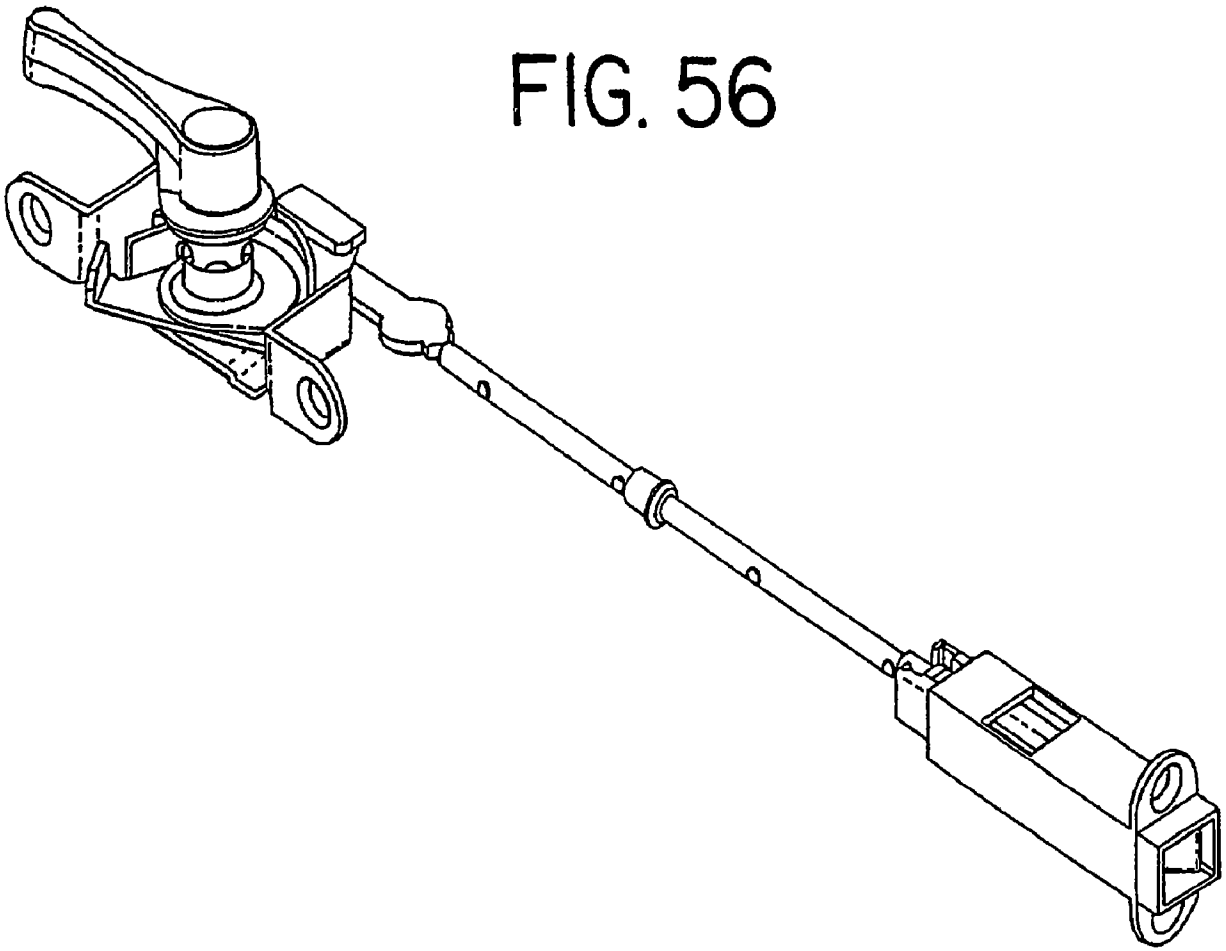
Figure 57:
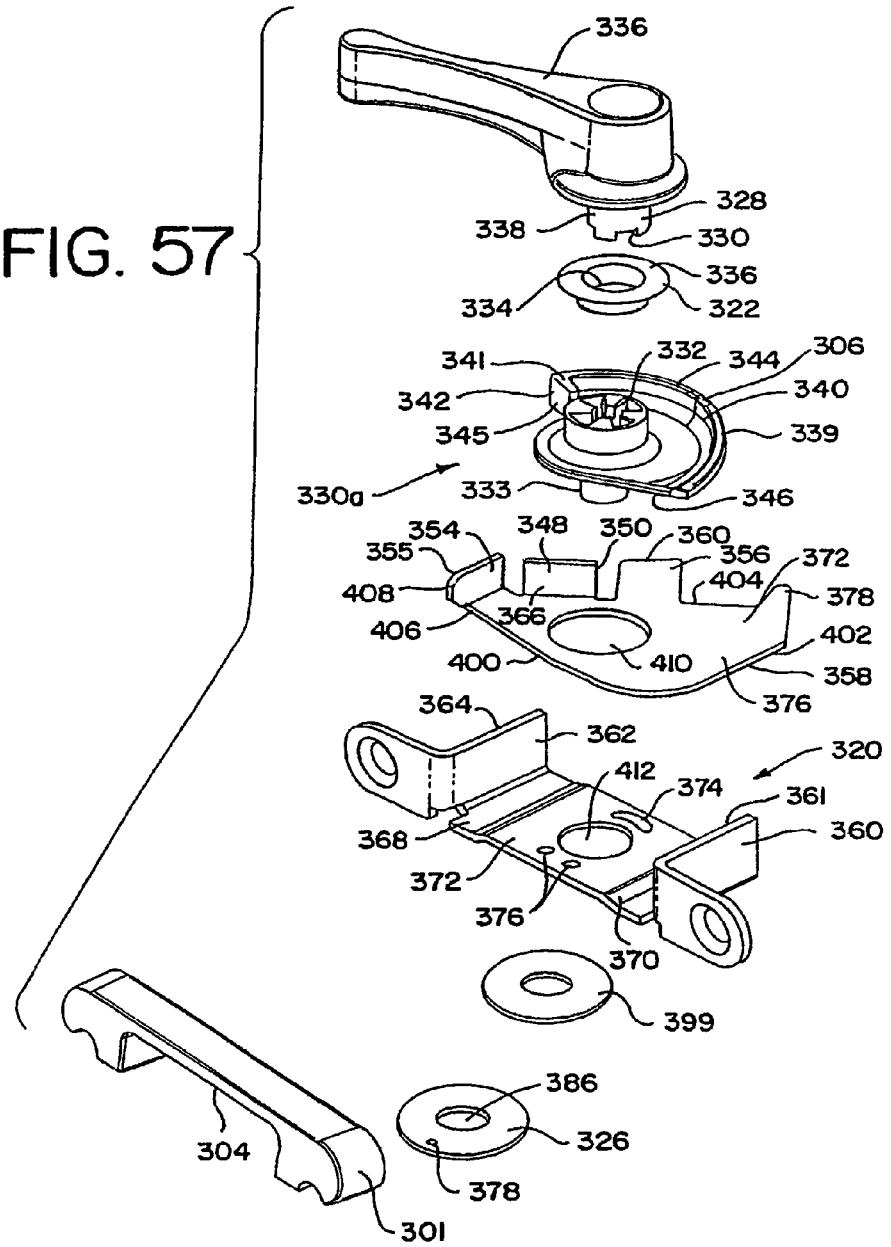
Figure 58:
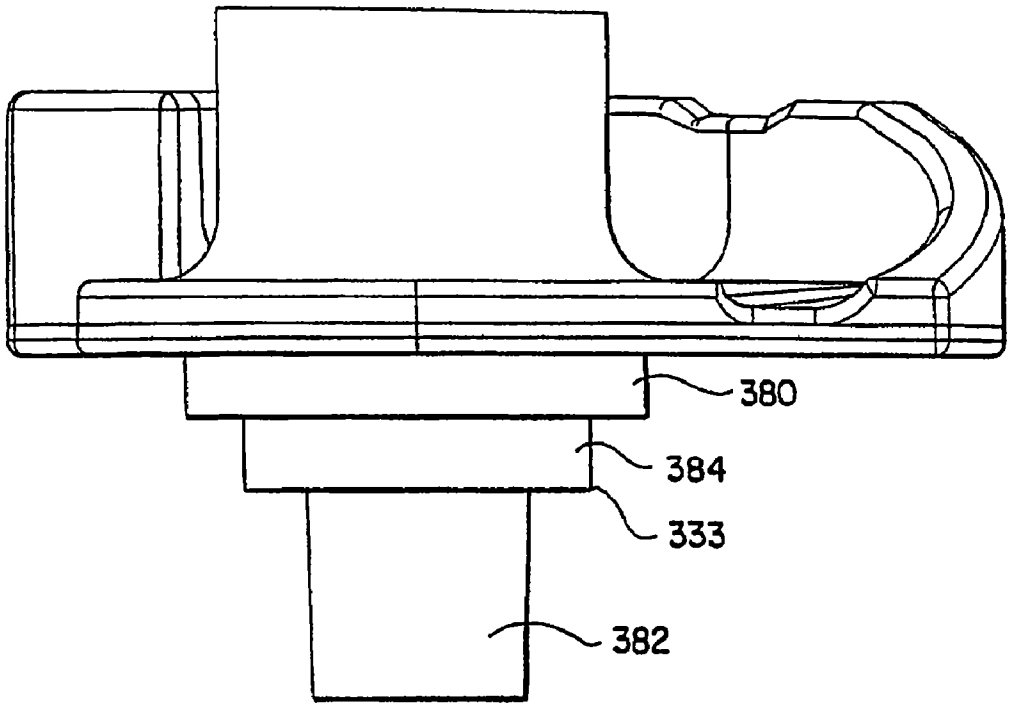
Figure 59:
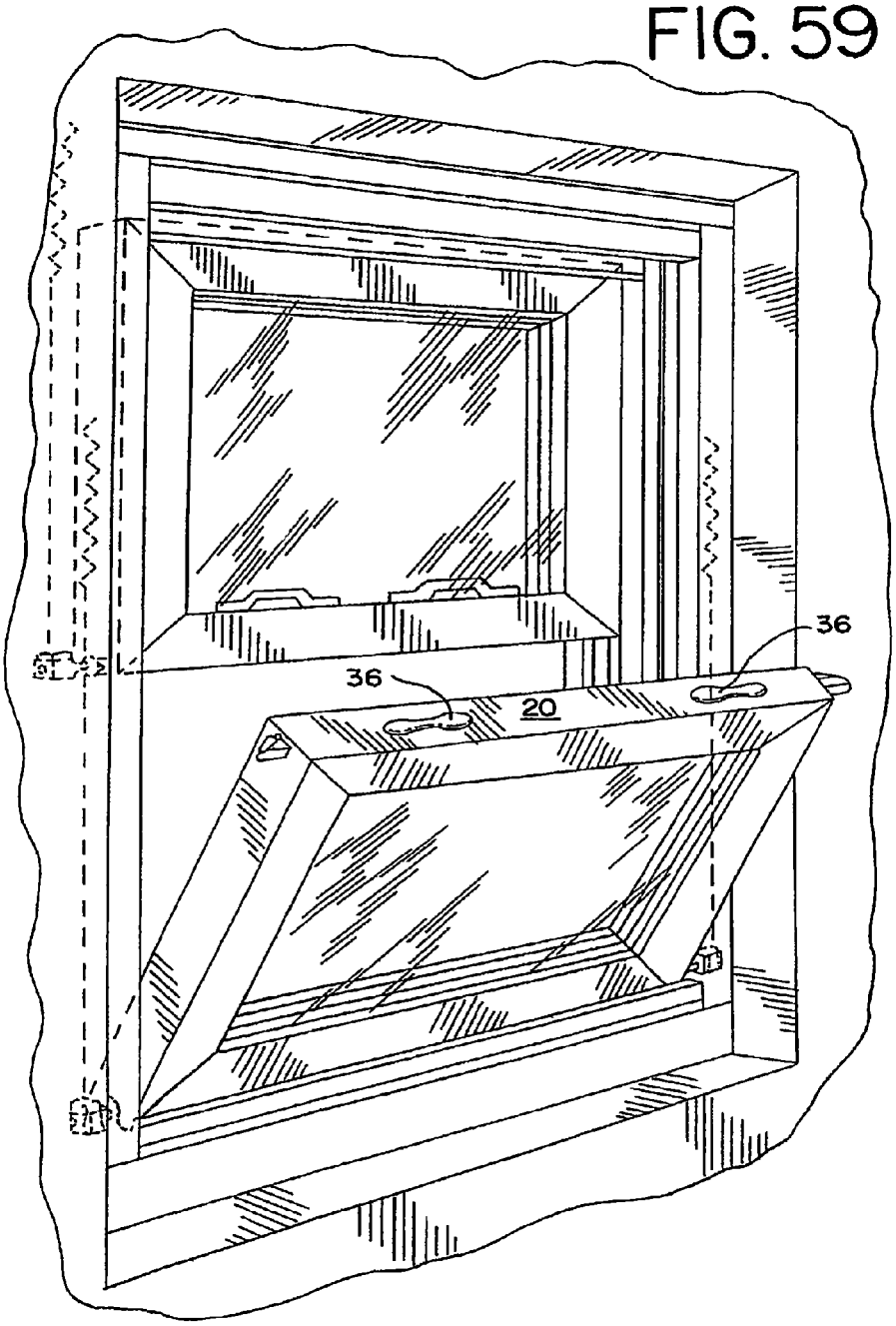
Figure 60:
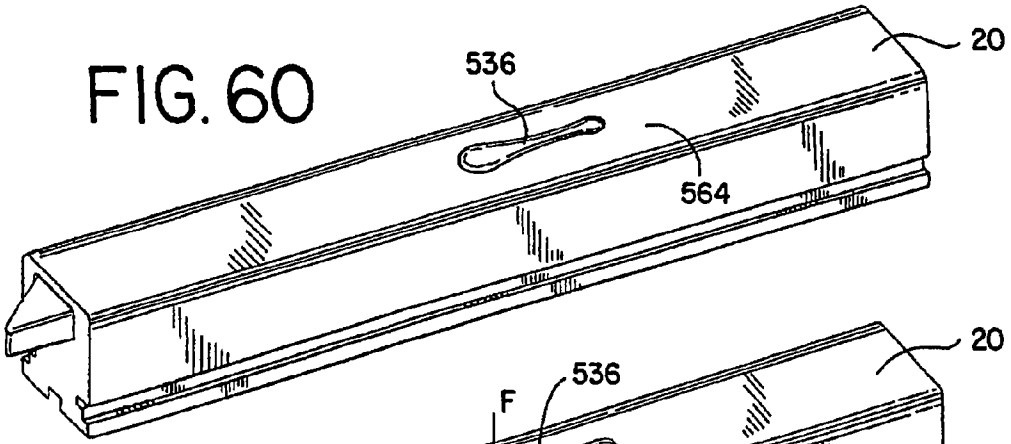
Figure 61:
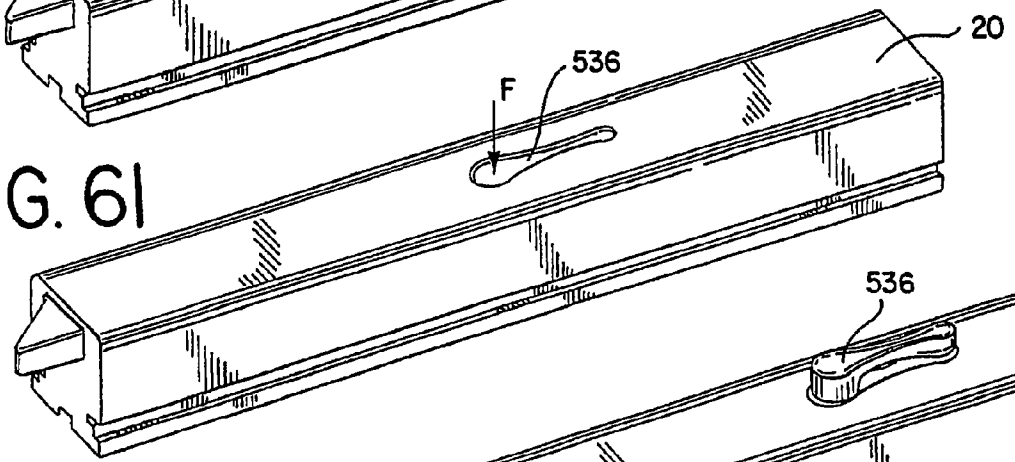
Figure 62:
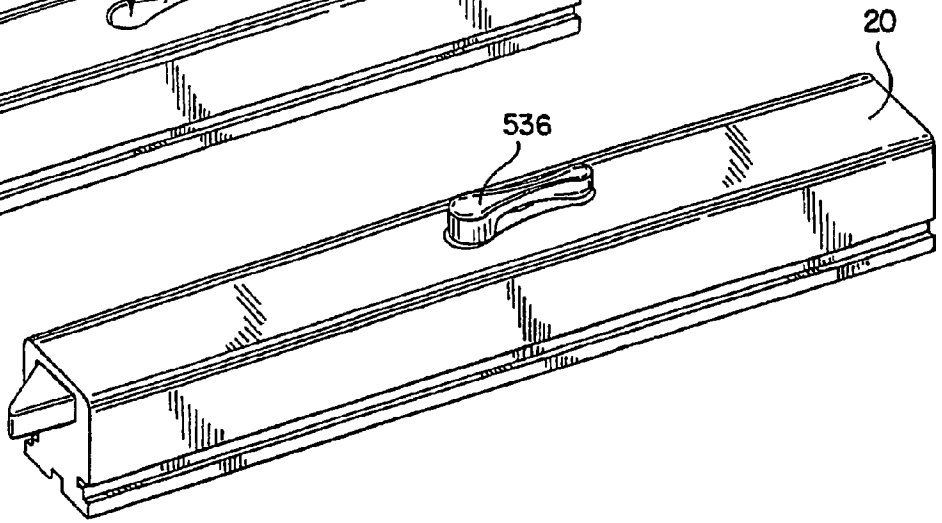
Figure 63:
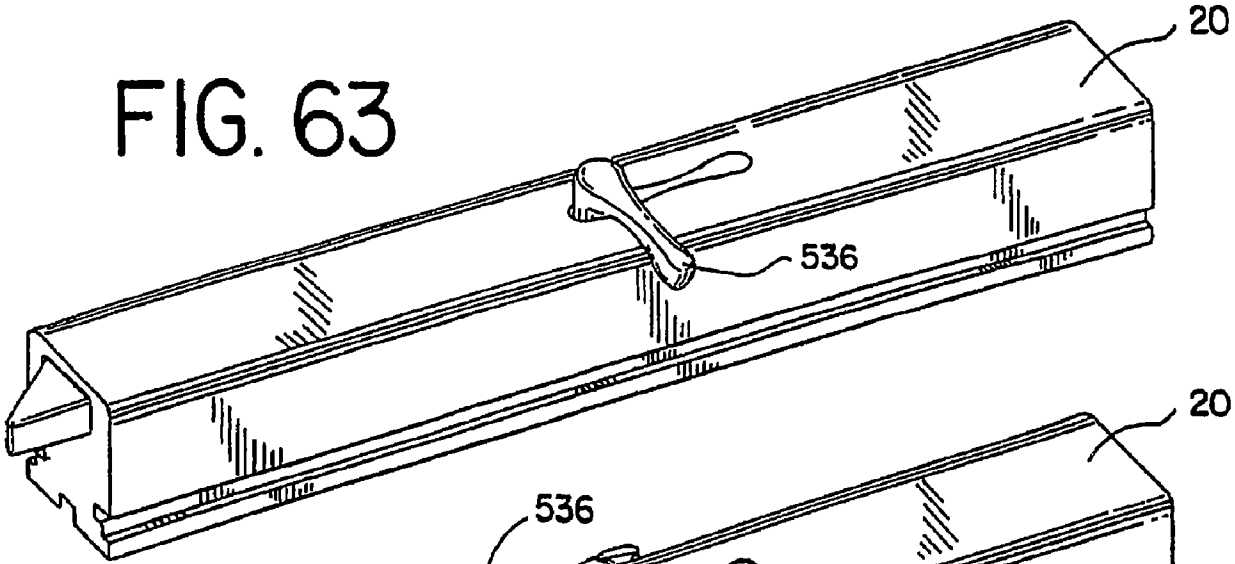
Figure 64:
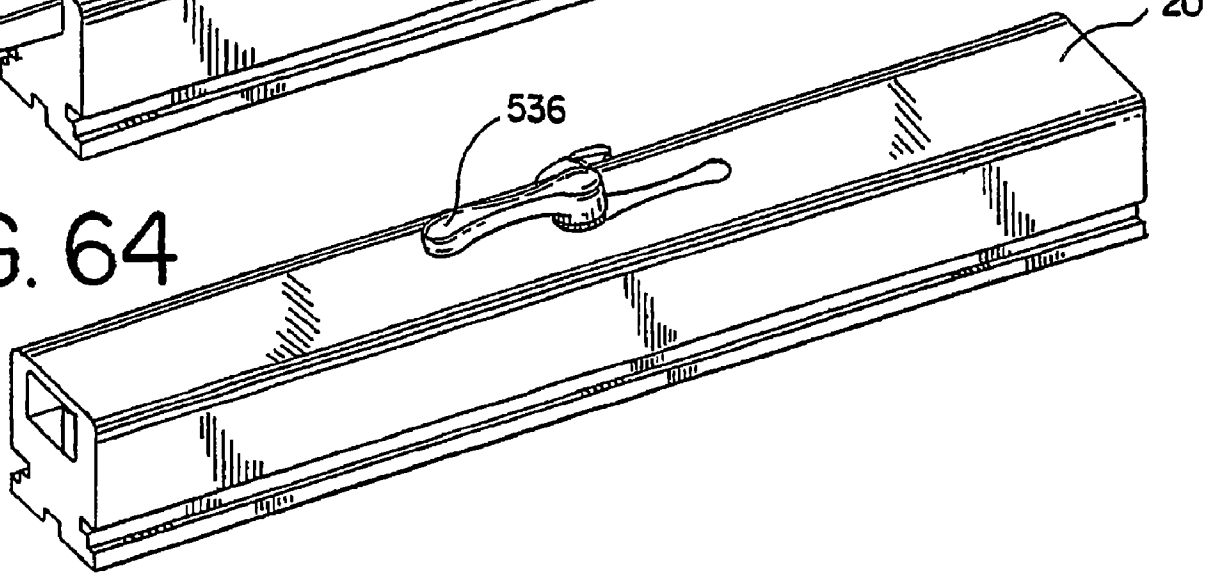
Figure 65:
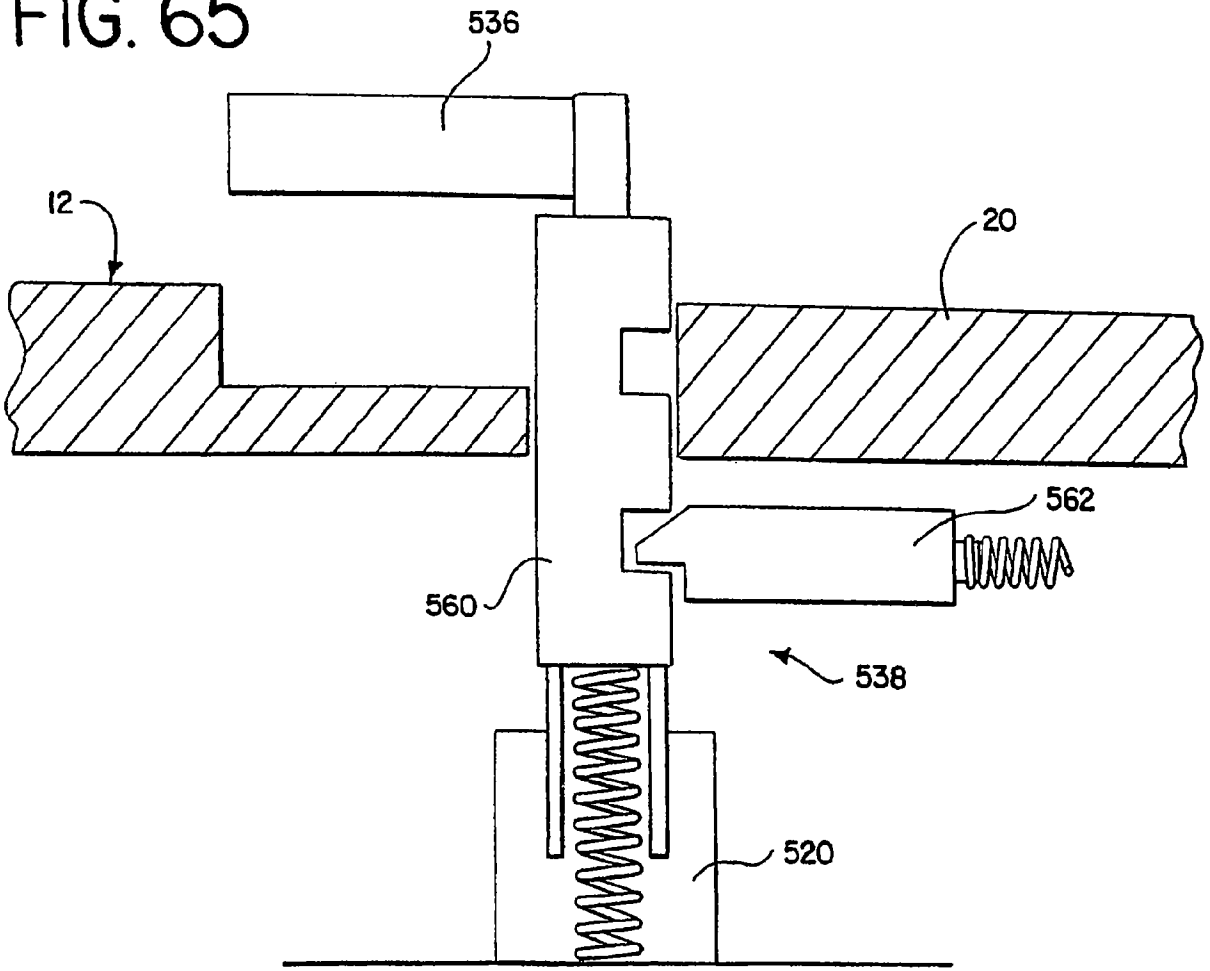
Figures 66, 67:
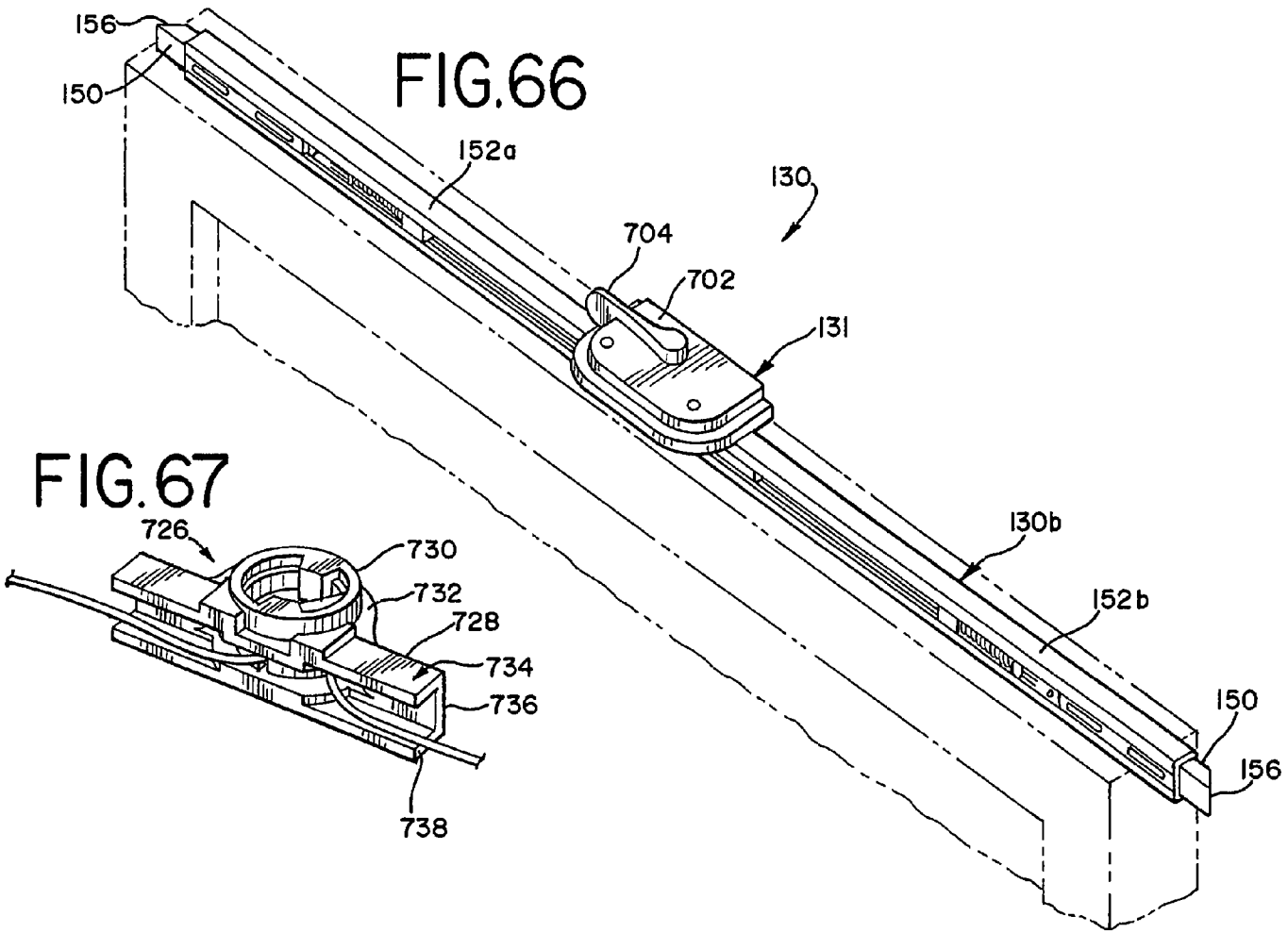
Figure 68:
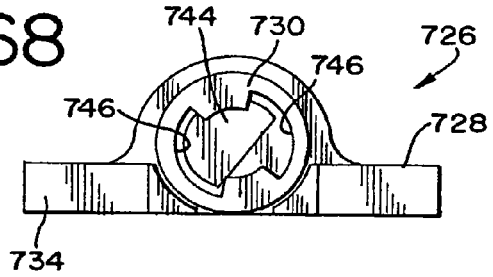
Figure 69:
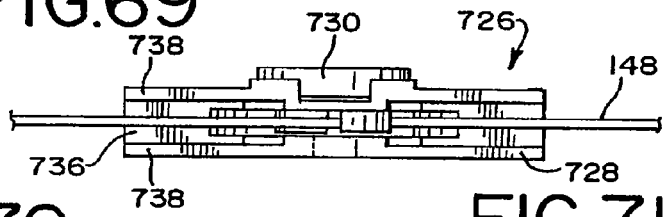
Figure 70:
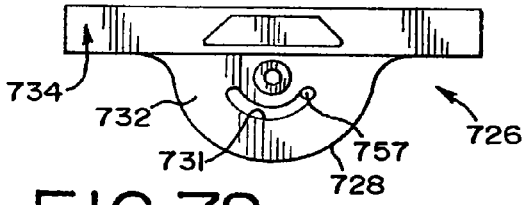
Figure 71:
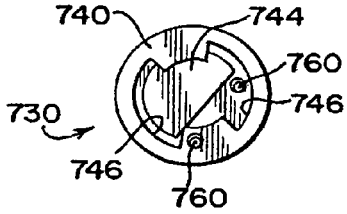
Figure 72:
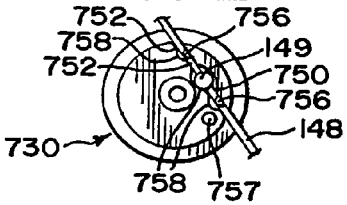
Figure 72A:
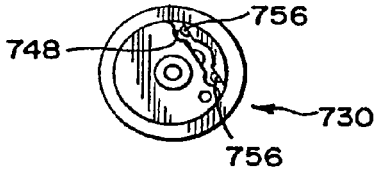
Figure 73:
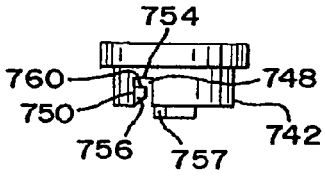
Figure 74:
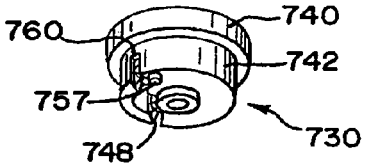
Figure 75:
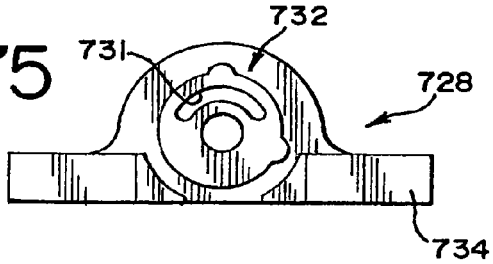
Figure 76:
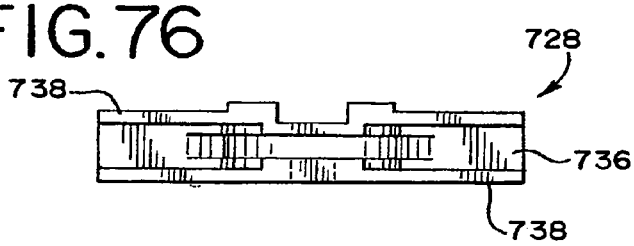
Figure 77:
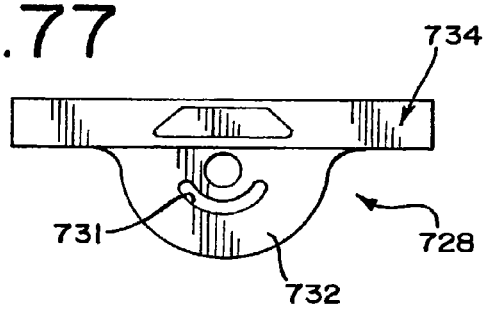
Figure 78:
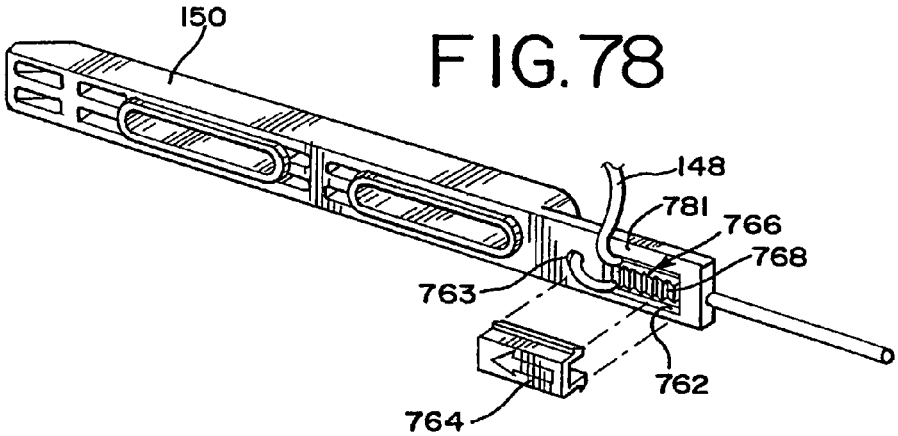
Figure 79:
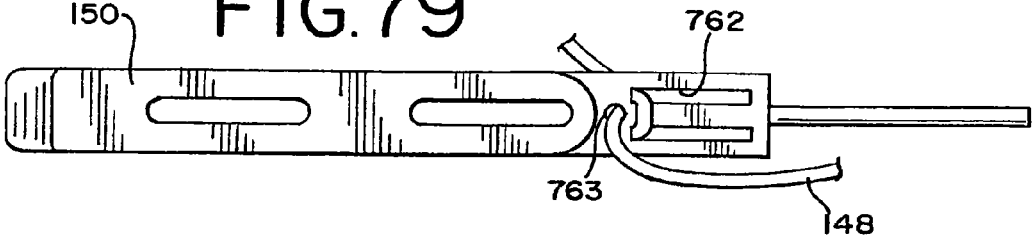
Figure 80:
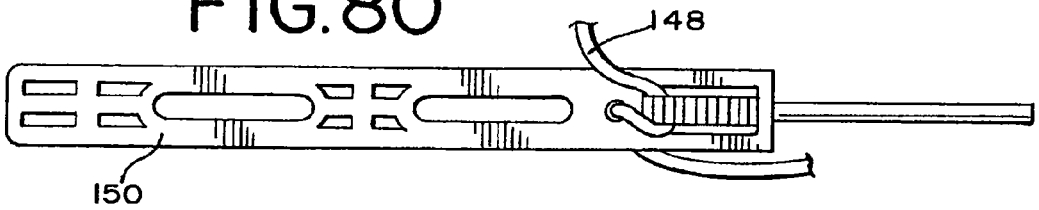
Figure 81:
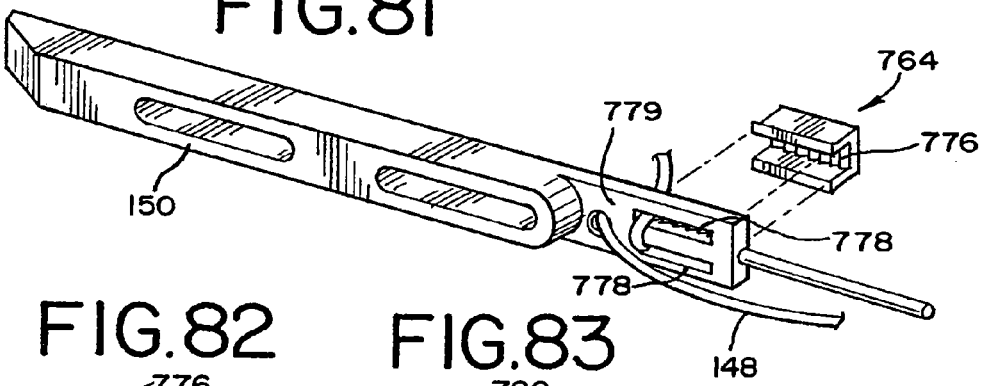
Figure 82:
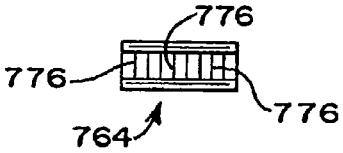
Figure 83:
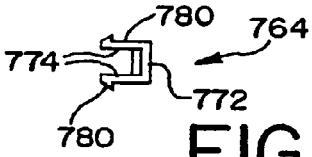
Figure 84:
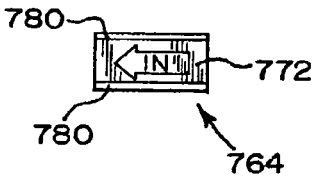
Figure 85:
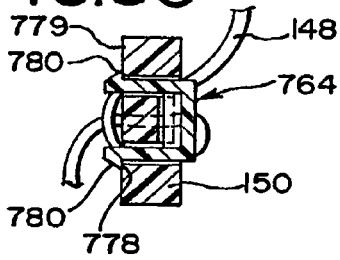
Figure 86:
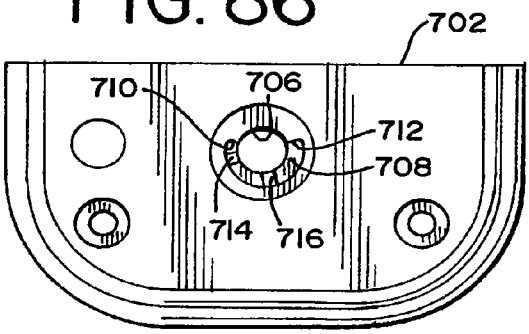
Figure 87:
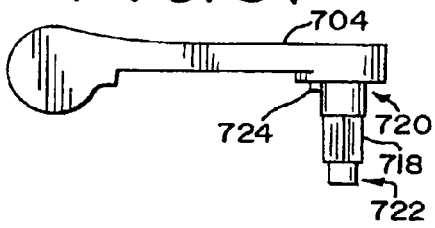
Figure 88:
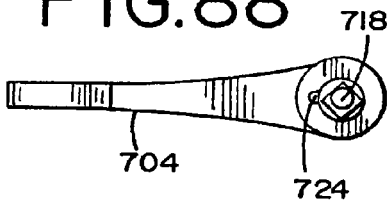
Figure 89:
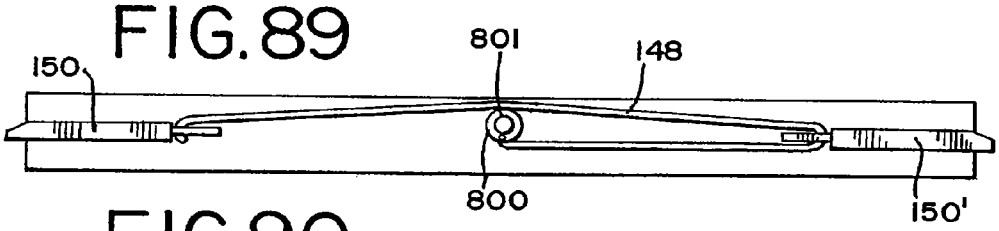
Figure 90:
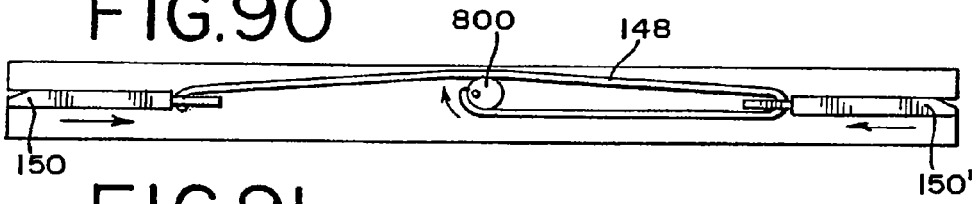
Figure 91:
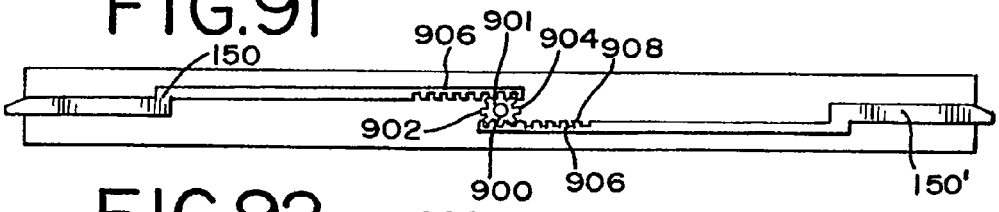
Figure 92:
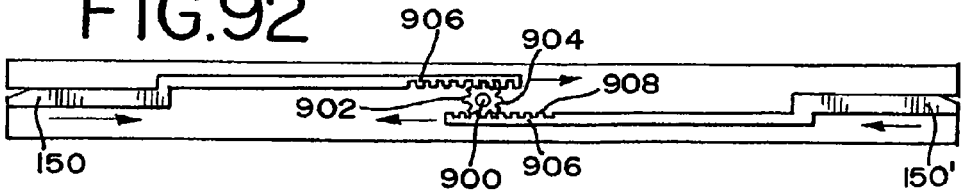

FIG. **6*a*** is a perspective view of another embodiment of the integrated assembly of the present invention;

FIG. 7 is a side view illustrating another embodiment of the sash lock and tilt latch mechanisms of the integrated assembly of the present invention;

FIG. 8 is a partial perspective view of another embodiment of the integrated assembly of the present invention;

FIG. 9 is a perspective view of another embodiment of the integrated assembly of the present invention, and showing an alternative latch bolt housing and with a sash lock handle removed;

FIG. 10 is a top plan view of the integrated assembly of FIG. 9;

FIG. 11 is a side view of the integrated assembly of FIG. 9;

FIG. 12 is a end view of the integrated assembly of FIG. 9;

FIG. 13 is a perspective view of another embodiment of the integrated assembly of the present invention;

FIG. 14 is a side elevation view of the integrated assembly of FIG. 13;

FIG. 15 is a top plan view of the integrated assembly of FIG. 13;

FIG. 16 is a perspective of the integrated assembly of FIG. 13 shown in cooperation with a portion of a guide rail of a master frame;

FIG. 17 is a perspective view of the integrated assembly of FIG. 13, shown in a retracted position;

FIG. 18 is a top plan view of the integrated assembly of FIG. 13, shown in the retracted position;

FIG. 19 a perspective view of a sash window assembly incorporating another embodiment of an integrated tilt/sash lock assembly of the present invention;

FIG. 20 a perspective view of the integrated assembly of FIG. 19 with a portion of a lower sash window shown in phantom;

FIG. 21 is a partially exploded perspective view illustrating the sash lock and tilt latch mechanisms of the integrated assembly of FIG. 20;

FIG. 22 is a partial perspective view of the integrated assembly of FIG. 19;

FIG. 23 is a top perspective view illustrating a portion of a sash lock mechanism of the integrated assembly of FIG. 19;

FIG. 24 is a bottom perspective view illustrating the portion of the sash lock mechanism of FIG. 24;

FIG. 25 is a top perspective view illustrating a portion of one embodiment of the sash lock mechanism of the integrated assembly of FIG. 19;

FIG. 26 is a bottom perspective view illustrating the portion of the sash lock mechanism of FIG. 19;

FIG. 27 is a cross-sectional view of the sash lock mechanism of the integrated assembly of FIG. 19, the sash lock mechanism being attached to a connector of a tilt-latch mechanism;

FIG. 28 is a cross-sectional view of the sash lock mechanism of FIG. 19;

FIG. 29 is a perspective view illustrating a cam used in connection with the integrated assembly of FIG. 19;

FIG. 30 is a top view illustrating the cam of FIG. 29;

FIG. 31 is a front elevation view illustrating the cam of FIG. 29;

FIG. 32 is a perspective view illustrating a spool used in the integrated assembly of FIG. 19;

FIG. 33 is a perspective view illustrating an alternative embodiment of the spool used in the integrated assembly of FIG. 19;

FIG. 34 is a perspective view of a retaining member or fastener used in connection with the spool of FIG. 32;

FIG. 35 is a perspective view illustrating a spool support member used in connection with the integrated assembly of FIG. 19;

FIG. 36 is a top view illustrating the spool support member of FIG. 35;

FIG. 37 is a perspective view of a portion of the sash lock mechanism shown in FIG. 23 and having an alternative embodiment of the spool;

FIG. 38 is a bottom plan view of the portion of the sash lock mechanism shown in FIG. 37;

FIG. 39 is a bottom plan view of the portion of the sash lock mechanism shown in FIG. 37 and having a connector connected to the spool;

FIG. 40 is a bottom plan view of the spool and connector shown in FIG. 39 and received by an alternative embodiment of the spool housing;

FIG. 41 is a perspective view of a sash window assembly incorporating another embodiment of an integrated tilt/sash lock assembly of the present invention;

FIG. 42 is a partial top cross-sectional plan view of a sash window assembly incorporating another embodiment of an integrated tilt/sash lock assembly of the present invention;

FIG. 43 is a partial front view a sash window incorporating the integrated assembly of FIG. 42;

FIG. 44 is a partial cross-sectional end view of sash windows used with the integrated assembly of FIG. 42;

FIG. 45 is a schematic end view of the integrated assembly of FIG. 42;

FIG. 46 is a perspective view illustrating a keeper used in connection with the integrated assembly of FIG. 42;

FIG. 47 is a perspective view illustrating a cam used in connection with the integrated assembly of FIG. 42;

FIG. 48 is a partial plan view of a sash window having a sash lock handle utilized in the integrated assembly of FIG. 42 wherein a sash lock housing is not utilized;

FIG. 49 is a perspective view of a pawl used in connection with the integrated assembly of FIG. 41;

FIG. 50 is a partial top view of a sash lock mechanism of the integrated assembly of FIG. 32 showing an alternative embodiment of the pawl;

FIG. 51 is a perspective view of the integrated assembly of FIG. 42;

FIG. 52 is a side view of the integrated assembly of FIG. 51;

FIG. 53 is a top plan view of the integrated assembly of FIG. 51 with the pawl of FIG. 50;

FIG. 54 is a side view of a tilt-latch mechanism used in the integrated assembly of FIG. 51;

FIG. 55 is a perspective view of another embodiment of a connector used in connection with the integrated assembly of FIG. 32;

FIG. 56 is a perspective view of the integrated assembly of FIG. 42 showing the latch bolt in a retracted position;

FIG. 57 is an exploded perspective view of another embodiment of the sash lock mechanism of the integrated assembly of FIG. 41;

FIG. 58 is an enlarged side view of the rotor of the sash lock mechanism of FIG. 46;

FIG. 59 is a perspective view of a sash window assembly incorporating another embodiment of the integrated tilt/sash lock assembly of the present invention and having a retractable sash lock handle;

FIG. 60 is a partial perspective view of a top rail of a sash window incorporating the integrated assembly of FIG. 59 wherein the sash lock handle is in a retracted position;

FIG. 61 is a partial perspective view of the top rail of FIG. 60 showing the retractable sash lock handle in a depressed position to move the handle from the retracted position to an operational position in accordance with the present invention;

FIG. 62 is a partial perspective view of the top rail of FIG. 60 showing the retractable sash lock handle in the operational position in accordance with the present invention;

FIG. 63 is a partial perspective view of a top rail of FIG. 60 showing the retractable sash lock handle in the operational position and in an unlocked position in accordance with the present invention;

FIG. 64 is a partial perspective view of the top rail of FIG. 60 showing the retractable sash lock handle in the operational position and in a tiltable position in accordance with the present invention;

FIG. 65 is a schematic partial cross-sectional view of the top rail of FIG. 60 showing a retractable actuating mechanism for the retractable sash lock handle of the present invention:

FIG. 66 is a perspective view of another embodiment of the integrated assembly of the present invention with a portion of a lower sash window shown in phantom;

FIG. 67 is a perspective view of a spool housing assembly of the embodiment of FIG. 66;

FIG. 68 is a top view of the spool housing assembly of FIG. 67;

FIG. 69 is front elevation of the spool housing assembly of FIG. 67;

FIG. 70 is a bottom view of the spool housing assembly of FIG. 67;

FIG. 71 is a top view of a spool according to the present invention;

FIG. 72 is a bottom view of the spool of FIG. 71;

FIG. 72*a* is a bottom view of an alternative embodiment of the spool of FIG. 72, showing an alternative channel or passageway;

FIG. 73 is a side view of the spool of FIG. 71;

FIG. 74 is a perspective view of the spool of FIG. 71;

FIG. 75 is a top view of a spool housing according to the present invention;

FIG. 76 is a front elevation view of the spool housing of FIG. 75;

FIG. 77 is a bottom view of the spool housing of FIG. 75;

FIG. 78 is a perspective view of a latch bolt according to the present invention;

FIG. 79 is a rear view of the latch bolt of FIG. 78;

FIG. 80 is a front view of the latch bolt of FIG. 78;

FIG. 81 is another perspective view of the latch bolt of FIG. 78;

FIG. 82 is rear view of a fastening mechanism used for fastening a connector to a latch bolt of the present invention;

FIG. 83 is an end view of the fastening mechanism of FIG. 82;

FIG. 84 is a top view of the fastening mechanism of FIG. 82;

FIG. 85 is a cross sectional view of the fastening mechanism of FIG. 82 fastened to a latch bolt;

FIG. 86 is a top view of a rotor assembly housing according to the present invention;

FIG. 87 is a side elevation view of an actuator according to the present invention;

FIG. 88 is a bottom view of the actuator of FIG. 87;

FIG. 89 is a schematic of a tilt latch mechanism according to the present invention in an un-actuated position;

FIG. 90 is a schematic of the tilt latch mechanism of FIG. 89 in an actuated position;

FIG. 91 is a schematic of another embodiment of a tilt-latch mechanism according to the present invention in an un-actuated position; and FIG. 92 is a schematic of the tilt-latch mechanism of FIG. 91 in an actuated position.

DETAILED DESCRIPTION

While this invention is susceptible of embodiment in many different forms, there are shown in the drawings and will herein be described in detail, preferred embodiments of the invention with the understanding that the present disclosures are to be considered as exemplifications of the principles of the invention and are not intended to limit the broad aspects of the invention to the embodiments illustrated.

Figure 1:
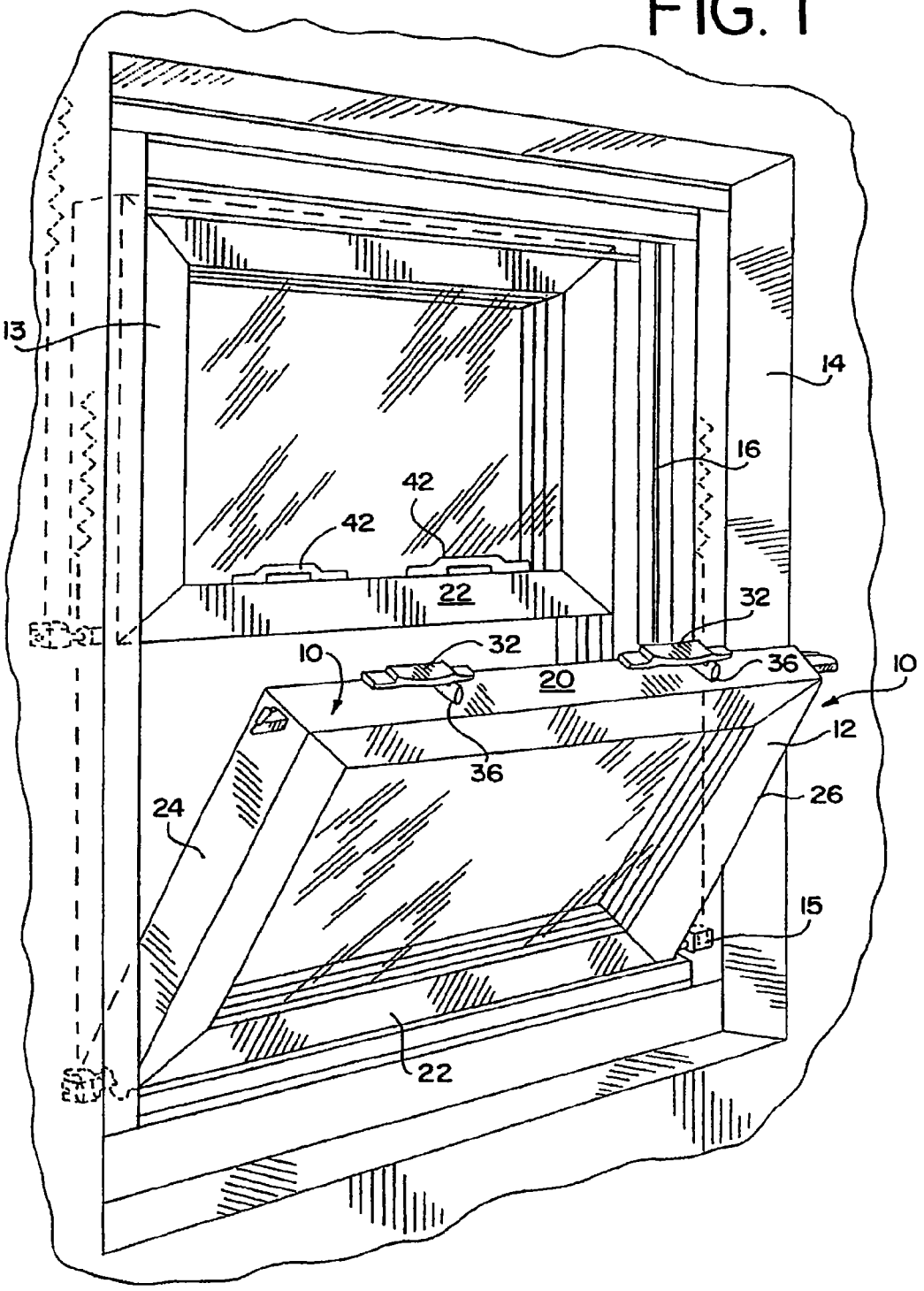
FIG. 1 a perspective view of a sash window assembly incorporating the present invention.

A sash window assembly 10 is shown in FIG. 1. The particular sash window assembly 10 in FIG. 1 is a double-hung window assembly having a first or lower sash window 12 and a second or upper sash window 13 installed in a master frame 14. The lower sash window 12 is pivotally mounted to the master frame 14 by a sash balance/brake shoe assembly 15. The master frame 14 has opposed, vertically extending guide rails 16. The lower sash window 12 has a top rail 20, a base 22 and a pair of stiles 24, 26, cooperatively connected together at adjacent extremities thereof to form a sash frame, typically rectangular although other shapes are possible. The upper sash window 13 is similarly constructed. The sash windows and master frame could be made from extrusions or pulltrusions that are filled with fiberglass, epoxy, plastic, or wood chips. These structures could also be solid and made from wood, masonite, pressboard, composite materials, or other materials as well including aluminum.

Figure 2:
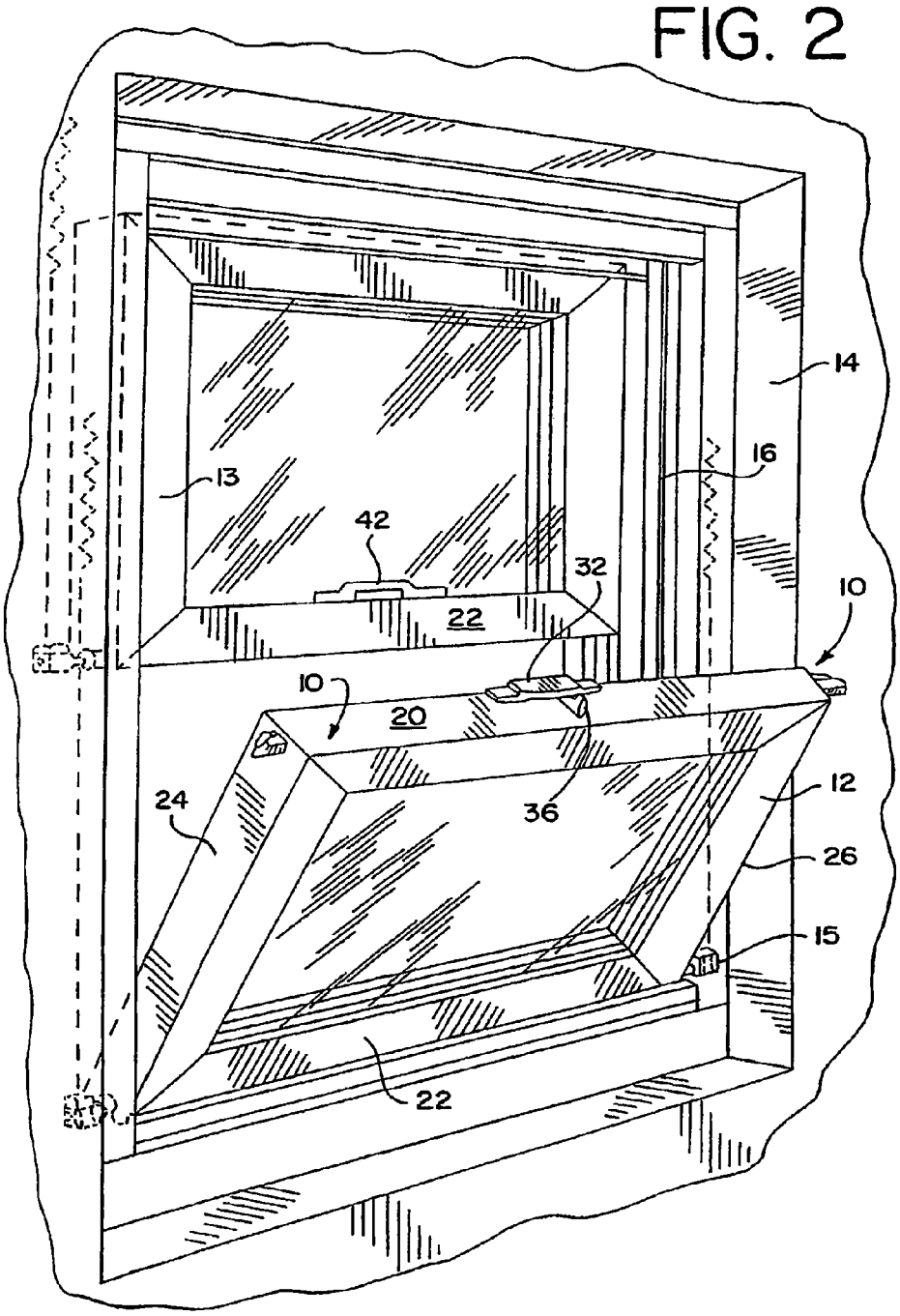
FIG. 2 a perspective view of another embodiment of a sash window assembly incorporating the present invention.

In accordance with the invention, the sash window assembly 10 includes an integrated tilt/sash lock assembly 30. For ease of description, the integrated tilt/sash lock assembly may be referred to as the integrated assembly 30. The integrated assembly 30 generally includes a sash lock mechanism 30*a* and a tilt-latch mechanism 30*b*. The sash lock mechanism 30*a* provides a sash lock operation, and the tilt-latch mechanism 30*b* provides a tilt-latch mechanism. As explained in greater detail below, the integrated assembly 30 has a locked position, an unlocked position and a tiltable position. In one preferred embodiment, the integrated assembly 30 has a single sash lock mechanism 30*a* and a single tilt-latch mechanism 30*b*, sometimes referred to as a single integrated assembly. A pair of single integrated assemblies 30 may be utilized in a sash window assembly 10 (See FIG. 1). It is further understood that the integrated assembly 30 may include a single sash lock mechanism 30*a* and a pair of tilt-latch mechanisms 30*b* (See FIG. 2), sometimes referred to as a dual integrated assembly.

FIGS. 1-18 illustrate a first set of embodiments of the integrated assembly 30 according to the present invention. The sash lock mechanism 30*a* of the integrated assembly 30 will first be described and then the tilt-latch mechanism 30*b* of the integrated assembly will be described. The interaction of the sash lock mechanism 30*a* and the tilt latch mechanism 30*b* will then be described in greater detail below.

Figure 3:
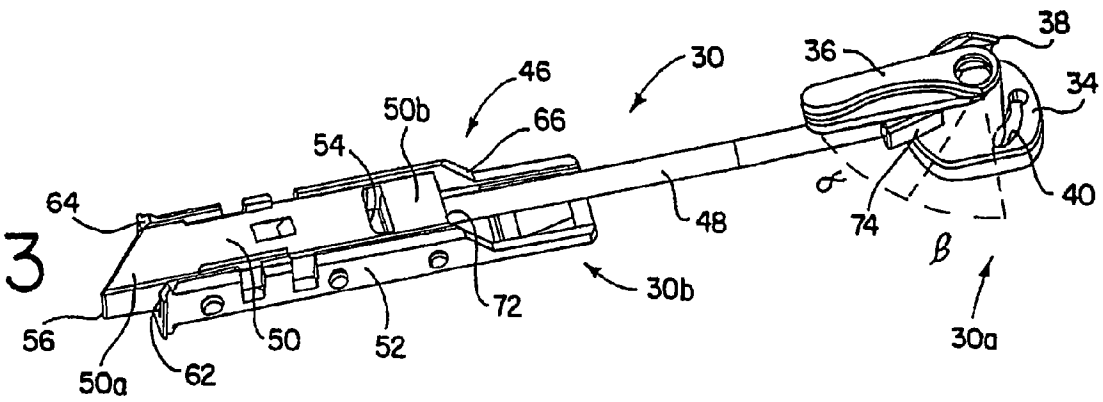
FIG. 3 is a perspective view of an integrated tilt/sash lock assembly of the present invention showing a sash lock mechanism and a tilt-latch mechanism.

As shown in FIGS. 3-6, the sash lock mechanism 30*a* is generally comprised of a sash lock system 31 and a keeper 42. The sash lock system 31 generally includes a sash lock housing 32, a rotor 34 and an actuator 36 typically in the form of a sash lock handle 36. As shown in FIG. 3, the sash lock housing 32 could be omitted wherein the sash lock handle 36 would fit through an opening in the top rail 20.

The sash lock housing 32 generally accommodates the rotor 34 and has an opening to allow the handle 36 to be connected to the rotor 34. The sash lock housing 32 is typically mounted to a top surface of the top rail 20 of the lower sash window 12. The rotor 34 has a generally annular peripheral surface having a locking end 38. The rotor 34 has a central opening to receive the handle 36. The rotor 34 further has a pair of slots 40 circumferentially spaced from the central opening. In one embodiment of the present invention, the slots 40 are kidney-shaped. The handle 36 has a shaft 37 that is connected to the rotor 34. The shaft 37 passes through the opening of the sash lock housing 32 and is received by the central opening of the rotor 34. The handle 36 is made preferably of glass filled nylon. The rotor 34 is preferably made of glass filled nylon or zinc. However, it is contemplated that the handle 36 and rotor 34 be made from any suitable material.

Referring to FIGS. 1,2 and 4-6, the keeper 42 of the sash lock mechanism 30*a* is generally a bracketed structure having an opening 44. The keeper 42 is generally designed to be mounted on the base 22 of the upper sash window 13. The keeper 42 confronts the sash lock system 31 when the sash windows 12,13 are in their respective closed positions. As explained in greater detail below, the opening 44 of the keeper 42 receives the locking end 38 of the rotor 34 when the integrated assembly 30 is in the locked position. The keeper 42 is preferably made of nylon. However, it is contemplated that the keeper 42 be made of any material suitable for the applications described herein.

As shown in FIGS. 3-6, the tilt-latch mechanism 30*b* is generally comprised of a latch bolt assembly 46 and a connector 48. The latch bolt assembly 46 generally includes a latch bolt 50, a latch bolt housing 52 and a biasing means 54.

The latch bolt 50 has a first end 50*a*, a second end 50*b*. A beveled nose 56 extends from the first end 50*a* of the latch bolt 50 and is adapted for engaging a respective one of the guide rails 16 of the master frame 14. The latch bolt housing 52, described in greater detail below, receives and slidably supports the latch bolt 50 wherein the latch bolt 50 is disposed within the latch bolt housing 52.

As further shown in FIGS. 3-6, the latch bolt housing 52 can take many different forms. In one preferred embodiment, the latch bolt housing 52 has a bottom wall 58 and a pair of opposing side walls 60 extending from the bottom wall 58 to form a channel-like member. The latch bolt housing 52 further has a first end 64, a second end 66 and an outward end opening 62 adjacent the first end 64. In a preferred embodiment, the latch bolt housing 52 is made of a molded plastic or other polymeric material. The outward end opening 62 provides for allowing the nose 56 of the latch bolt 50 to extend past the latch bolt housing 52 and engage the guide rail 16 of the master frame 14.

In the embodiment of the latch bolt housing 52 shown in FIGS. 3-7, the bottom wall 58 of the latch bolt housing 52 has a first tab 68 depending from the bottom wall 58 and a second tab 70 depending from the bottom wall 58. The first and second tabs 68, 70 are located between and spaced from the first and second ends of the latch bolt housing 52. The tabs 68, 70 are generally aligned along and extend from a longitudinal axis of the bottom wall 58 of the latch bolt housing 52. The first and second depending tabs 68, 70 are adapted to be received by openings in the top rail as will be described below. The tabs 68, 70 are generally positioned along the bottom wall 58 at specific locations relative to one another to most optimally allow for tolerance variations that occur during manufacturing of the sash window, and more particularly, variations in the openings punched into the top rail that receive the tabs 68, 70. Such structures is further disclosed in commonly owned patent to Schultz, U.S. Pat. No. 6,230,443, entitled "Hardware Mounting," the specification of which is expressly incorporated herein by reference. The present invention, however, is not intended to be limited by the specific disclosure of the latch bolt housing of U.S. Pat. No.

6,230,443, or the latch bolt housing 52 described herein. Instead, as would be known to one of ordinary skill, any latch bolt housing 52 in which a latch bolt may suitably be disposed may be employed without departing from the present invention.

As further shown in FIGS. 3-6, the biasing means 54 is positioned in the latch bolt housing 52 and is designed to bias the latch bolt 50. In a preferred embodiment, the biasing means 54 is a spring. Generally, the spring biases the latch bolt 50 through the outward end opening 62 of the latch bolt housing 54. More specifically, the spring 54 has one end positioned abutting a wall of the latch bolt and the other end of the spring abutting a spring stop wall of the latch bolt housing 52. It is understood that other biasing means 54 known in the art could be employed. For example, the biasing means 54 may be a pressure activated mechanism, a cam, a compressed material with resilient characteristics or any other mechanisms suitable for biasing the latch bolt 50. The combination of the spring 54 and latch bolt 50 provides for releasably securing the sash window to the master frame 16.

As further shown in FIGS. 3-6, the connector 48 of the tilt-latch mechanism 30*b* generally connects the latch bolt 50 to the sash lock mechanism 30*a*. The connector 48 has a first end 72 and an opposed second end 74. The first end 72 of the connector 48 is coupled to the latch bolt 50. The opposed second end 74 of the connector 48 is coupled to the rotor 34. According to one embodiment of the present invention, the connector 48 is a flexible cord. It is contemplated, however, that the connector 48 be rigid or semi-rigid connecting rod.

Figure 4:
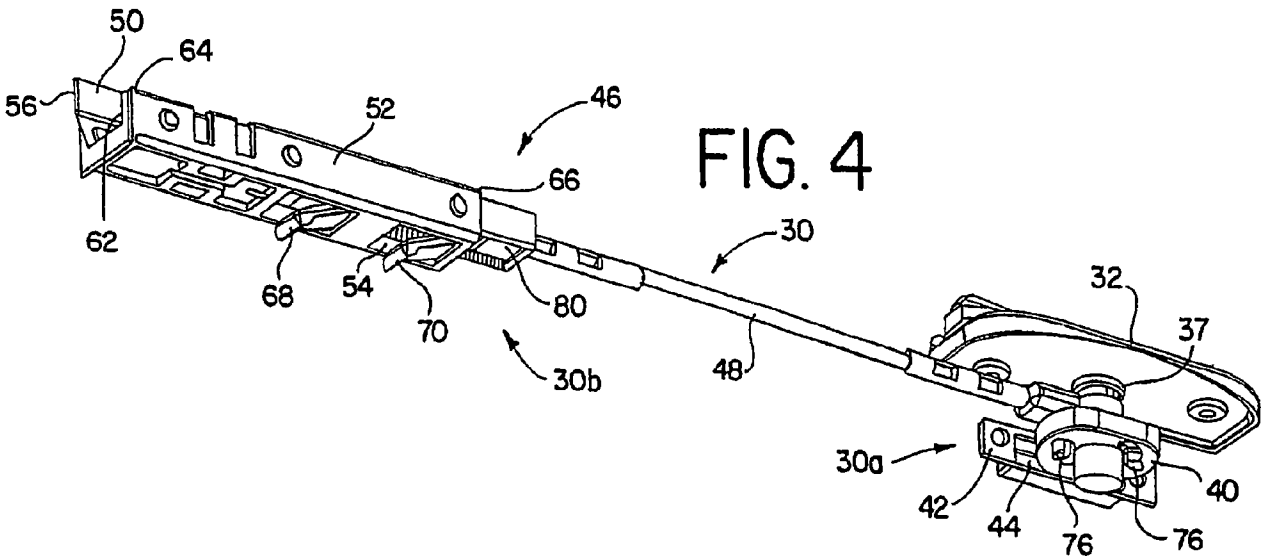
FIG. 4 is another perspective view of the integrated tilt/sash lock assembly of the present invention.
Figure 5:
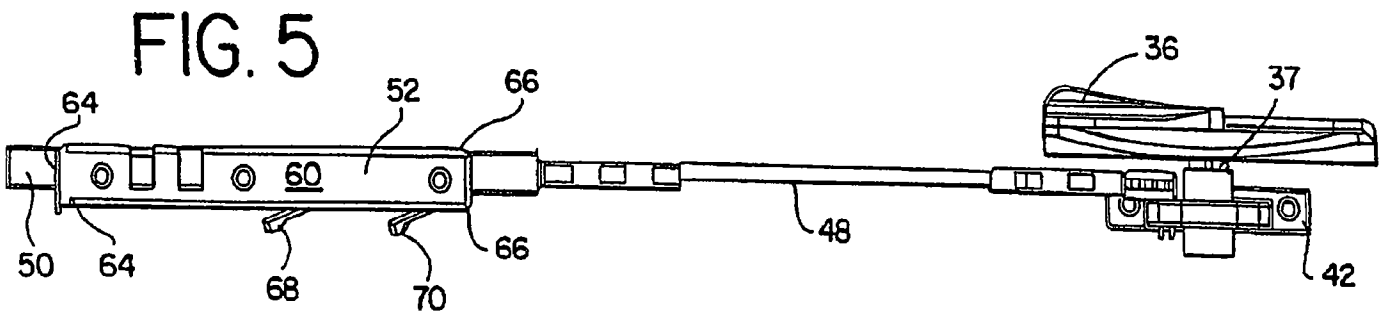
FIG. 5 is a side view of the assembly illustrating the sash lock and tilt-latch mechanisms of the present invention.
Figure 6:
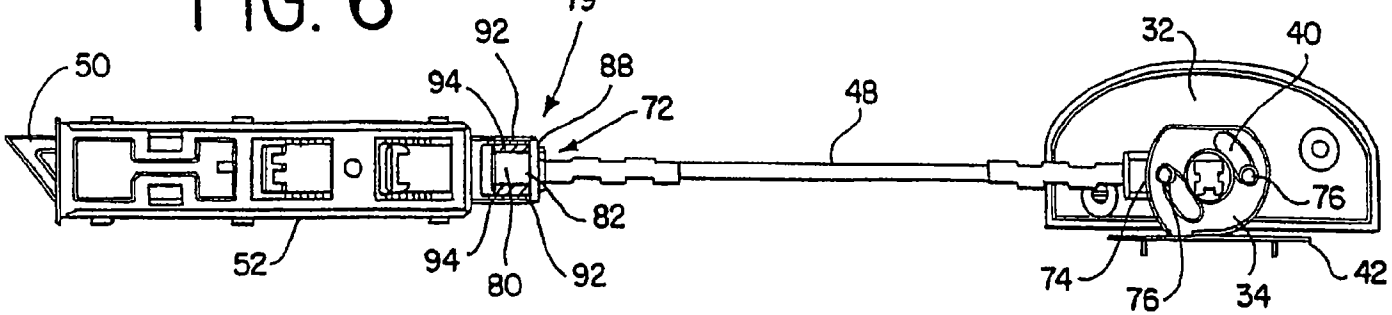
FIG. 6 is a bottom plan view illustrating the sash lock and tilt latch mechanisms of the integrated assembly of the present invention.

In one embodiment of the present invention shown in FIGS. 4-6, the connector 48 has a guide pin 76. The guide pin 76 is connected to the second end 74 of the connector 48 and slidably engages the slot 40 in the rotor 34. According to another embodiment illustrated in FIGS. 7-18, the connector 48 is coupled proximate a first end 72 to the latch bolt 50 and proximate a second end 74 to a first end of a linkage member 78*a*. The second end of the linkage member 78*b* is pivotably coupled to the rotor 34. The linkage member 78 is preferably curvilinear in shape such that a greater distance of travel is obtained from the first end of the linkage member 78*a* to the second end of the linkage member 78*b* as the linkage member 78 pivots about its second end 78*b*.

Figure 6A:
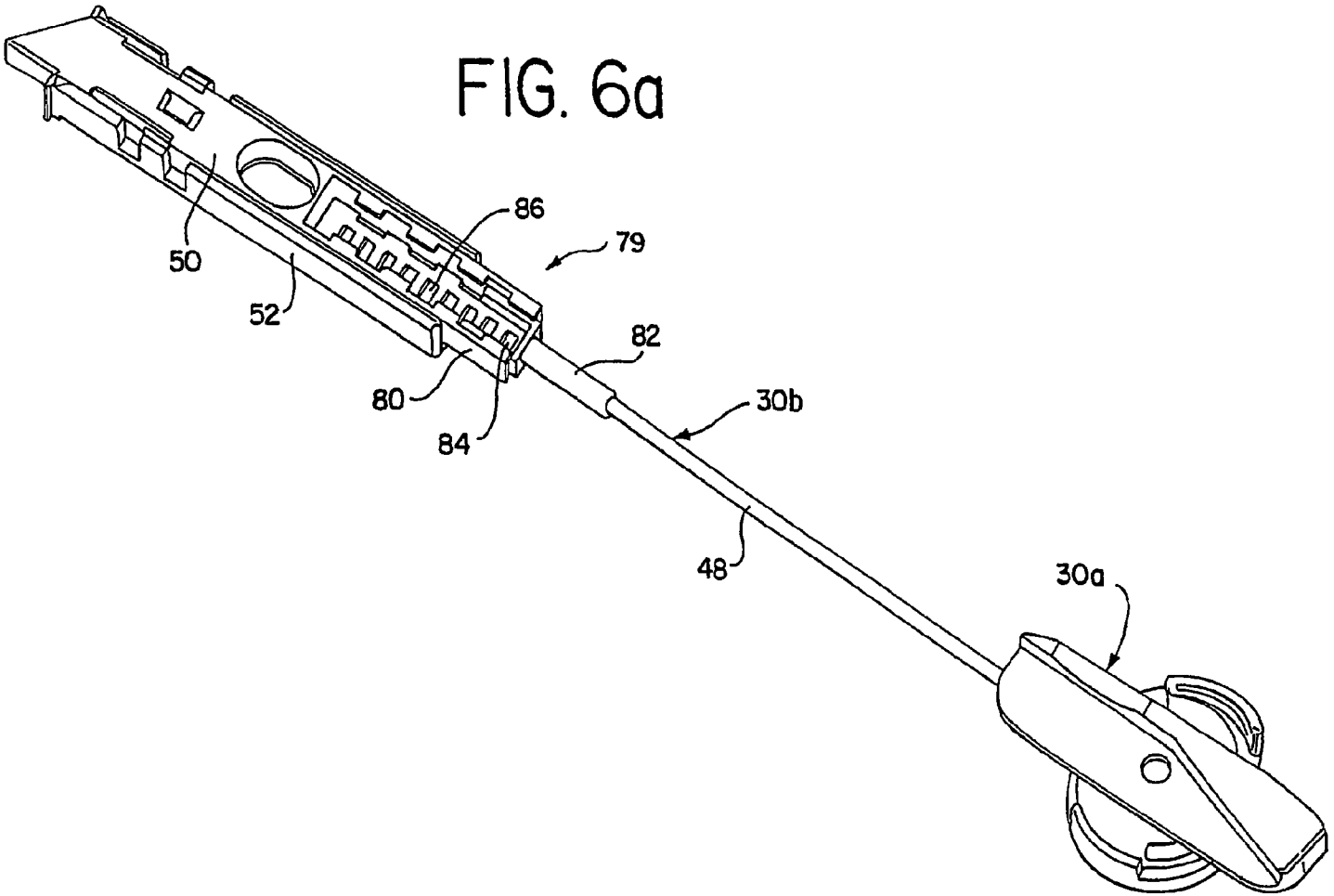

In one embodiment of the present invention in which a semi-rigid rod is employed as the connector 48, the connector 48 is a part of an adjustable connector assembly 79 as shown in FIGS. 3-6. As shown in FIG. 6*a*, the adjustable connector assembly 79 is comprised of an adjustable carrier 80 having a sleeve 82. The connector 48 is connected to the latch bolt 50 by the adjustable connector assembly 79. The position of the carrier 80 relative to the latch bolt housing 52 is adjustable to account for windows having different top sash rail lengths, to set the proper distance from the rotor 34 to the nose 56 of the latch bolt 50. The carrier 80 has holes 84, which receive sloped tabs 86. Thus, the housing 52 has a channel 88 formed by sidewalls 72 and shoulder portions 74. The carrier 80 is slid into the channel 88 to the proper position, where it is retained by the engagement of the holes 84 with the tabs 86.

The connector 48 may be secured to the sleeve 82 as by gluing. Alternatively, if a finer dimensional adjustment is necessary, the sleeve 82 and the corresponding end of the connector 48 can be cooperatively threaded. Thus, rotation of the connector 48 relative to the sleeve 82 further adjusts the distance from rotor 34 to the tip of the latch bolt 50.

As may be seen in FIGS. 4 and 6, the sidewall 60 of the latch bolt housing 52 has an inner sidewall 60*a* and an outer sidewall 60*b*, the inner sidewall 60*a* of the latch bolt housing 52, and at least a portion of a distal end of the adjustable carrier 80 has serrations 92. Thus, as the adjustable carrier 80 is slid into the channel 88, it is retained by the engagement of the serrations 92 of the adjustable carrier 80 with the complementary serrations 94 of the inner sidewall 60*a*. Thus, sliding the connector 48 and adjustable carrier 80 relative to the latch bolt housing 52 adjusts the distance from the rotor 34 to the latch bolt 50.

The embodiment in FIGS. 3-7 is considered a dual integrated assembly 30. As discussed, the rotor 34 has two slots 40. Thus, a connector 48 can be attached to each slot 40 wherein the sash lock mechanism 30*a* can actuate a pair of tilt-latch mechanisms 30*b* as described in greater detail below.

FIG. 8 discloses an embodiment of the integrated assembly 30 that is considered a single integrated assembly 30 wherein a single sash lock mechanism 30*a* cooperates with a single tilt-latch mechanism 30*b*. The connector 48 is coupled proximate the first end 72 to the latch bolt 50 and proximate a second end 74 to a first end 78*a* of the linkage member 78. The second end 78*b* of the linkage member 78 is pivotably coupled to the rotor 34. The linkage member 78 is preferably curvilinear in shape such that a greater distance of travel is obtained from the first end of the linkage member 78*a* to the second end of the linkage member 78*b* as the linkage member 78 pivots about its second end 78*b*. Thus, it can appreciated that the linkage member 78 can pivot about the second end 74 of the connector 48 and the rotor 34.

FIGS. 9-12 disclose another embodiment of the integrated assembly 30. In this embodiment, an alternative latch bolt housing 52 is utilized. The latch bolt housing 52 is a channel-like member that also houses the main components of the sash lock mechanism 30*a*.

FIGS. 13-18 disclose another embodiment of the integrated assembly 30 of the present invention. The embodiment of FIGS. 13-18 is similar to the embodiments shown in FIGS. 3-12 and similar elements will be designated with identical reference numerals. The sash lock mechanism 30*a* has a rotor 180 having a locking cam 181 and leg assembly 182. The leg assembly 182 has a projection 183 and a tab 184. The latch bolt housing 52 has a block assembly 185 having a well portion 186 that is adapted to receive the projection 183 when the assembly 30 is in the tiltable position as described in greater detail below. The tab 184 is adapted to abut the keeper 42 or the upper sash window 13 if an operator attempts to retract the latch bolt when the lower sash window 12 is in a closed position. This feature will also be described in greater detail below.

The latch bolt housing 52 further has an engaging member 186 depending from a bottom wall of the latch bolt housing 52. The engaging member 186 is adapted to engage an inside surface of the stile of the lower sash window 12 upon installation. This maintains the assembly 30 in the top rail 20 of the lower sash window. It is further understood that the assembly 30 is installed in the top rail 20 with the handle 36 rotated approximately 120 degrees wherein the extending portions of the rotor 180 are within the latch bolt housing. This allows the assembly 30 to fit into the opening of the top rail 20.

The latch bolt housing 52 further has a wall member 187 extending upwards from the bottom wall of the housing 52. The wall member 187 is positioned generally adjacent the linkage member 78 and the connected end of the connector 48. Because of the pivotal connections among the linkage member 78 and the connector 48 and the rotor 34, the wall member 187 maintains the connector 48 and linkage member 78 on an operational side 188 of the latch bolt housing 52. This wall member 187 prevents the linkage member 78 and connector 48 from moving towards the other side of the latch bolt housing 52 wherein the pivotal connections would be rendered inoperable. In a preferred embodiment, a portion of the bottom wall of the latch bolt housing 52 is cut and bent upwards to form the wall member 187. It is understood, however, that a separate wall member could be affixed to the bottom wall of the latch bolt housing 52.

As further shown in FIGS. 16 and 17, the window assembly 10 may have additional structures to selectively prevent sliding movement of the lower sash window 12 along the guide rails 16 of the master frame 14. As shown in FIG. 16, the guide rail 16 has a back wall 189 having an opening 190 therein. The opening 190 is vertically positioned on the guide rail 16 to correspond to the location of the latch bolt 50 when the lower sash window 12 is in a fully closed position. In the fully closed position, and the latch bolt 50 is dimensioned such that in the extended position, the nose 56 of the latch bolt 50 extends into the guide rail 16 and through the opening 190 in the back wall 189 of the guide rail 16. Engagement between the latch bolt nose 56 and the guide rail surfaces defined by the opening 190 prevents the lower sash window 12 from being raised, or bowed outwardly by external forces including wind forces or forced entry. The guide rail 16 further has a slot 191 therein, vertically positioned on the guide rail 16 proximate the location of the latch bolt 50 when the lower sash window 12 is in a fully closed position. The latch bolt nose 56 has a beveled portion 192 having a finger 193 extending therefrom. When the lower sash window 12 is in the fully closed position, the finger 193 is received by the slot 191. This cooperating structure provides further resistance to sliding of the lower sash window 12 in the guide rails 16. It is understood that in embodiments utilizing these cooperating structures, the sash lock mechanism 30*a* and the tilt-latch mechanism 30*b* are appropriately dimensioned such that the latch bolt 50 can be partially retracted wherein the finger 193 is removed from the slot 191 and the nose 56 is removed from the back wall opening 190 to allow the lower sash window 12 to be raised in order for the tab 184 to clear the keeper 42 when it is desired to place the integrated assembly in the tiltable position. The latch bolt 50, however, is not retracted enough at this initial retraction to clear the guide rail 16. Furthermore, if the lower sash window 12 remains in the closed position, further retraction will be prevented by the tab 184 engaging the keeper 42.

As shown in FIGS. 1-18, the integrated assembly 30 is generally supported by the top rail 20 of the lower sash window 12 and the base 22 of the upper sash window 13. With the exception of the keeper 42, all of the components of the integrated assembly 30 are mounted in and supported by the top rail 20 of the lower sash window 12. The keeper 42 is generally mounted on the base of the upper sash window. The top rail 20 has a generally hollow cavity to accommodate the a portion of the sash lock mechanism 30*a* and the tilt-latch mechanism 30*b*. The sash lock housing 32 may be mounted on a top surface of the top rail 20. The top rail 20 further has an opening to allow the handle 36 to be connected to the rotor 34. The tabs 68,70 of the latch bolt housing 52 are received by internal slots in the top rail 20. If the latch bolt housing 50 is used without the tabs 68,70, the design utilizing the engaging member 186 may be used.

As discussed, the integrated assembly 30 is operable among three positions: a first position corresponding to the locked position, a second position corresponding to the unlocked position and a third position corresponding to the tiltable position. The handle 36 of the sash lock mechanism 30*a* is actuated by an operator to place the integrated assembly 30 in these various positions. In one embodiment of the present invention, the handle 36 and the upper side of the rotor 34 include cooperating structures, such that the integrated assembly 30 produces an audible click, whenever the handle 36 reaches any of the locked, unlocked or released positions.

As discussed briefly above, the sash lock operations are performed by the sash lock mechanism 30*a* of the integrated assembly 30, and the tilt-latch operations are performed by the tilt-latch mechanism 30*b* of the integrated assembly 30 with actuation by the sash lock mechanism 30*a*. As can be understood from FIGS. 1 and 2, when the integrated assembly 30 is in the locked position, the lower sash window 12 is fully lowered in the master frame 14 and the upper sash window 13 is fully raised in the master frame 14. The rotor 34 engages the keeper 42 and the latch bolts 50 are in an extended position to engage the guide rails 16 of the master frame 14. Thus the lower sash window 12 is prevented from vertically opening and from tilting.

When an operator rotates the handle 36 to a first angle β from the locked position (FIG. 3), the integrated assembly 30 is placed in the unlocked position. In the unlocked position, the handle 36 rotates the rotor 34 such that the locking end 38 of the rotor 34 disengages from the keeper 42. With no engagement between the rotor 34 and the keeper 42, the lower sash window 12 is permitted to vertically open. However, the guide pin 76 slides along its respective slot 40 and thus the latch bolt 50 remains outwardly extended into the guide rails 16 Thus, the lower sash window 12 continues to be prevented from tilting.

When an operator further rotates the handle 36 to a second angle β from the locked position (FIG. 3), the integrated assembly 30 is moved from the unlocked position to the tiltable position. The second angle β is greater than the first angle α. In the tiltable position, the handle 36 is further rotated wherein the rotor 34 remains disengaged from the keeper 42, still permitting the lower sash window 12 to vertically open. In addition, the guide pin 76 abuttingly engages the end of rotor slot 40 such that as the rotor 34 is further rotated by the handle 36, the connector 48 pulls the latch bolt 50 to inwardly retract the latch bolt 50 into the latch bolt housing 52 and, therefore, into the top rail 20. Accordingly, the latch bolt 50 is released from the guide rail 16 thereby allowing the lower sash window 12 to be tilted inwardly.

In the embodiment shown in FIGS. 13-18, the rotor 180 has structure to selectively prevent retraction of the latch bolt 50. If the lower sash window 12 is in the fully closed position and an operator attempts to rotate the handle 36 from the unlocked position to the tiltable position, the tab 184 on the leg assembly 182 will engage the keeper 42 or other part of the upper sash window 13. This engagement will prevent further rotation of the handle 36 and thus retraction of the latch bolt 50. Thus, in order to retract the latch bolt 50, the lower sash window 12 must be raised slightly to wherein the leg will clear the keeper 42. This prevents inadvertent retraction of the latch bolt 50. To place the integrated assembly 30 in the tiltable position, the lower sash window 12 is raised slightly so that the tab 184 will clear the keeper 42 and allow full rotation of the handle 36. As discussed, it is understood that the sash lock mechanism 30*a* and tilt-latch mechanism 30*b*, in embodiments using these cooperating structures, will allow the latch bolt 50 to be partially retracted to allow lower sash window 12 to be raised to provide for needed clearance. FIGS. 17-18 disclose the integrated assembly 30 in the tiltable position wherein the latch bolt 50 is in a retracted position. When the actuator 36 is placed in the tiltable position and the latch bolt 50 is retracted, the projection 183 is received by and maintained in the well portion 186. This maintains the latch bolt 50 in a retracted position if desired. The projection 183 has adequate resiliency to be moved in and out of the well portion 186 upon rotation of the rotor 180 by the handle 36.

When operating the handle 36 in reverse to the above, the handle 36 is moved from the tiltable position to the unlocked position, and the rotor 34 is rotated back to the first angle α. The locking cam 44 remains disengaged from the keeper 42, still permitting the sash window to vertically open. However, the guide pin 76 no longer engages the end of the slot 40, and the biasing means 54 biases the latch bolt 50 outwardly into the guide rails 16. Thus, the sash window is prevented from tilting.

When the handle 36 is moved from the unlocked position to the locked position. The locking cam 44 engages the keeper 42, preventing the sash window from opening. The guide pin 76 engages the opposed end of the rotor slot 40, and holds the latch bolt 50 in its extended position. Thus, the sash window is still prevented from tilting, and the latch bolt 50 provides additional security against opening of the window.

As discussed in further detail below, the handle 36 can include a plurality of indicia to indicate to an operator certain operating positions of the integrated assembly 30.

As shown in FIG. 1, it is understood that a single integrated assembly 30 can be employed on opposite sides of the top rail 20 of the lower sash window 12. The construction, installation and operation of the integrated assemblies 30 are generally identical and configured appropriately for each side of the top rail 20. As can be understood from FIGS. 2 and 3, a single sash lock mechanism 30*a* can be employed to operate a pair of tilt-latch mechanisms 30*b* on opposite sides of the top rail 20, sometimes referred to as a dual integrated assembly. For example, the rotor 34 in FIG. 3 has a pair of slots 40. Each slot 40 receives a respective connector 48 of the pair of tilt-latch mechanisms 30*b* employed.

Another embodiment of the present invention is illustrated in FIGS. 19-40. According to this embodiment, the sash window assembly 10 includes an integrated tilt/sash lock assembly 130. For ease of description, this will hereinafter be referred to as the integrated assembly 130. As with the above described embodiments, the integrated assembly 130 of this embodiment generally includes a sash lock mechanism 130*a* and a tilt-latch mechanism 130*b*. The sash lock mechanism 130*a* provides a sash locking operation the tilt-latch mechanism 130*b* provides a tilt-latch operation. While the integrated assembly 130 will be described herein with respect to a dual integrated assembly wherein a single sash lock mechanism actuates a pair of latch bolts, the integrated assembly could also be constructed as a single integrated assembly wherein a single sash lock mechanism actuates a single latch bolt. In the case of the dual integrated assembly, an additional sash lock mechanism could be added. However, the second sash lock mechanism would only perform a sash lock operation and not a tilt-latch operation.

The sash lock mechanism 130*a* will first be described followed by a description of the tilt-latch mechanism 130*b* of the integrated assembly 130. The interaction between the sash lock mechanism 130*a* and the tilt-latch mechanism 130*b* will further be described in greater detail below.

FIGS. 23-31 illustrate one embodiment of the sash lock mechanism 130*a* according to the present invention. The sash lock mechanism 130*a* of the integrated assembly 130 generally includes a sash lock system 131 and a keeper 142.

As shown in FIGS. 23-26, the sash lock system 131 generally includes a rotor assembly 133, a rotor assembly housing 135 and an actuator or handle 136. The handle 136 of this embodiment of the integrated assembly 130 is operably coupled to the rotor assembly 133. As was described in the previous embodiment, the handle 136 is generally operable among three positions: the locked position, the unlocked position and the tiltable position.

The rotor assembly housing 135 generally houses the rotor assembly 133. The housing 135 is mounted on a top surface of the top rail 20 of the lower sash window 12. The housing 135 has an opening to receive the handle 136 for connection to the rotor assembly 133.

The rotor assembly 133 generally includes a cam 134. As best seen in FIGS. 29-31, the cam 134 of the rotor assembly 133 is comprised of a locking end 115 and an abutting end 112. The cam 134 further also includes a first flange 114 and a second flange 116. The first flange 114 traverses a first portion of the cam 134 proximate the abutting end 112 and is upwardly canted toward the locking end 115. The second flange 116 traverses a second portion of the cam 134 and is vertically spaced from the first flange 114. The paths of traverse of the first flange 114 and the second flange 116 do not overlap.

The button 108 is disposed proximate the handle 136 and is upwardly biased by a spring 118. As will be described in greater detail below, the button 108 provides a means for preventing the handle 136 from being rotated from the unlocked position to the tiltable position. According to the present invention, the button 108 is depressable and comprises a top portion 120 and a bottom portion 122. The bottom portion 122 of the button 108 includes a groove 124 therein which is adapted to cooperatively engage the flanges 114, 116. The operation of the button 108 relative to the cam 134 will be described in more detail below.

As shown in FIG. 19, the keeper 142 of the sash lock mechanism is generally a bracketed structure having an opening 144 adapted to receive the locking end 138 of the cam 134. The keeper 142 can be made of any material suitable for the applications described herein. The keeper 142 is disposed on the base of the upper sash window adjacent the sash lock system 131. When the sash window is in a closed position, the keeper 142 and sash lock system 131 are substantially aligned.

The tilt-latch mechanism 130*b* is generally shown in FIGS. 21 and 22. The tilt-latch operation of the integrated assembly 130 is generally carried out by the handle 136 actuating the tilt-latch mechanism 130*b*. The tilt-latch mechanism 130*b* generally includes a latch bolt assembly and a connector 148. The latch bolt assembly includes a first latch bolt 150, a second latch bolt 150', a sleeve 152, a spool assembly 126 and a pair of biasing means 153.

The first and second latch bolts 150, 150' each have a first end, a second end. Further, each latch bolt 150, 150' has a nose 156 extending from a first end which is adapted for engaging a respective one of the guide rails 16 of the master frame 14. The first and second latch bolts 150, 150' are each slidably disposed proximate opposed ends of the sleeve 152. Thus, the sleeve 152 defines a latch bolt housing for slidably securing the latch bolts 150, 150' in the integrated assembly 130. According to one embodiment of the present invention, the sleeve 152 comprises a first portion 152*a* and a second portion 152*b* that are slidably connected one to the other. Alternatively, as shown in FIG. 21, the first and second portions 152*a*, 152*b* are connected to the spool support member 137. The latch bolt system further includes a means for outwardly biasing the latch bolts 150, 150' toward respective the guide rails. Generally, the means for outwardly biasing the latch bolts 150, 150' is a spring 154. It should be noted that the means for biasing 153 the latch bolts 150, 151' should not be limited to springs. The means 154 may be a pressure activated mechanism, a cam, a compressed material with resilient characteristics or any other mechanisms suitable for outwardly biasing the latch bolts 150, 150'.

As further shown in FIGS. 21 and 22, the connector 148 having a first end 148*a* and an opposed second end 148*b*. The first end of the connector 148*a* is coupled to the first latch bolt 150 and the opposed second end of the connector 148*b* is coupled to the second latch bolt 150'. A portion of the connector 148 is operably coupled with the rotor assembly 133. The flexible connector 148 of this embodiment of the present invention is preferably a flexible cord. It is also contemplated, however, that a chain or wire be employed as a connector 148 without departing from the present invention.

As shown in FIGS. 21, 22 and 32-36, the spool assembly 125 generally includes a spool 126 and a spool housing 137 or spool support member 137. FIGS. 32 and 33 show the spool 126. The spool 126 has an end wall 128 and a sidewall 129 depending from the end wall 128. The spool 126 receives a portion of the cam 134. The end wall 128 of the spool 126 includes a throughway 147 which, in turn, includes at least one keyway 127. While the embodiments shown depict two keyways 127 in the end wall 128 of the spool 126, it is contemplated that the spool 126 may include any number of keyways 127 suitable for performing the cooperative function described below. The sidewall 129 of the spool 126 has a slot 107 disposed therein. According to this embodiment, a first surface of the cam 134 is coupled to the handle 136, and a second surface of the cam 134 is adapted to operatively engage the keyways 127 of the spool 126. According to one embodiment of the invention, the cam 134 includes engaging tabs 186 which cooperate with the keyways 127. The spool 126 is received in a spool support member 137. The spool support member 137 has a central opening adapted to receive the spool 126. The connector 148 passes through the spool support member 137.

As shown in FIG. 32, in one embodiment of the present invention incorporating the spool 126 described above, the connector 148 passes into and out of the slot 107 in the spool 126. The connector 148 forms a loop within the spool 126 and is secured therein by a plug or fastener 178. The plug or fastener 178 is shown in greater detail in FIG. 34. The fastener 178 has a plurality of tabs 186 which fit into an opening 167 in the spool 126 and engage the spool 126 to fasten the connector 148 to the spool 126. The fastener 178 further has a plurality of serrated teeth 179 that cooperate with corresponding serrated teeth 169 on the spool 126.

According to another embodiment shown in FIG. 33, the spool 126 has a hook 176 extending from the sidewall 129 of the spool 126. In this embodiment, the connector 148 loops around the hook 176. According to either of the above embodiments, the length of one end of the connector 148 as measured from the spool 126 must be greater than the opposed length of the connector 148 in order to ensure proper actuation of the latch bolts when moving the integrated assembly 130 to a tiltable position as described below.

FIGS. 37-40 disclose an alternative embodiment of the spool and spool housing. FIG. 37 discloses a portion of the sash lock mechanism 130*a* wherein a spool 194 is connected to the rotor 134 as described above. The spool 194 has a generally annular shape. As shown in FIG. 38, the spool 194 has a passageway or channel 195. The channel 195 is spaced from a center of the spool 194 and generally occupies a cord of the spool 194. The channel 195 is not a radial or diametrically passageway. The channel 195 is defined by a pair of spaced internal walls 196 of the spool 194. The internal walls 196 have a plurality of spaced protrusions 197. As shown in FIGS. 39 and 40, the connector 148 is routed around the spool 194 and through the channel 195. The protrusions 197 assist in gripping the connector 148. As shown in FIG. 40, an alternative embodiment of a spool housing 198 receives the spool 194 and the connector 148. The spool housing 198 has a first end 199*a* and a second end 199*b*. Because of the routing of the connector 148 in the spool 194, the connector 148 does not contact the second end 199*b* of the spool housing 198. Thus, the second end 199*b* of the spool housing 198 does not guide the connector 148. As can be understood, when the handle 136 is rotated to rotate both the cam 134 and spool 194, the connector 148 is pulled to retract the latch bolts 150 into the latch bolt housing 152.

The operation of the integrated assembly 130 will now be described in detail. As discussed above, the handle 136 of the present invention is operable among three positions: the locked position, the unlocked position and the tiltable position. When the sash windows are in the locked position, the cam 134 engages the keeper 142 and the latch bolts 150, 150' are fully, outwardly extended to engage the guide rails 16. Thus the sash window 12 is prevented from vertically opening and from tilting. Also, in the locked position, the groove 124 of the button 108 is in operable engagement with the first flange 114, and the top portion 120 of the button 108 is fully retracted in the sash lock housing 135.

When the handle 136 is moved from the locked position to the unlocked position, the cam 134 is rotated to a first angle from the locked position. This can be considered a 60 degree rotation of the handle 136. This rotation disengages the locking end 138 of the cam 134 from the keeper 142, permitting the sash window 12 to vertically open. However, the tabs 186 of the cam 134 are not yet abutting an inner surface of the keyways 127 on the spool. Thus, the tilt latch bolts 150, 150' remain outwardly extended into the guide rail 16. Thus, the lower sash window 12 continues to be prevented from tilting. As the handle 136 is moved from the locked position to the unlocked position, the groove 124 of the button 108 slides along the first flange 114 which extends the button out of the sash lock housing 135. When the handle 136 continues to be rotated in the unlocked position, generally considered from the 60 degree rotation moving towards a 120 degree rotation, the latch bolts 150,150' are partially retracted. At the 120 degree rotational position, the bottom of the button 108 abuts the second flange 116, thereby obstructing further movement of the handle 136 and rotation of the cam 134. This configuration is generally shown in FIGS. 23 and 28 wherein the handle 136 is rotated to the 120 degree rotational position. This prevents inadvertent retraction of the latch bolts 150, 150;. Thus, this configuration provides a means for preventing the handle 136 from being moved from the unlocked position to the tiltable position. More specifically, in this position, the top of the button 108 is fully upwardly biased. In order to further move the handle 136 from the unlocked position to the tiltable position, the button 108 must be depressed. Depressing the button 108 causes the groove 124 of the button 108 to be aligned with and engage the second flange 116 of the cam 134. With the second flange 116 aligned with the groove 124, the cam 134 can be further rotated by the handle 136.

When the handle 136 is moved from the unlocked position to the tiltable position, the cam 134 is rotated a second angle from the locked position. This can be considered rotation from the 120 degree rotational position to the 180 degree rotational position. In the tiltable position, the locking end 138 of the cam 134 remains disengaged from the keeper 142, still permitting the sash window to vertically open. However, the tabs 186 extending from the cam 134 engage abutting inner surfaces of the keyways 127 as the cam 134 is rotated. This abutment rotates the spool 126 which, in turn, pulls the connector 148 so that the tilt latch bolts 150,150' are inwardly retracted and released from the guide rail 16. Thus, the sash window 12 is permitted to tilt.

When operating the handle 136 in reverse to the above, the handle 136 is moved from the tiltable position to the unlocked position, and the cam 134 is rotated back to the first angle. The rotor assembly 133 may also include a handle spring that assists in returning the handle 136 from a 180 degree position to a 120 degree position. When the handle 136 is moved from the unlocked position to the locked position. The locking end 138 engages the keeper 142, preventing the sash window 10 from opening. Thus, the sash window 10 is still prevented from tilting, and the tilt latch bolts 150, 150' provide additional security against opening of the window.

As the handle 136 is moved from the tiltable position to the unlocked position, the groove 124 of the button 108 re-engages a ramped portion of the second flange 116. When the handle 136 reaches the unlocked position, the spring 154 cooperating with the button 108 biases the button 108 upward, such that the groove 124 is aligned with the first flange 114. As the handle 136 is moved toward the locked position, the groove 124 re-engages the first flange 114 and draws the top of the button 108 downward into the sash lock housing 135.

Yet another embodiment of the present invention is illustrated in FIGS. 41-58. It is contemplated that the embodiment of FIGS. 41-58 is preferably utilized in a sash window assembly 10 made from wood such as shown in FIG. 31. The wooden sash window assembly 10 shown in FIG. 41 has a similar construction to the sash window assemblies disclosed in FIGS. 1, 2 and 19. It is further understood that the embodiment of FIGS. 41-58 can also be utilized in other sash window assemblies made from other materials such as vinyl.

According to this embodiment, a sash window assembly includes an integrated tilt/sash lock assembly 230. For ease of description, this will hereinafter be referred to as the integrated assembly 230. As with the above described embodiments, the integrated assembly 230 of this embodiment provides a sash locking operation and a tilt latch operation. While the integrated assembly 230 will be described herein with respect to a single integrated assembly 230, the integrated assembly 230 can also be used in connection with a dual integrated assembly.

The integrated assembly 230 generally includes a sash lock mechanism 230*a* and a tilt-latch mechanism 230*b*. The interaction between the sash lock mechanism 230*a* and the tilt-latch mechanism 230*b* will be described in greater detail below. FIGS. 42-43 illustrate one embodiment of the sash lock mechanism 230*a* according to the present invention. The sash lock mechanism 230*b* of the integrated assembly 230 generally includes a sash lock system 231 and a keeper 242.

As shown in FIGS. 42-56, the sash lock system 231 includes a handle 236, a rotor assembly 234, and a rotor assembly housing 232. The handle 236 of this embodiment of the integrated assembly 230 is operably coupled to the rotor assembly 234. As was described in the previous embodiments, the handle 236 is generally operable between three positions: the locked position, the unlocked position and the tiltable position.

The rotor assembly 234 is generally comprised of a rotor 235 having a locking cam 238 and a pawl 278. The rotor 235 has a first face 235*a* and a second face 238*b*. The locking cam 238 of the rotor 235 also has a slot 282 which will be described in greater detail below. In a preferred embodiment, the locking cam 238 is integral with the rotor 235. It is also contemplated, however, that the locking cam 238 be a discrete member which is separate from the rotor 234.

As shown in FIG. 47, the pawl 278 is generally disposed proximate the second face 235*b* of the rotor 235. The pawl 278 comprises a base 287 and an appending member 289. The base 287 includes a tab 280 extending generally perpendicular from a top surface of the base 287. The tab 280 of the pawl 278 abuttingly engages the rotor 235 such that in operation, the rotor 235 and the pawl 278 generally move in unison. The appending member 289 may be biased by a spring within the tilt-latch bolt housing 252 or by an independent coil spring operably attached to the base 287 of the pawl 278.

FIG. 48 shows a plan view of the handle 236. As illustrated in FIG. 48, the handle 236 can have a plurality of symbols 210,212,214 to indicate to an operator certain operating positions of the integrated assembly 230. For example, the handle 236 is shown in a locked position with the locked symbol 210 being aligned with a base marking 216. When the handle 236 is rotated to an unlocked position, the unlocked symbol 212 will be aligned with the base marking 216. Similarly, when the handle 236 is further rotated to where the sash window can be tilted, the tilt or unlatch symbol 214 is aligned with the base marking 216. In this embodiment of the present invention, the handle 236 is made preferably of metal.

The keeper 242 is generally a bracketed structure having an opening 243 adapted to receive the locking cam 238 of the rotor 235. FIGS. 46 and 47 show one embodiment of the keeper 242 and rotor 235 utilized in the integrated assembly 230. In this embodiment, the keeper 242 has a protrusion 245 on an underside surface. The locking cam 238 has a notch 292. The protrusion 245 fits into the notch 292 when the sash lock assembly is locked to give an operator an indication that there is positive engagement between the locking cam 238 and the keeper 242. The keeper 242 can be made of any material suitable for the applications described herein.

FIGS. 51-56 generally disclose the tilt-latch mechanism 230*b*. The tilt-latch operation of the integrated assembly 230 is generally carried out by the handle 236 in cooperation with the tilt-latch mechanism 230*b*. The tilt-latch mechanism 230*b* generally includes a latch bolt assembly 249 and a connector 248. The latch bolt assembly 249 includes a latch bolt 250, a latch bolt housing 252 and a biasing means.

The latch bolt 250 is generally of the type described in reference to the preferred embodiments above. In particular, the latch bolt 250 generally has a first end 250*a*, a second end 250*b* and a nose 256 extending from the first end 250*a* that is adapted to engage a one of the guide rails 16 of the master frame 14. The latch bolt 250 is slidably disposed within the latch bolt housing 252. In one embodiment of the invention shown in FIG. 53, the second end of the latch bolt 250 is coupled to a slide 251 by the connector 248 (described in detail below). In this embodiment, both the latch bolt 250 and slide 251 are slidably disposed within the housing.

As shown in FIGS. 51-53, the latch bolt housing 252 has a bottom wall 258 and a pair of opposing side walls 260 extending from the bottom wall 258. The latch bolt housing 252 further has a first end 264, a second end 266 and an outward end opening 262 adjacent the first end 264. In the preferred embodiment the latch bolt housing 252 is made of plastic suitable for mounting in wooden sash window frames, but could also be made of other materials. The latch bolt housing 252 of this embodiment is generally smaller in size than the other embodiments. It is understood than the latch bolt housings of the various embodiments described herein can vary in size. The means for biasing 254 the latch bolt 250 through the outward end opening 262 of the housing 252 is disposed in the housing 252. The means for biasing 254 typically comprises a spring although other structures that can force the latch bolt 250 through the outward end opening 262 are possible.

The connector 248 is operably connected at one end to the pawl 287, and at the opposed end to the latch bolt 250. According to one embodiment of the present invention, the connector 248 is a flexible cord. Preferably, however, that the connector 248 comprises a semi-flexible linkage. The connector 248 may be formed from various synthetic semi-flexible materials, including a flexible plastic, polyurethane or any other semi-flexible material suitable for such an application.

In one embodiment shown in FIGS. 51 and 54, one end of the connector 248 terminates in a first hook 288. The first hook 288 is connectable to a slot proximate the second end of the latch bolt 250*b*. The opposed end of the connector 248 terminates in a second hook 290 having a peg 291 and an overhang member 293. According to this embodiment, an alternate pawl 278 (FIG. 50) has a notch 292 in the appending member 289. The notch 292 of the pawl 278 engages, and fits around the peg 291 of the second hook 290. The overhang member 293 of the second hook 290 positioned over the pawl 278 prevents the connector 248 from inadvertently becoming disengaged from the pawl 278 when the latch bolt 250 retracts when the sash window is tilted back into a vertical position in the master frame.

The connector 248 can also includes a guide portion 294 for guiding the integrated assembly 230 within a channel in the sash rail. It is contemplated that the guide portion 294 be integrally formed into the connector 248 or a discrete member that attaches to the connector 248. The connector 248 further has an annular leg 253 generally adjacent the first hook 288 that places a remaining portion of the connector 248 in a raised vertical position with respect to the first hook 288' for the purpose of aligning the second hook 290 with the pawl 278.

An alternative embodiment of the connector is shown in FIG. 55, and generally referred to with the reference numeral 248". As seen in FIG. 54, at least a portion of the connector 248" is round according to this embodiment. The round portion terminates in a round snap link 294 having a plurality of snapping ridges 296 formed therein. In this embodiment, the round snap link 294 engages the latch bolt 250. This embodiment allows the latch bolt 250 and latch bolt housing 252 to rotate about the linkage during assembly such that the integrated assembly may be either a left assembly or a right assembly by turning the latch bolt 250 and latch bolt housing 252 180 degrees. The opposed end of the connector 248" terminates in the second hook 290 which engages the notch 292 in the pawl 278. The connector 248 further has a curved member 300 at a distal end generally adjacent the second hook 290. The curved member 300 keeps the peg 291 properly aligned for engagement with the pawl 278.

As shown in one embodiment illustrated in FIGS. 42-44, the sash lock housing 252 may be disposed in a first location 283 of the sash rail 20 that is laterally offset from, or misaligned with, a second location 284 of the top rail 20 in which the latch bolt housing 252 is disposed. It is understood that in a preferred embodiment, channels are routed into the top rail 20 of the wooden sash window 12 to accommodate the sash lock mechanism 230*a* and the tilt-latch mechanism 230*b*. In this embodiment, the appending member 289 of the pawl 278 includes a step portion 301 (FIG. 49). As shown in FIGS. 42-44 and 49, the base 287 of the pawl 278 will be mounted proximate the first location 283, which is at a higher location in the top sash rail 20 because the depth of the slot 282 at the first location 283 is limited by cladding 285 that protects the sash window 12. The step portion 252 allows the latch bolt housing 252 to be mounted at a lower depth in the rail 20 than the sash lock housing 252. Such a configuration facilitates a channel in the sash window rail 20 of sufficient depth to secure the latch bolt housing 252 with minimal compromise to the structural integrity of the rail 20. It is understood that the step portion 301 can vary for different sash window assembly configurations.

The operation of the integrated assembly 230 will now be described in detail. As discussed briefly above, in general, the sash lock operations are performed by the sash lock mechanism 230*a* of the integrated assembly 230, and the tilt latch operations are performed by the tilt-latch mechanism 230*b* of the integrated assembly 230. When the sash windows are in the locked position, the locking cam 238 engages the keeper 242 and the latch bolts 250 are fully, outwardly extended and engaged with the guide rails 16. Thus the lower sash window 12 is prevented from vertically opening and from tilting.

When the handle 236 is moved from the locked position to the unlocked position, the rotor 234 is rotated to a first angle from the locked position. This rotation disengages the locking cam 238 from the keeper 242, permitting the lower sash window to vertically open. However, the tab 280 of the pawl 278 is not yet engaged by the rotor 234 and thus the latch bolt 250 remains outwardly extended into the guide rail 16. Thus, the sash window 12 continues to be prevented from tilting.

When the handle 236 is moved from the unlocked position to the tiltable position, the rotor 234 is rotated a second angle from the locked position, wherein the second angle is greater than the first angle. In the tiltable position, the locking cam 238 remains disengaged from the keeper 242, still permitting the lower sash window 12 to vertically open. However, the tab 280 extending from the pawl 278 engages an abutting end of the rotor 234 as the rotor 234 is rotated, and the latch bolt 250 is inwardly retracted and released from the guide rail 16. (See FIG. 56). Thus, the sash window 12 is permitted to tilt. It is understood that this operation is performed for each integrated assembly 230 mounted on opposite sides of the top rail 20 of the lower sash window 12.

When operating the handle 236 in reverse to the above, the handle 236 is moved from the tiltable position to the unlocked position, and the rotor 234 is rotated back to the first angle. The locking cam 238 remains disengaged from the keeper 242, still permitting the sash window to vertically open. In the unlocked position, the pawl 278 moves towards its biased position as the pawl tab 280 no longer is rotatably biased by the rotor 234. A spring within the latch bolt housing 252 biases the pawl 278 to this position and further biases the latch bolt 250 outwardly into the guide rails 16. Thus, the sash window 12 is prevented from tilting.

When the handle 236 is moved from the unlocked position to the locked position. The cam 238 engages the keeper 242, preventing the sash window 12 from opening. Thus, the sash window 12 is still prevented from tilting, and the latch bolt 250 provides additional security against opening of the window.

The handle 236 and the upper side of the rotor 234 may include cooperating structures, such that the integrated assembly 230 produces an audible click, whenever the handle 236 reaches any of the locked, unlocked or released positions.

FIGS. 57-58 disclose an alternative embodiment of the sash lock mechanism 230*a* used in the integrated assembly 230 of FIG. 41.

FIG. 57 discloses an exploded view of a sash lock mechanism 330*a* used in the integrated assembly 230 of the present invention. The sash lock mechanism 330*a* includes an actuator arm 336 operatively connected to a rotor 340 and washer 326. The sash lock mechanism 330*a* further includes a housing 320, a collar 122, an actuator plate or pawl 372 and a keeper 301.

The actuator arm 336 has a post 328, which extends in a longitudinally downward direction from the actuator arm 336, generally coaxial with a shaft 338. The post 328 has an end portion 330 adapted for cooperative engagement with the rotor 340. In the present embodiment, the end portion 330 has a stepped configuration adapted for operative engagement with a central portion 332 of the rotor 340. However, it is understood that the end portion 330 can have virtually any configuration that enables coupled connection with the rotor 340. The collar 322 provides intermediate support to the connection between the post 328 and the rotor 3 40. The collar 322 has an opening 334 adapted to receive the post 328 and rotor 340 and a flanged top portion 336, configured for confronting abutment with a lower portion of the actuator arm 336.

The rotor 340 is positioned intermediate to the actuator 336 and the pawl 372. The rotor 340 includes a locking cam surface 344. As shown, the locking cam surface 344 has a generally curved inclined surface 339 extending semi-annularly about the rotor 340. As such, the locking cam surface 344 enables sliding engagement with the keeper 301. The locking cam surface 344 also has a notch 306 adapted to receive a protrusion 304 of the keeper 301. Accordingly, when the sash lock mechanism 330*a* is in a locked position, the protrusion 304 is received by the notch 306. This engagement provides a "feel" indication to the operator that a positive engagement between the locking cam surface 344 and the keeper 301 has been formed, thus indicating the assembly in the locked position. The rotor 340 has a first end portion 341 defining an abutment surface 342. The abutment surface 342 has a generally planar first surface 345 adapted for abutting engagement with a first edge 350 of the first tab 348 of the pawl 372. The rotor 340 has an edge 346 provided for abutting engagement with an inner surface 366 of the first tab 148 of the actuator plate or pawl 372.

As shown in FIG. 57, the rotor 340 further includes a second post 333 extending generally downward from a bottom portion of the rotor 340. The second post 133 includes a first section 380 positioned adjacent to a lower portion of the rotor 340 proximate to the housing 320. The second post 333 further includes a second section 382, and an intermediate section 384 positioned intermediate to a lower portion of the first section 380 and an upper portion of the second section 182.

As shown in FIG. 57, the actuator plate or pawl 372 is positioned intermediate to the rotor 340 and the housing 320. The pawl 372 is configured for operative engagement with the rotor 340 and housing 320. As such, the pawl 372 includes an appending member 378, a first tab 348, a second tab 354, a finger 356, and a base 376. In the present embodiment, the base 376 has a generally foot-shaped configuration having non-parallel sides and defining a first side 400, a second side 402, a third side 404, and an end portion 406. The first side 402 of the actuator plate or pawl 372 has an edge 358 adapted for abutting engagement with an inner surface of the first upright 360 of the housing 320. The finger 356 of the base 376 extends generally outward from the third side 404 of the base 376. The finger 356 has an edge 360 configured for abutment with an inner surface 362 of a second upright 364.

The first tab 348 extends generally perpendicularly from the top surface of base 376 of the pawl 372. The first tab 348 has a generally planar configuration including an inner surface 366 and a first edge 350. The inner surface 366 provides an abutment for operative engagement with the abutting edge 346 of the rotor 340.

The second tab 354 provides a means for preventing actuation of the latch bolts 50 when the window is in a closed position. The second tab 354 extends generally perpendicularly upward from the top surface of the base 376 at the end 406 of the pawl 372. Preferably, the second tab 354 has a generally rounded edge 408, providing a sliding lead-in surface. In the event that the second tab 354 is extending slightly outward, such that if the keeper 301 or the window engages the tab 354 in an open position, the sliding surface enables the window to slide past the tab 354. The second tab 354 extends outward such that the sash assembly engages the keeper 301, thereby preventing the sash window 12 from tilting. The pawl 372 further includes an opening 410 adapted to receive the second post 333. Preferably, the opening 410 is adapted to receive the intermediate section 384 of the post 333.

The housing 320 includes a base portion 372 having a first end 370 and a second end 368. The housing 320 further includes a first upright 360 and a second upright 362. The first upright 360 extends generally perpendicularly upward from the top surface of the base portion 372 at the first end 370. The second upright 362 extends generally perpendicularly upwardly from the top surface of the base portion 372 at the second end 368. As such the first and second uprights 360, 362 are generally parallel to each other. The first upright 360 defines a first stop for abutting engagement with the edge 358 of the base 376 in a closed position. The second upright 362 defines a second stop adapted for abutting engagement with the edge 360 of the finger 356, in an open position. The housing 320 further includes a semi-annular slot 374 and one or more openings 376 adapted to receive a protrusion or dimple 378 from the washer 326. The slot 374 and opening 376 are positioned for cooperative engagement with a dimple 378 in the washer 326. Preferably, the housing 320 provides two openings 376. The second opening 376 enables the housing 320 to be a reversibly positioned on the top rail 20 in either a left assembly or right assembly as shown in FIG. 41. In this manner, the dimple 378 engages the second opening 376 of the base 376. The housing 320 further includes an opening 412 adapted to receive the post 333.

In the present embodiment, the washer 326 has a generally circular shape, however it is understood that the washer 326 can have virtually any shape without departing from the scope of the present invention. The washer 326 is positioned below the housing 320. The washer 326 includes an opening 386 adapted to receive the intermediate section 384 of the post 333. The washer 326 is rotatively coupled to the actuator 336 such that rotational movement of the actuator 336 rotates the washer 326. The dimple 378 or protrusion 378 of the washer 326 extends generally upwardly from a top surface of the washer 326 for engagement with the lower surface of the base 372. The protrusion 378 is coaxially aligned with the slot 374 and opening 376 of the base 372 enabling the protrusion 378 to be inserted into the opening 376 in a locked position, and slot 374 in a unlocked position. As further shown in FIG. 57, a nylon washer 399 may be provided between the washer 326 and housing 320. As the washer 326 and housing 320 are preferably made from the same material (e.g. metal), a nylon intermediary provides for an enhanced smooth and quite operation. It is noted that the nylon washer 399 is shown enlarged in FIG. 57 for ease of description. The nylon washer 399 is thin wherein the dimple 378 on the washer 326 will adequately deform the washer 399 to provide the "feel" indications described herein.

The rotor 340 is mounted to the actuator plate 372 and housing 320. As such, the first section 380 of the post 333 is inserted in the opening 410 of the actuator plate 372. In this arrangement, the opening 310 of the actuator plate 372 loosely fits around the outer surface of the first section 380 enabling the post 333 to rotate within the opening 410. The intermediate section 384 of the post 333 is inserted in the opening 412 of the housing 320. The opening 412 loosely fits around the intermediate section 384. The second section 382 of the post 333 is inserted in the opening 386 of the washer 326. The second section 382 is fastened to the washer 326. In the preferred embodiment, the end portion 392 of the second section 382 is spin formed, forming a head wherein the post 333 is fastened to the washer 326.

When the sash lock mechanism 330*a* is in a locked position, the protrusion 378 fits into the opening 376 providing the operator with a "feel" indication that the sash lock assembly is in a locked position. When the sash lock assembly is in an unlocked position, the protrusion 378 fits into the slot 374 providing a "feel" indication to the operator that the assembly 230 is in the unlocked-tiltable position. The slot 374 is sized to allow further rotation of the protrusion 378 within the slot 374 when the actuator arm is further rotated to retract the latch bolts.

In a locked position, the first edge 346 of the rotor 344 is in abutment with the inner surface 366 of the first tab 348. The outer surface 355 of the second tab 354 is positioned in a confronting relationship with the inner surface 362 of the second upright 364. As such, the protrusion 378 of the washer 326 is inserted into the opening 376 of the plate, providing a "feel" indication to the operator that the sash mechanism 330 is in the locked position. Additionally the edge 402 of the second side 358 of the pawl 372 is in confronting relation with the inner surface 361 of the first upright 360. The sash lock mechanism 330*a* can be rotated from the locked position to the unlocked position by rotating the actuator 336. The rotation moves the protrusion 378 into the slot 374 providing a "feel" indication that the assembly 230 is in the unlocked position. Further rotation of the actuator arm 336 causes the abutment surface 342 of the cam 344 to engage the edge 350 of the first tab 348. This engagement rotates the pawl 372 such that the appending member 378 pulls the connected latch bolt 250 to retract the latch bolt 250.

As discussed, the dimple 378/opening 376/slot 374 arrangement provides a "feel" indication to the operator of the position of the assembly 230. The operator can tell or "feel" that the assembly 230 is in a locked position when the dimple 178 is received by the opening 176. The protrusion 304/notch 306 arrangement also provides a "feel" indication of the locked position. Similarly, the operator can tell, or "feel" that the assembly 230 is in an unlocked position wherein the latch bolts 250 can be retracted upon further rotation of the actuator arm 336 when the dimple 378 is received by the slot 374. It is further understood these cooperative engaging members provide further resistance to forced entry wherein an intruder attempts to use a tool to rotate the rotor from outside a housing or building to unlock the sash lock assembly.

As further discussed, the second tab 354 provides a means to prevent retraction of the latch bolt 250 when the window is in its closed position. When the window is in its closed position, the components of the sash lock mechanism 330*a* are vertically aligned. Thus, the second tab 354 is vertically aligned with the keeper 301. If the actuator arm 336 is rotated to a position to retract the latch bolt 250, the rotor 344 rotates the pawl 372 wherein the second tab 354 is rotated into engagement with the keeper 301. This engagement prevents further rotation of the actuator arm 336 wherein the appending member 378 of the pawl 372 is prevented from pulling the connector to retract the latch bolt 250. Thus, the latch bolts 250 cannot be retracted to tilt the window when the window is in its closed position. This prevents inadvertent retraction of the latch bolts 250 allowing for a tiltable window if an operator only wanted to unlock the sash lock assembly.

Accordingly, to place the window in a tiltable position, the window must first be raised vertically wherein the keeper 301 is vertically misaligned with the remaining components of the sash lock mechanism 330*a*. With this misalignment, the actuator arm 336 can be fully rotated to retract the latch bolts 250 because the second tab 354 will no longer engage the keeper 301. In the present embodiment the actuator arm 336 can be rotated until the finger 356 is in abutment with the inner surface 362 of the second upright 364.

In accordance with another embodiment of the invention, any of the above described integrated assemblies may include a system that allows for the hardware components of the integrated assembly to be retractable such that the hardware is substantially flush with the top surface of the top rail 20 of the sash window 12 and a substantially smooth line of sight is provided. Such a system generally includes a retractable handle 536 and a retracting mechanism 538 and is depicted in FIGS. 59-65.

The retractable handle 536 is movable between a retracted position (FIGS. 59-60) and an operational position (FIGS. 61-65). As illustrated in FIG. 60, when the handle 536 is in the retracted position, a top surface of the handle 336 is substantially flush with the top surface 564 of the top rail 20 such that a substantially smooth sight-line is provided. As shown in FIGS. 62-65, when the handle 536 is in the operational position, the handle 536 is projected above the top surface 564 of the top rail 20. In the operational position, the handle 536 is movable between a plurality of operational positions (see FIGS. 61-65). In particular, the handle 336 is operable between the three operational positions described above: locked, unlocked and tiltable.

The system also includes a retracting mechanism 538 that is operably associated with the handle 536. The retracting mechanism 538 is capable of moving the handle 536 between the retracted position (FIG. 60) and the operational position (FIGS. 62-65). The retracting mechanism 538 comprises a biasing means 560 disposed below the handle 536 and a catch 562 in cooperative engagement with the biasing means 560. The catch 562 disengages the biasing means 560 upon some predetermined stimulus, thereby causing the biasing means 560 to urge the handle 536 to the operational position (illustrated in FIG. 61). The biasing means 560 may be a spring or any other mechanism suitable for applying upward pressure to the handle 536. When biased to the operational position, the handle 536 has structure to cooperate with the additional structure 520 of the sash lock mechanism to operate the integrated assembly as described above.

In one embodiment of the invention depicted in FIG. 61, the catch 562 can be designed to become disengaged from the biasing means when a user depresses the top surface of the handle 536. The downward pressure on the handle 536 moves the catch 562 out of contact with a resting surface on the biasing means 560. However, it is contemplated that the catch 562 may be disengaged from the biasing means 560 by depressing or sliding a separate button that is operably connected to the catch 562 or biasing means 560. With the handle 536 in a retracted position, a smooth light of sight is provided by the assembly.

Another embodiment of the present invention is illustrated in FIGS. 66-92. The embodiment of the present invention shown in FIGS. 66-92 is similar to the embodiment illustrated in FIGS. 19-40. Features of the presently described embodiment that are similar to features of previously described embodiments may be described using the same reference numerals as previously used. FIGS. 66-92 show an integrated tilt/sash lock assembly 130 (the integrated assembly 130). Similar to previous embodiments, the integrated assembly 130 generally includes a sash lock mechanism 130*a* and a tilt-latch mechanism 130*b*. The sash lock mechanism 130*a* provides a sash locking operation and the tilt-latch mechanism 130*b* provides a tilt-latch operation.

As previously described, the sash lock mechanism 130*a* includes a keeper 142 (see FIG. 19) and a sash lock system 131 (FIG. 66). The keeper 142 is identical as discussed above and will not be further described. As further shown in FIG. 66, the sash lock system 131 includes a rotor assembly housing 702, an actuator 704 (FIGS. 66, 86-88) and a rotor assembly comprising a cam 134 (see FIG. 23-24). As further shown in FIG. 86, the housing 702 includes a central housing opening 706 and an annular groove 708 surrounding the opening 706. The groove 708 includes a first end wall 710, a second end wall 712, a first bump 714 and a second bump 716.

As shown in FIGS. 87 and 88, the actuator 704 includes a stem 718 having a proximal end 720 and a distal end 722. The distal end 722 is configured to operably engage or couple to the cam 134, through the central opening 706, as previously described. Located near the proximal end 720 is a protuberance 724. In an assembled state, the stem 718 passes through the opening 706 and is operably coupled to the cam 134. The protuberance 724 is received by the groove 708. The end walls 710, 712 and bumps 714, 716 cooperate with the protuberance 724 to provide a user with a tactile or 'feel' indication that the actuator 704 is in one of the previously described locked position, unlocked position and tiltable position.

More specifically, and with reference to FIGS. 66, 86-88, when the protuberance 724 is received in the groove 708 and located between the first end wall 710 and the first bump 714, the actuator 704 is generally in the locked position. As the actuator 704 rotates past the first bump 714, there is enough relative movement allowed, or play, between the housing 702 and the actuator 704 to allow the protuberance 724 to pass over the first bump 714. This interaction between the protuberance 724 and the first bump 714 provides a tactile indication to a user that the actuator 704 has moved from the locked position into the unlocked position. As the actuator 704 continues to rotate towards the second bump 716 it continues to move through the unlocked position. As the actuator 704 moves past the second bump 716, the protuberance 724 passes over the second bump 716 providing an indication that the actuator is moving from the unlocked position into the tiltable position. When the protuberance is received between the second bump 716 and the second end wall 712, the actuator is generally in the tiltable position. It is noted that in one preferred embodiment, the actuator 704 moves counterclockwise when moving from the locked position to the tiltable position. It is understood that the actuator 704 could also be connected in a configuration to move clockwise when moving from the locked position to the tiltable position.

It is noted that there is not enough relative movement between the housing 702 and the actuator 704 to allow the protuberance 724 to move past either the first end wall 710 or the second end wall 712. Therefore, it can be seen that the first end wall 710 and second end wall 712 cooperate with the protuberance 724 to define or limit the extent of angular movement or rotation of the actuator 704. In other words, as the actuator 704 is rotating towards the locked position, the protuberance 724 may not rotate past the first end wall 710. Similarly, as the actuator 704 is rotating towards the tiltable position, the protuberance 724 may not rotate past the second end wall 712.

Additionally, when the actuator 704 is moved to the tiltable position, the protuberance 724 is received by the groove 708 between the end wall 712 and the second bump 716. From this position, as the tilt-latches are spring loaded, the actuator 704 is biased to rotate in a clockwise direction as looking at the housing 702 as shown in FIG. 86. The second bump 716 and protuberance 724 also cooperate to prevent the actuator 704 from rotating from the tiltable position and past the unlocked position into the locked position by virtue of said biasing of the actuator 704. Thus, positive actuation from a user is required when moving the actuator 704 from the unlocked position to the locked position.

It is further noted that the rotor assembly housing 702 may also include a torsional spring (not shown), one end of which acts on the screw of a post of a screw hole of the housing 702, the other of which acts on the cam 134. The torsional spring assists in biasing the actuator 704 from the tiltable position to the unlocked position. Therefore, once a user releases the actuator 704 when in the tiltable position, the actuator 704 will return to the unlocked position which will in turn allow the latch bolts 150, 150' to return to a position extending from the upper sash rail 20. This configuration is desirable so that the latch bolts 150,150' are not inadvertently allowed to remain in a retracted position without the knowledge of a user.

The tilt-latch mechanism 130*b* (FIGS. 66-70) includes a latch bolt assembly and a connector 148. The latch bolt assembly includes a first latch bolt 150, a second latch bolt 150', a pair of sleeves 152*a*, 152*b* and a spool assembly 726. Each latch bolt 150, 150' has a first end having a nose 156 adapted to engage the master frame 14, as previously described. The first latch bolt 150 and second latch bolt 150' are slidingly disposed in a respective sleeve 152*a*, 152*b* at opposite end of the upper sash rail 20 of the lower sash window 12 such that the nose 156 of each latch bolt 150, 150' is adapted to engage the master frame 14.

As further shown in FIGS. 68-77, the spool assembly of the presently described embodiment includes a spool support member or spool housing 728 and a spool 730. The spool housing 728 has a central opening or spool seat 732 and a channel portion 734. The spool seat 732 is configured to rotatably receive and support the spool 730 and includes an arcuate slot 731. The channel portion 734 is of an open-faced design and is defined by a base wall 736 and a pair of generally parallel side walls 738 extending from the base 736. The channel portion 734 is an open face design in the sense that the side walls 738 are sufficiently spaced such that in an assembled state, the connector 148 (FIG. 69) does not touch either side wall 738.

As further shown in FIGS. 71-74, the spool 730 includes a spool body having a spool end wall 740 and an arcuate side wall 742 depending from the end wall 740. The end wall 740 includes a throughway 744 which includes at least one keyway 746. The throughway 744 and keyway 746 are adapted to operably couple the spool 730 to the cam or rotor 134 as previously described. As discussed, a portion of the cam 134 is received in the throughway 744 which then engages the keyways 746 upon rotation by the actuator to, in turn, rotate the spool 730.

The spool body has a channel or passageway 748 through the spool 730. The channel 748, or passageway 748 passes through the end wall. In a preferred embodiment, the channel or passageway 748 is positioned off-center in the spool 730. The passageway 748 is formed in the spool 730 and is defined by a first internal wall 750 in confronting relation to a second internal wall 752. The passageway 748 is further defined by a base wall 754. The passageway 748 is open to a bottom portion of the spool 730. A pair of protrusions 756 extend from the first internal wall 750. The second internal wall 752 includes a pair of recesses 758 each generally opposed from a respective protrusion 756. Additionally, first internal wall 750 includes a centrally located recess 758 generally opposed from a centrally located recess 758 in the second internal wall 752 to create an enlarged area within the recess. This enlarged are receives a knot 149 in the connector 148. As further shown in FIG. 73, each protrusion 756 has a portion removed within the spool 730 to define a bottom wall 760 in the form of a ledge. The bottom wall 760 is spaced from the base wall 754 of the passageway 748.

As further shown in FIGS. 72-74, a peg 757 extends from a bottom portion of the spool 730. The peg 757 is received in the arcuate slot 731 when the spool 730 is received and supported by the spool housing 728. (See FIG. 70).

As previously described in connection with the embodiment of FIGS. 37-40, in an assembled state, a portion of the connector 148 passes through the passageway 744. In the embodiment of the spool 740 shown in FIGS. 71-74, when the connector 148 is received in the passageway 748, a portion of the connector 148 is received and held between the bottom wall 760 of each protrusion 756 and the base wall 754 of the passageway 748. Additionally, a knot 149 (shown schematically in FIG. 72) or otherwise enlarged portion of the connector may be received in the enlarged area of the passageway 748 formed by the opposed central recesses 758 of the first and second internal walls 750, 752. The described features of the passageway cooperate to prevent the connector 148 from moving out of the passageway after assembly and further cooperate to maintain the relative position of the connector 148 with respect to the passageway 748.

As an alternative to the above described passageway 748, an S-shaped passageway 748 could be utilized. In this situation, the central recess 758 of the second internal wall 752 could be replaced with a protrusion 756. This would create a generally S-shaped passageway 748. This configuration is generally shown in FIG. 72*a*.

FIGS. 78-85 show a means for fixing the connector 148 to the latch bolt 150 including a slot 762 and a cord hole 763 in the latch bolt 150 and a clip or fastener 764 for fixing the connector 148 to the latch bolt 150. Located within the slot 762 is a ridged wall 766. A plurality of ridges 768 is located on the ridged wall 766. Although the ridged wall 766 is shown with a plurality of ridges 768, it will be seen that the wall 766 need not have any ridges 768, or may have any of a varying number of ridges 768. It may also include another type of texturing such as protrusions. The bolt 150 also includes a pair of contact edges 778 near a rear surface 779. The latch bolt 150 also includes a front surface 781.

The clip 764 includes a base 772 and a pair of legs 774 extending from the base 772. Each leg 774 has a tab or lip 780. An underside of the base 772 includes a plurality of clip ridges 776 adapted to closely oppose the ridged wall 766 of the latch bolt 150 in an assembled state, to be seen. The legs 774 are generally resilient.

To fix the connector 148 to latch bolt 150, one end of the connector 148 is passed through the cord hole 763 from the direction of the rear surface 779 towards the front surface 781. From there, the connector 148 is then strung through the slot 762 as shown such that a portion of the connector 148 passes behind the ridged wall 766 as shown in FIGS. 78-81 and 85. The legs 774 of the clip 764 are then inserted into the slot 762 from the direction of the front surface 781 of the latch bolt 150. The legs 774 are sufficiently resilient to allow them to flex towards one another to allow the lips 780 to pass through the slot 764. Once the lips 780 have passed through the slot 762, the legs 774 move back towards their un-flexed position such that the each lip 780 engages and opposes a respective contact edge 778. In this way, a portion of the connector 148 is fixed between the clip 764 and the latch bolt 150.

Alternatively, in fixing the connector 148 to the latch bolt 150, the connector 148 may be passed through the cord hole 763 from the direction of the front surface 781 towards the rear surface 779 of the latch bolt 150. Then the connector 150 is wound through the slot 762 such that a portion of the connector 148 passes in front of the ridged wall 766, or over the plurality of ridges 768. Then the clip 764 is inserted into the slot 762 as previously described. In this way, a portion of the connector 148 is fixed to the latch bolt 150 between the clip ridges 776 and the plurality of ridges 768 of the ridged wall 766 of the latch bolt 150.

This clip arrangement provides the advantage of a near permanent attachment of the connector 148 to the latch bolt 150, along with the advantage of being able to relatively easily alter or adjust the point of connection between the connector 148 and the latch bolt 150. That is, with this clip arrangement, the connector 148 will not move with respect to the latch bolt 150 over time. On the other hand, if an alteration is required, particularly during original installation, the resilient nature of the clip legs 774 allow the clip 764 to be removed, the connector 148 to be adjusted or moved with respect to the latch bolt 150, and the clip 764 to be reinserted into the slot 762. This represents an improvement over the prior art which either includes a permanent connection, or an adjustable connection that carries with it the disadvantage of allowing the connector 148 to move or slip over time with respect to the latch bolt 150.

FIGS. 89-92 show an alternative arrangement of a spool 800, connector 148 and latch bolts 150, 150' for use in an integrated assembly of the present invention. While FIGS. 89-92 show a portion of the integrated assembly, it is understood from the previous figures and description on how the portion is connected to the remainder of the integrated assembly in a sash window assembly. One end of the connector 148 is fixed to the first latch bolt 150. This attachment is achieved either by the above described clip arrangement, or by any other known means. Another end of the connector 148 is attached or fixed to the spool 800. In a preferred embodiment, the connector 148 is connected to a side wall of the spool 800. This attachment may be by means of a hook and loop, or any type of known fastener or other means. A central portion of the connector 148 is slidingly attached to the second latch bolt 150'. This may be accomplished by winding the connector 148 in an opening or slot of the latch bolt 150'. This will allow the connector 148 to slide generally freely through the slot of the second latch bolt 150'. When the spool 800 rotates as previously described, the overall length of the connector 148 between first latch bolt 150 and the spool 800 shortens as the connector 148 is wound about the spool 800. Accordingly, the connector 148 retracts the latch bolts 150, 150' as shown in FIG. 90. It is further understood that although the connector 148 slides through a slot of the second latch bolt 150', when the spool 800 rotates, the connector 148 retracts the second latch bolt 150' as well as the first latch bolt 150.

It is further understood that the spool 800 will have a structure 801 (shown generally schematically) allowing for suitable connection with other components of the sash lock system 131 including the cam or rotor 134 and actuator 704 etc. For example, the structure 801 of the spool 800 may have an upper structure such as shown in FIG. 71 including the throughway 744 and keyways 746. (See also FIGS. 23-33). Thus, the actuator 704 may turn the cam 134 to place the integrated assembly in an unlocked position from the locked position wherein the portion of the cam 134 received in the spool 800 does not engage the surfaces of the spool 800 for rotation. As the actuator 704 is further rotated, the portion of the cam 134 engages the surfaces defined by the keyways 746 to rotate the spool 800 as shown in FIG. 90 to place the integrated assembly in a tiltable position wherein the latch bolts 150,150' are retracted. One of ordinary skill in the art, appreciates the suitable connection for the spool 800 to the other portions of the integrated assembly.

FIGS. 91-92 show another alternative arrangement of a spool 900 for use in an integrated assembly of the present invention. FIGS. 91-92 show the spool 900 connected to the latch bolts 150, 150'. While FIGS. 91-92 show a portion of the integrated assembly, it is understood from the previous figures and description on how the portion is connected to the remainder of the integrated assembly in a sash window assembly. The spool 900 includes a series of teeth 904 to form a pinion 902. Each latch bolt 150, 150' includes a rack 906 having a series of teeth 908. The pinion 902 of the spool 900 operably engage the rack 906 of the latch bolts 150, 150'. Specifically, the teeth 904 of the pinion 902 engage the teeth 908 of the rack 906. In a preferred embodiment, the teeth 904 of the pinion 902 are located on a side wall of the spool 900. When the spool 900 rotates as previously described, the described rack and pinion functions to retract the latch bolts 150, 150' as shown in FIG. 92.

As previously discussed, it is further understood that the spool 900 will have a structure 901 (shown generally schematically) allowing for suitable connection with other components of the sash lock system 131 including the cam or rotor 134 and actuator 704 etc. For example, the structure 901 of the spool 900 may have an upper structure such as shown in FIG. 71 including the throughway 744 and keyways 746. (See also FIGS. 23-33). Thus, the actuator 704 may turn the cam 134 to place the integrated assembly in an unlocked position from the locked position wherein the portion of the cam 134 received in the spool 900 does not engage the surfaces of the spool 900 for rotation. As the actuator 704 is further rotated, the portion of the cam 134 engages the surfaces defined by the keyways 746 to rotate the spool 900 as shown in FIG. 92 to place the integrated assembly in a tiltable position wherein the latch bolts 150,150' are retracted. One of ordinary skill in the art, appreciates the suitable connection for the spool 900 to the other portions of the integrated assembly.

While the integrated assembly of the present invention can be used in conventional double-hung window assemblies, it is understood that the integrated assembly could also be used in other types of window assemblies or other closure structures. In addition, it is understood that individual features of the various embodiments of the integrated assemblies described above can be combined as desired. It is further understood that the integrated assemblies described above can be utilized in sash window assemblies of various materials including vinyl, wood, composite or other types of materials. The individual components of the integrated assemblies can also be made from various materials as desired for a particular application. It is further understood that individual features of the invention may be utilized in sash window assemblies not incorporating an integrated assembly, but rather separate sash lock mechanisms and tilt-latch mechanisms. The sash lock mechanism could also be operable to engage a portion of the sash window assembly including the upper sash window wherein a keeper is not necessary.

While the above invention has been described as separate embodiments, it is contemplated that various aspects of each embodiment may be used in connection with each of the other embodiments without departing from the present invention. Further, while the specific embodiments have been illustrated and described, numerous modifications come to mind without significantly departing from the spirit of the invention and the scope of protection is only limited by the scope of the accompanying claims.

What is claimed is:

1. An integrated tilt-latch/sash lock assembly for a sash window assembly, the sash window assembly having an upper sash window and a lower sash window slideable within a master frame, and a keeper connected to the upper sash window, the tilt-latch/sash lock assembly comprising a rotor assembly configured to be supported by the lower sash window having a rotor adapted to engage the keeper;

a latch bolt configured to be supported by the lower sash window and configured to engage the master frame;

a connector operably connected to the rotor and having a first end portion;

a fastener for releasably fixing the first end portion between the fastener and the latch bolt;

an actuator operably connected to the rotor, the actuator having a locked position wherein the rotor is adapted to engage the keeper, the actuator being moveable to an unlocked position wherein the rotor is adapted to disengage from the keeper, and being further moveable to a tiltable position wherein the connector retracts the latch bolt from the master frame wherein the fastener has a base and a pair of legs extending therefrom for releasably engaging the bolt and wherein the bolt comprises a pair of contact edges and each leg comprises a lip for an engaging a respective contact edge.

2. The integrated tilt-latch/sash lock assembly of claim 1 wherein the bolt comprises a slot for receiving the fastener.

3. The integrated tilt-latch/sash lock assembly of claim 2 wherein the fastener has a base having a plurality of base-ridges and the bolt has a plurality of bolt-ridges wherein the base-ridges generally confront the bolt-ridges.

4. The integrated tilt-latch/sash lock assembly of claim 3 further including a cord wherein the cord is received between the base ridges and the bolt-ridges.

5. The integrated tilt-latch/sash lock assembly of claim 4 wherein the bolt has a cord-hole.

6. An integrated tilt-latch/sash lock assembly for a sash window assembly, the sash window assembly having an upper sash window and a lower sash window slideable within a master frame, the tilt-latch/sash lock assembly comprising:

a sash lock housing configured to be supported by the lower sash and having a rotor adapted to engage the master fame, the sash lock housing having a central opening having an annular groove surrounding the central opening;

an actuator extending through the central opening and operably connected to the rotor, the actuator having a protuberance received by the annular groove wherein the annular groove has a bump that cooperates with the protuberance to provide the user a tactile indication that the actuator is in one of the locked position, unlocked position and tillable position;

a pair of latch bolts configured to be supported by the lower sash window and each latch bolt configured to engage the master frame;

a connector having a first end connected to one of the pair of latch bolts and a second end connected to the other of the pair of latch bolts, the connector operably associated with the rotor;

wherein the actuator has a locked position wherein the rotor is adapted to engage the master frame, the actuator being moveable to an unlocked position wherein the rotor is adapted to disengage from the master frame, and being further moveable to a tiltable position wherein the rotor rotates to wind the connector thereby retracting each latch bolts.

7. The integrated tilt-latch/sash lock assembly of claim 6 wherein the annular groove has a first end wall that cooperates with the protuberance to limit a range of movement of the actuator.

8. The integrated tilt-latch/sash lock assembly of claim 7 wherein the first end wall and protuberance cooperate to prevent the actuator from moving past the tiltable position from the unlocked position.

9. The integrated tilt-latch/sash lock assembly of claim 7 wherein the first end wall and protuberance cooperate to prevent the actuator from moving past the locked position from the unlocked position.

10. The integrated tilt-latch/sash lock assembly of claim 7 wherein the annular groove further has a second end wall, the first end wall and the second end wall cooperating with the protuberance to define the range of movement of the actuator.

11. An integrated tilt-latch/sash lock assembly for a sash window assembly, the sash window assembly having an upper sash window and a lower sash window slideable within a master frame, the tilt-latch/sash lock assembly comprising:

a sash lock housing configured to be supported by the lower sash and having a rotor adapted to engage the master fame, the sash lock housing having a central opening having an annular groove surrounding the central opening;

an actuator extending through the central opening and operably connected to the rotor, the actuator having a protuberance received by the annular groove wherein the annular groove has a first end wall, a second end wall, a first bump and a second bump, wherein the first end wall and the first bump cooperate with the protuberance to provide a tactile indication to a user that the actuator is in the locked position, the first bump and the second bump cooperate with the protuberance to provide a tactile indication to the user that the actuator is in the unlocked position, and the second bump and the second end wall cooperate with the protuberance to provide a tactile indication to the user that the actuator is in the tiltable position;

a pair of latch bolts configured to be supported by the lower sash window and each latch bolt configured to engage the master frame, a connector having a first end connected to one of the pair of latch bolts and a second end connected to the other of the pair of latch bolts, the connector operably associated with the rotor;

wherein the actuator has a locked position wherein the rotor is adapted to engage the master frame, the actuator being moveable to an unlocked position wherein the rotor is adapted to disengage from the master frame, and being further moveable to a tiltable position wherein the rotor rotates to wind the connector thereby retracting each latch bolts.

* * * * *